US006346356B1

(12) United States Patent
Ohno et al.

(10) Patent No.: US 6,346,356 B1
(45) Date of Patent: Feb. 12, 2002

(54) TONER, TONER PRODUCTION PROCESS, AND IMAGE-FORMING METHOD

(75) Inventors: Manabu Ohno, Numazu; Toshiyuki Ugai, Toride; Ryoichi Fujita, Odawara; Shinya Yachi, Mishima; Yasushi Katsuta; Kenichi Nakayama, both of Shizuoka-ken, all of (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 09/572,642

(22) Filed: May 17, 2000

(30) Foreign Application Priority Data

May 17, 1999 (JP) ..... 11-135835
Apr. 27, 2000 (JP) ..... 2000-127522

(51) Int. Cl.[7] ..... G03G 9/097

(52) U.S. Cl. ..... 430/108.2; 430/108.1; 430/108.4; 430/137.17; 430/125; 430/126

(58) Field of Search ..... 430/110, 111, 430/137, 108.2, 108.4, 108.1, 110.3, 110.1, 137.17, 126, 125

(56) References Cited

U.S. PATENT DOCUMENTS

| | | | | | |
|---|---|---|---|---|---|
| 5,424,162 | A | | 6/1995 | Kohri et al. | 430/110 |
| 5,451,482 | A | * | 9/1995 | Law et al. | 430/110 |
| 5,700,617 | A | | 12/1997 | Takiguchi et al. | 430/110 |
| 5,747,209 | A | | 5/1998 | Takiguchi et al. | 430/106.6 |
| 6,063,537 | A | * | 5/2000 | Nakamura et al. | 430/110 |
| 6,096,468 | A | * | 8/2000 | Ohno et al. | 430/110 |
| 6,183,927 | B1 | * | 2/2001 | Magome et al. | 430/110 |

FOREIGN PATENT DOCUMENTS

| | | | | |
|---|---|---|---|---|
| EP | 0490370 | | 6/1992 | G03G/9/097 |
| EP | 0869398 | | 10/1998 | G03G/9/08 |
| JP | 36-10231 | * | 7/1961 | |
| JP | 42-23910 | * | 11/1967 | |
| JP | 24748 | | 10/1968 | |
| JP | 51-14895 | * | 2/1976 | |
| JP | 17735 | | 2/1978 | |
| JP | 13945 | | 4/1981 | |
| JP | 53856 | | 3/1984 | |
| JP | 61842 | | 4/1984 | |
| JP | 238846 | | 10/1986 | |
| JP | 33755 | | 2/1988 | |
| JP | 190869 | | 7/1990 | |
| JP | 230163 | | 9/1990 | |
| JP | 84558 | | 4/1991 | |
| JP | 347863 | | 12/1992 | |
| JP | 134457 | | 5/1993 | |
| JP | 6-348055 | * | 12/1994 | |
| JP | 9197714 | | 7/1997 | G03G/9/08 |
| WO | 96/20436 | * | 7/1996 | |

OTHER PUBLICATIONS

English language machine translation of JP 6–348055, Dec. 1994.*
Translation of JP 6–348055 Dec. 1994.*
Translation of JP 9–197714.*

* cited by examiner

*Primary Examiner*—Christopher Rodee
(74) *Attorney, Agent, or Firm*—Fitzpatrick, Cella, Harper & Scinto

(57) ABSTRACT

A toner is comprised of toner particles containing at least a binder resin, a colorant, a wax component and an oxycarboxylic acid. The toner satisfies the following conditions:

$$1.05 \leqq A/B \leqq 3.00,$$

and $$0.15 \leqq B \leqq 3.50$$

wherein A (mg) is a weight of oxycarboxylic acid extracted with methanol from 1 g of the toner, and B (mg) is a weight of oxycarboxylic acid extracted with an aqueous 0.1 mol/liter sodium hydroxide solution from 1 g of the toner.

39 Claims, 17 Drawing Sheets

TONER, TONER PRODUCTION PROCESS, AND IMAGE-FORMING METHOD

BACKGROUND OF THE INVENTION

1. Field of the Invention

This invention relates to a toner used in recording processes carried out by electrophotography, electrostatic recording, magnetic recording and toner-jet recording, a process for producing the toner, and an image-forming method employing the toner. More particularly, the present invention relates to a toner used in image-recording apparatus utilizable in copying machines, printers, fax machines, plotters and so forth, a process for producing the toner, and an image-forming method employing the toner.

2. Related Background Art

Various methods are conventionally proposed as electrophotography in U.S. Pat. No. 2,297,691, Japanese Patent Publications No. 42-23910 and No. 43-24748 and so forth. Methods by which electrostatic latent images are developed include dry-process development and wet-process development. Also, the dry-process development is grouped into a method employing a two-component developer and a method employing a one-component developer. Toners used in the dry-process development are commonly colored fine resin particles containing a binder resin, a colorant and a wax as chief constituents. Usually, they have a particle diameter of about 6 $\mu$m to about 15 $\mu$m as number-average particle diameter. As processes for producing toners comprised of such colored fine resin particles, commonly used is a production process, what is called pulverization, in which a binder resin, a colorant such as a dye or pigment and/or a magnetic material, a wax and so forth are melt-kneaded, the kneaded product obtained is cooled and thereafter pulverized and the pulverized product obtained is further classified to obtain a toner.

Toners produced by such a process must be so made up as to have positive or negative electric charges in accordance with the charge polarity of electrostatic latent images to be developed. To make a toner have electric charges, the triboelectric chargeability of a binder resin, which is a chief constituent of the toner, may be utilized, but such a means alone can not impart a sufficient charging performance to a toner. Accordingly, in order to impart the desired triboelectric chargeability to toners, a charge control agent is added. Toners containing such a charge control agent can provide a relatively large quantity of triboelectricity, but may commonly cause a lowering of the quantity of triboelectricity in an environment of high humidity and on the other hand a lowering of toner's charging rate in an environment of low humidity.

One of the causes thereof is considered to be the adsorption of moisture that occurs in the vicinity of the charge control agent contained in toner particles and at toner particle surfaces. More specifically, it is considered that in the environment of high humidity the moisture is adsorbed to the charge control agent in a large quantity to lower the quantity of triboelectricity and that in the environment of low humidity the moisture is adsorbed to the charge control agent in a small quantity and hence the resistance becomes higher to lower the charging rate.

Nowadays, as charge control agents known in the present technical field, negatively chargeable ones include metal salts of monoazo dyes and copper phthalocyanine pigments.

Most of the charge control agents, though having a sufficiently high charge-providing ability, have so poor a charge controllability that there has been limitations on binder resins and other materials which are usable in combination.

Japanese Patent Applications Laid-open No. 63-33755, No. 2-190869, No. 2-230163 and No. 4-347863 disclose toners making use of salicylic acid or derivatives thereof as charge control agents. The salicylic acid, however, not only makes charge controllability greatly variable depending on temperature and humidity but also has sublimation properties, and hence toner's storage conditions are greatly restricted. Also, salicylic acid derivatives have a good dispersibility to binder resins, and hence toner's matching to image-forming apparatus can be improved to a certain extent. However, it has been necessary to add them in a large quantity in order for them to exhibit the desired charge controllability.

Japanese Patent Applications Laid-open No. 61-238846 and No. 5-134457 disclose toners obtained by depositing a charge control agent on toner particle surfaces in order to attain a uniform charge-providing ability. Such a method certainly makes toner's charging performance stable. However, as a result of running on many sheets, the charge control agent may come off the toner particle surfaces to become less effective to cause a problem on the running performance of toners.

Japanese Patent Application Laid-open No. 3-84558 also discloses a toner prepared by first producing spherical particles, thereafter immersing the spherical particles in an organic solvent in which a charge control agent pigment has been dissolved or dispersed, and then controlling the concentration of the charge control agent pigment on the particle surface to a stated range while washing off any unwanted matter. However, the charge control agent pigment on particle surfaces of the toner obtained by such a method stands dispersed non-uniformly, and causes a problem on toner's matching to image-forming apparatus. Also, since the pigment is used, it is difficult to use the toner as a color toner.

In recent years, as electrophotographic images are sought to have much higher image quality and much higher resolution, toners are required to have smaller particle diameter and higher function. Under such circumstances, processes for producing toners by polymerization have attracted notice. For example, as the processes for producing toners by polymerization, Japanese Patent Publications No. 36-10231 and No. 51-14895 and Japanese Patent Application Laid-open No. 53-17735 disclose processes for producing toners by suspension polymerization. In the processes, a colorant and further optionally a polymerization initiator, a dispersant, a cross-linking agent, a charge control agent, a release agent, a polar resin and other additives are dissolved or dispersed in a polymerizable monomer which is a material for a binder resin, thus a polymerizable monomer composition is prepared. The polymerizable monomer composition thus obtained is introduced into an aqueous dispersion medium containing a dispersion stabilizer, having been prepared beforehand, to carry out granulation by the use of a stirrer to form particles of fine particle size, and thereafter polymerizable monomers present in the granulation particles are polymerized to solidify the particles, followed by filtration, washing and then drying to obtain toner particles having the desired particle diameter and composition.

Such toners produced by polymerization are toners having a small particle diameter which enable formation of images having a good quality, and have a sharp particle size distribution. Hence, they have superior matching to image-forming apparatus.

However, in the suspension polymerization in which polymerizable monomers present in granulation particles formed in an aqueous dispersion medium are polymerized, the granulation particles and the aqueous dispersion medium come into contact in so large a contact area that any toner constituent material having many polar groups tends to dissolve out of the interior of granulation particles into the aqueous dispersion medium, so that the toner constituent material having many polar groups that is present at toner particle surfaces and in the vicinity of the surfaces may become non-uniform in its content. Thus, it has been difficult to obtain toners having charging performance with a superior environmental stability.

Studies made by the present inventors have revealed that, when a toner containing an oxycarboxylic acid such as salicylic acid is produced by such suspension polymerization, the oxycarboxylic acid may so seriously dissolve into the aqueous dispersion medium that the oxycarboxylic acid present at toner particle surfaces and in the vicinity of the surfaces may become non-uniform in its content to cause problems such that the charging performance is affected by temperature and humidity to vary greatly and, due to poor matching to image-forming apparatus, a toner-carrying member is contaminated with toner.

SUMMARY OF THE INVENTION

An object of the present invention is to provide a toner having solved such problems the prior art has had, and a process for producing the toner.

More specifically, an object of the present invention is to provide a toner which has superior environmental stability and charging performance and enables high-quality images to be formed stably over a long period of time, and a process for producing such a toner.

Another object of the present invention is to provide a toner which is highly applicable to electrophotographic processes and free of adverse effect on a toner-carrying member, etc. such as contamination, and a process for producing such a toner.

Still another object of the present invention is to provide an image-forming method suited to development according to a one-component contact development system.

A further object of the present invention is to provide an image-forming method suited to a cleaning-at-development system in which the toner remaining on the surface of an image-bearing member after the step of transfer is collected by a developing assembly simultaneously in the step of development.

A still further object of the present invention is to provide an image-forming method that enables formation of stable images over a long period of time without causing any faulty images due to faulty charging, even in a contact charging system making use of a contact charging member.

A still further object of the present invention is to provide an image-forming method that enables formation of stable images over a long period of time while reducing transfer residual toner and without causing any faulty images due to faulty charging, even in a contact transfer system making use of a contact transfer member.

A still further object of the present invention is to provide an image-forming method promising a superior running performance, that can smoothly collect transfer residual toner at the time of development even when applied in a higher-speed image-forming process, and enables formation of stable images over a long period of time by virtue of stable developing performance.

To achieve the above objects, the present invention provides a toner comprising toner particles containing at least a binder resin, a colorant, a wax component and an oxycarboxylic acid, wherein:

where the weight of oxycarboxylic acid extracted with methanol from 1 g of the toner is represented by A (mg) and the weight of oxycarboxylic acid extracted with 0.1 mol/liter of an aqueous sodium hydroxide solution from 1 g of the toner is represented by B (mg), the toner satisfies:

$$1.05 \leqq A/B \leqq 3.00,$$

and $$0.10 \leqq B \leqq 3.50.$$

The present invention also provides a process for producing a toner, comprising:

a granulation step of dispersing in an aqueous dispersion medium a polymerizable monomer composition containing at least a polymerizable vinyl monomer, a colorant, a wax component, a polymerization initiator and an oxycarboxylic acid, to form particles of the polymerizable vinyl monomer composition; and a polymerization step of polymerizing the polymerizable vinyl monomer present in the particles of the polymerizable monomer composition to form toner particles;

wherein the reaction to polymerize the polymerizable vinyl monomer in the course of from the granulation step to the polymerization step comprises a first reaction step carried out to enhance the polymerization conversion of the polymerizable vinyl monomer to 10% or higher while keeping pH of the aqueous dispersion medium at 4.5 to 8.5, and a second reaction step carried out after the first reaction step while adjusting pH of the aqueous dispersion medium to 9 to 13 to further enhance the polymerization conversion.

The present invention still also provides a process for producing a toner, comprising:

a granulation step of dispersing in an aqueous dispersion medium a polymerizable monomer composition containing at least a polymerizable vinyl monomer, a colorant, a wax component, a polymerization initiator and an oxycarboxylic acid, to form particles of the polymerizable monomer composition;

a polymerization step of polymerizing the polymerizable vinyl monomer present in the particles of the polymerizable monomer composition to form toner particles;

a distillation step of removing the polymerizable vinyl monomer remaining in the toner particles;

a filtration step of solid-liquid separating the toner particles from the aqueous dispersion medium; and a washing step of washing the toner particles;

wherein the reaction to polymerize the polymerizable vinyl monomer in the course of from the granulation step to the polymerization step is carried out in the aqueous dispersion medium at pH of 4.5 to 8.5, and then, after pH of the aqueous dispersion medium is adjusted to 9 to 13, the distillation step is carried out at a temperature not lower than the glass transition temperature of the binder resin of the toner.

The present invention further provides an image-forming method comprising:

a charging step of charging an image-bearing member for holding thereon an electrostatic latent image;

an exposure step of subjecting the image-bearing member thus charged, to exposure to form an electrostatic latent image;

a developing step of developing the electrostatic latent image by the use of a toner held on the surface of a toner-carrying member, to from a toner image; and a transfer step of transferring the toner image formed on the image-bearing member, to a transfer medium via, or not via, an intermediate transfer member;

wherein;

the toner comprises toner particles containing at least a binder resin, a colorant, a wax component and an oxycarboxylic acid; and where the weight of oxycarboxylic acid extracted with methanol from 1 g of the toner is represented by A (mg) and the weight of oxycarboxylic acid extracted with 0.1 mol/liter of an aqueous sodium hydroxide solution from 1 g of the toner is represented by B (mg), the toner satisfies:

$$1.05 \leqq A/B \leqq 3.00,$$

and $$0.10 \leqq B \leqq 3.50.$$

DESCRIPTION OF THE PREFERRED EMBODIMENTS

Figure 1A:
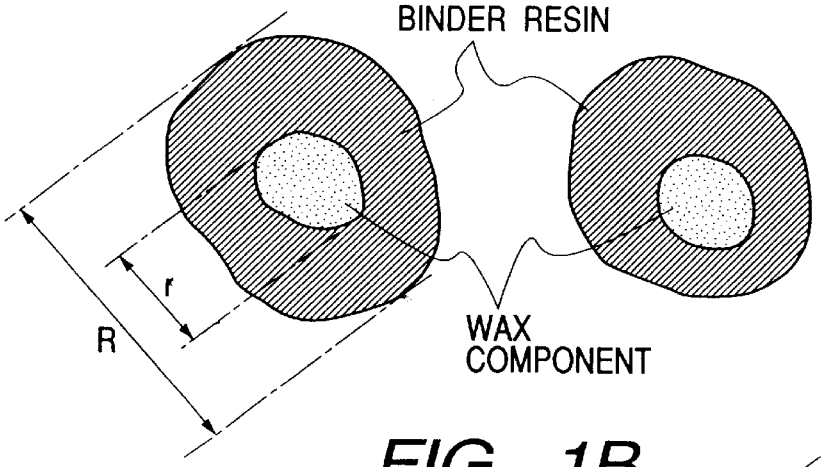
FIGS. 1A, 1B, 1C and 1D are diagrammatic views showing examples of cross sections of toner particles encapsulating a wax component.

As a result of extensive studies, the present inventors have discovered that a toner having a very good charging performance and having a superior matching to image-forming apparatus can be obtained by specifying a state where an oxycarboxylic acid is incorporated at toner particle surfaces and in the vicinity of the surfaces, and accomplished the present invention.

{Toner}

Features, materials and so forth in making up the toner will be described first.

The toner of the present invention comprises toner particles containing at least a binder resin, a colorant, a wax component and an oxycarboxylic acid, and, where the weight of oxycarboxylic acid extracted with methanol from 1 g of the toner is represented by A (mg) and the weight of oxycarboxylic acid extracted with 0.1 mol/liter of an aqueous sodium hydroxide solution from 1 g of the toner is represented by B (mg), satisfies:

$$1.05 \leqq A/B \leqq 3.00,$$

and $$0.10 \leqq B \leqq 3.50.$$

This makes it possible to control quantity of triboelectricity and charging rate to impart the desired charging performance to the toner.

The weight A (mg) of oxycarboxylic acid extracted with methanol from 1 g of the toner (hereinafter often "oxycarboxylic-acid weight A") refers to the weight of oxycarboxylic acid present at the surfaces of toner particles and their surface layer portions (the vicinity of surfaces) in which the methanol is permeable. Also, the weight B (mg) of oxycarboxylic acid extracted with 0.1 mol/liter of an aqueous sodium hydroxide solution from 1 g of the toner (hereinafter often "oxycarboxylic-acid weight B") refers to the weight of oxycarboxylic acid present at the surfaces of toner particles. The present inventors consider that each of these governs the charge quantity (quantity of triboelectricity) of toner and the charging rate of toner.

More specifically, if the value of B is less than 0.10, the toner can not retain a sufficient charging performance. If the value of B is more than 3.50, the charging performance may greatly lower because of the effect of moisture absorption of the oxycarboxylic acid when the toner is left in a high-temperature/high-humidity environment.

If the value of A/B is less than 1.05, the moisture absorption effect of the oxycarboxylic acid present at the toner particle surfaces acts more strongly than the charge-providing effect of the oxycarboxylic acid present in the vicinity of the surfaces in a high-temperature/high-humidity environment to make the toner have a poor charging performance. If on the other hand the value of A/B is more than 3.00, the resistance in the vicinity of toner particle surfaces acts more strongly than the chargeability of the oxycarboxylic acid present at the toner particle surfaces to lower a charging rate.

The oxycarboxylic-acid weight A (extracted with methanol from the toner) and the oxycarboxylic-acid weight B (extracted with 0.1 mol/liter of an aqueous sodium hydroxide solution) may also have a relationship that satisfies $A \leqq (3/4)B+1$. In such a case, image deterioration can be greatly inhibited upon many-sheet printing.

As the oxycarboxylic acid according to the present invention, any known compounds may be used. From the viewpoint of charge-providing ability, a compound represented by the following Formula (1) or (2) may preferably be used.

Formula (1)

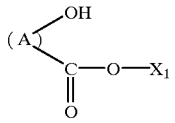

In the above Formula (1), (A) is selected from the following groups; and $X_1$ represents a hydrogen atom, a sodium atom, a potassium atom, an ammonium group or an aliphatic ammonium group.

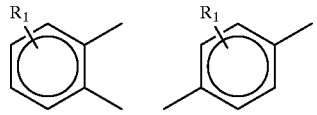

wherein $R_1$ represents a hydrogen atom, or at least one substituent selected from the group consisting of an alkyl group having 1 to 18 carbon atoms, an alkenyl group having 2 to 18 carbon atoms, an aralkyl group, an alkoxyl group, a halogen atom, a nitro group, a cyano group, an amino group, a carboxyl group and a hydroxyl group.

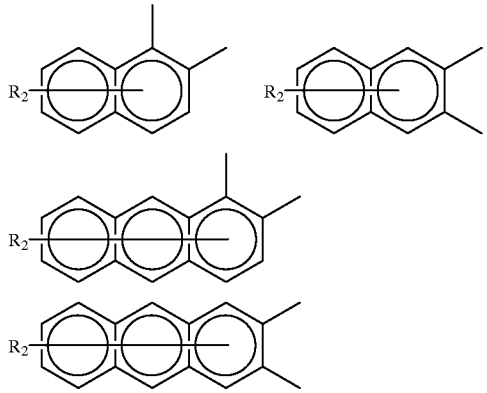

wherein $R_2$ represents a hydrogen atom, or at least one substituent selected from the group consisting of an alkyl group having 1 to 18 carbon atoms, an alkoxyl group having 1 to 18 carbon atoms, a halogen atom and a nitro group.

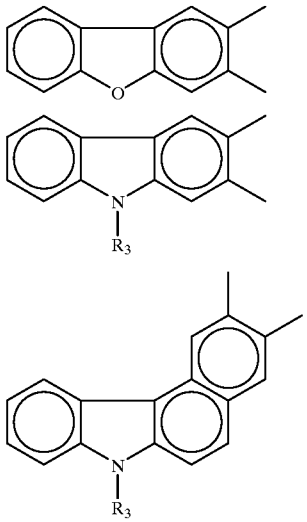

wherein $R_3$ represents a hydrogen atom, an alkyl group having 1 to 22 carbon atoms or an alkenyl group having 2 to 22 carbon atoms.

Formula (2)

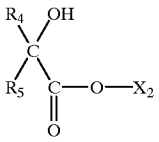

In the above Formula (2), $X_2$ represents a hydrogen atom, a sodium atom, a potassium atom, an ammonium group or an aliphatic ammonium group; $R_4$ represents an alkyl group having 1 to 22 carbon atoms, an alkenyl group having 2 to 22 carbon atoms or an aryl group; and $R_5$ represents a hydrogen atom, an alkyl group having 1 to 22 carbon atoms, an alkenyl group having 2 to 22 carbon atoms, an aryl group or an alkoxyl group.

Of the oxycarboxylic acids represented by Formulas (1) and (2), preferably usable in the present invention are oxycarboxylic acids having an aromatic ring. They may include monoalkyl aromatic oxycarboxylic acids such as 5-tert-octylsalicylic acid and dialkyl aromatic oxycarboxylic acids such as di-tert-butylsalicylic acid. Besides these, they may also include salicylic acid, hydroxynaphthoic acid and benzilic acid. These compounds are readily fixable at toner particle surfaces, and hence are preferably usable in the present invention.

Typical exemplary compounds are listed below.

Oxycarboxylic acid (1-A)

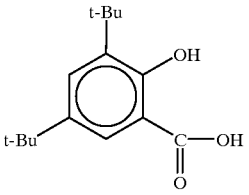

-continued
Oxycarboxylic acid (1-B)
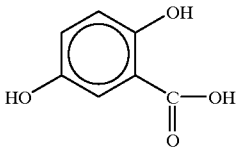
Oxycarboxylic acid (1-C)
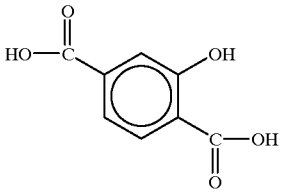
Oxycarboxylic acid (1-D)
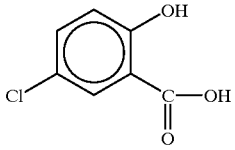
Oxycarboxylic acid (1-E)
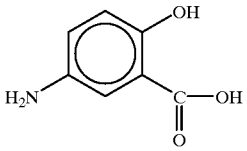
Oxycarboxylic acid (1-F)
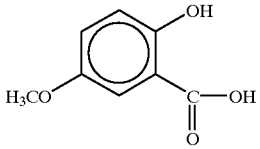
Oxycarboxylic acid (1-G)
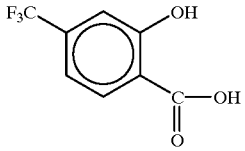
Oxycarboxylic acid (1-H)
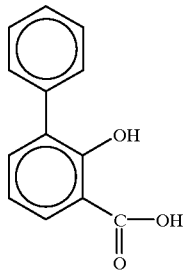
Oxycarboxylic acid (1-I)
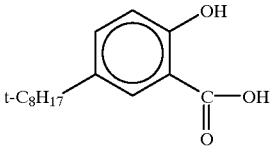
-continued
Oxycarboxylic acid (1-J)
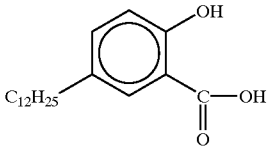
Oxycarboxylic acid (1-K)
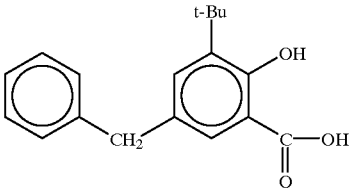
Oxycarboxylic acid (1-L)
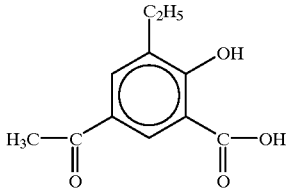
Oxycarboxylic acid (1-M)
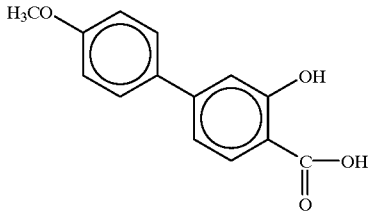
Oxycarboxylic acid (1-N)
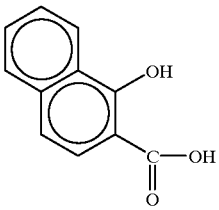
Oxycarboxylic acid (1-O)
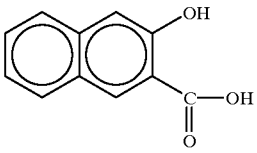
Oxycarboxylic acid (1-P)
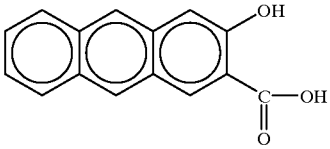

-continued

Oxycarboxylic acid (1-Q)

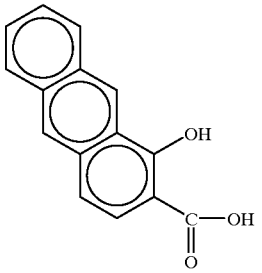

Oxycarboxylic acid (1-R)

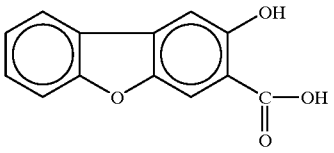

Oxycarboxylic acid (1-S)

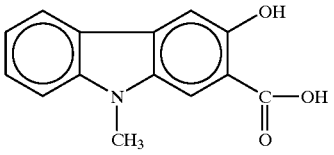

Oxycarboxylic acid (1-T)

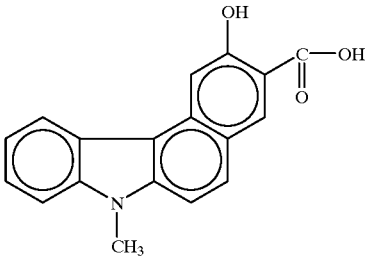

Oxycarboxylic acid (2-A)

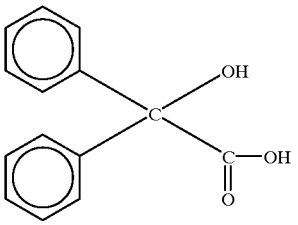

-continued

Oxycarboxylic acid (2-B)

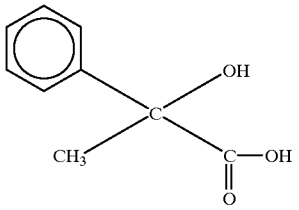

Oxycarboxylic acid (2-C)

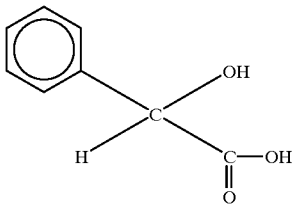

Oxycarboxylic acid (2-D)

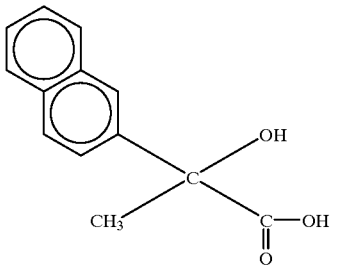

Oxycarboxylic acid (2-E)

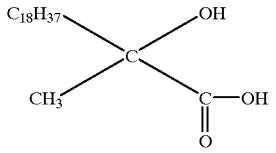

In the present invention, the oxycarboxylic-acid weight A (extracted with methanol from the toner) and the oxycarboxylic-acid weight B (extracted with 0.1 mol/liter of an aqueous sodium hydroxide solution) are measured in the following way.

Methanol and an aqueous 0.1 mol/liter sodium hydroxide solution to which 0.04 g of a dispersant CONTAMINON N (trade name; available from Wako Pure Chemical Industries, Ltd.) were put in separate containers in. an amount of 50 ml for each. Toner weighed in an amount of 1 g is added to each of them, and then stirred at 50 rpm by means of a stirrer to disperse it uniformly. After the dispersion treatment is made for 3 hours, filtration is effected using a membrane filter (pore size: 0.45 $\mu$m). Absorption spectra of the filtrates obtained are measured with a spectrophotometer to determine differences between maximum values of maximum absorption peaks due to the oxycarboxylic acid and base lines. From the results obtained, the oxycarboxylic-acid weight A (at toner particle surfaces and in surface layer portions) and the oxycarboxylic-acid weight B (at toner particle surfaces) are calculated using a predetermined calibration curve. The absorption spectrum of the oxycarboxylic acid appears in the range of, e.g., from 280 to 350 nm.

The toner of the present invention can be prevented from its melt-adhesion to the toner-carrying member which is caused by an increase in transfer residual toner or a lowering of developing efficiency, especially when it has a good circularity distribution.

In the toner of the present invention, the particle shape of toner may precisely be so controlled that, in a number-based circle-corresponding diameter/circularity scatter diagram as measured with a flow type particle image analyzer, the toner can have a circle-corresponding number-average particle diameter D1 ($\mu$m) of from 2 to 10 $\mu$m and also can have an average circularity of from 0.920 to 0.995 and a circularity standard deviation of less than 0.040, whereby the toner can be more improved in the effect attributable to the addition of the oxycarboxylic acid incorporated in the toner in a specific state of presence. The reason therefor is not necessarily clear. The present inventors presume that the control of the particle shape of toner as described above also brings the surface shape of toner into a uniform state, and hence the oxycarboxylic acid comes to act in a good efficiency, so that the charging performance can be desirably improved without deteriorating the powder characteristics of the toner. Thus, the toner can be improved in its developing performance and transfer performance in a well balanced state and also can greatly be improved in its matching to image-forming apparatus.

More specifically, when the toner is made to have a circle-corresponding number-average particle diameter D1 ($\mu$m) of from 2 to 10 $\mu$m in a small particle diameter, the reproducibility of images at their contour portions can be improved especially in the development of character images or line patterns. Also, when the toner is made to have an average circularity of from 0.920 to 0.995, preferably from 0.950 to 0.995, and more preferably from 0.970 to 0.990 in its circularity frequency distribution, the toner having a small particle diameter can greatly be improved in its transfer performance, which has ever been difficult to realize, and also can greatly be improved in the developability for low-potential latent images. Such tendencies appear very effectively, especially when minute spot latent images in a digital type are developed or when toner images are transferred many times through an intermediate transfer member to form a full-color image, also bringing about a good matching to image-forming apparatus.

In the toner of the present invention, the circularity standard deviation may be controlled to be less than 0.040, preferably less than 0.035, and more preferably from 0.015 to less than 0.035. This can bring about a great improvement of properties relating to developing performance.

A toner having an average circularity less than 0.950 in its circularity frequency distribution may be in a content of 15% by number or less. This brings the development efficiency in image formation to a satisfactory level and also enables good image formation.

The average circularity, the circularity standard deviation and the percent by number of the toner having an average circularity less than 0.950 can be controlled by adjusting pH of an aqueous medium at the time of polymerization reaction in the course of from the step of granulation to the step of polymerization.

The circularity referred to in the present invention is used as a simple method for quantitatively expressing the shape of toner. In the present invention, the shape of particles is measured with a flow type particle image analyzer FPIA-1000, manufactured by Toa Iyou Denshi K.K., and the circularity is calculated according to the following equation. Further, as shown in the following equation, the value obtained when the sum total of the circularity of all particles measured is divided by the number of all particles is defined to be the average circularity.

$$\text{Circularity} = \frac{\text{Circumferential length of a circle with the same area as particle projected area}}{\text{Circumferential length of particle projected image}}$$

$$\text{Average circularity } \bar{c} = \sum_{i=1}^{m} (c_i / m)$$

$$\text{Circularity standard deviation } SDc = \left\{ \sum_{i=1}^{m} (\bar{c} - c_i)^2 / m \right\}^{1/2}$$

In the above, the "particle projected area" is the area of a binary-coded toner particle image, and the "circumferential length of particle projected image" is defined to be the length of a contour line formed by connecting edge points of the toner particle image.

The measuring device "FPIA-1000" used in the present invention employs a calculation method in which, in calculating the circularity of each particle and thereafter calculating the average circularity and circularity standard deviation, circularities of 0.400 to 1.000 are divided into division ranges, which are divided into 61 ranges at intervals of 0.010 as from 0.400 to less than 0.410, from 0.410 to less than 0.420, . . . from 0.990 to less than 1.000, and 1.000, and the average circularity and circularity standard deviation are calculated using the center values and frequencies of divided points.

Between the values of the average circularity and circularity standard deviation calculated by this calculation method and the values of the average circularity and circularity standard deviation calculated by the above calculation equation which uses the circularity of each particle directly, there is only a very small accidental error, which is at a level that is substantially negligible. Accordingly, in the present invention, for the reasons of data handling, e.g., a reduction in the calculation time and simplification of the operational equation for calculation, such a calculation method is used in which the concept of the calculation equation directly using the circularity of each particle is utilized and modification is partly added.

The circularity referred to in the present invention is an index showing a degree of the surface unevenness of particles. It is indicated as 1.000 when the particles are perfectly spherical. The more complicated the surface shape is, the smaller the value of circularity is.

The circle-corresponding diameter is a value defined to be:

$$\text{Circle-corresponding diameter} = (\text{particle projected area}/\pi)^{1/2} \times 2.$$

The circle-corresponding number-average particle diameter (D1) represents a number-based, average value of the circle-corresponding diameters of toner and, where the particle diameter (center value) at a divided point i is represented by di and the frequency at that point by fi, it is expressed by the following equation.

Circle-corresponding number-average particle diameter $$(D1) = \sum_{i=1}^{n} (fi \times di) \Big/ \sum_{i=1}^{n} fi$$

Similarly, its standard deviation is expressed as follows:

Circle-corresponding diameter standard deviation $$SDd = \left( \sum_{i=1}^{n} (D1 - di)^2 \Big/ \sum_{i=1}^{n} fi \right)^{1/2}$$

The divided points of the particle size distribution in the present invention are as shown in the following table.

In the following table, the upper-limit numeral in each particle diameter range does not include that numeral itself to mean that it is indicated as "less than".

TABLE

| Particle diameter ranges | | | |
|---|---|---|---|
| (μm) | (μm) | (μm) | (μm) |
| 0.60–0.61 | 1.12–1.16 | 2.12–2.18 | 4.00–4.12 |
| 0.61–0.63 | 1.16–1.19 | 2.18–2.25 | 4.12–4.24 |
| 0.63–0.65 | 1.19–1.23 | 2.25–2.31 | 4.24–4.36 |
| 0.65–0.67 | 1.23–1.26 | 2.31–2.38 | 4.36–4.49 |
| 0.67–0.69 | 1.26–1.30 | 2.38–2.45 | 4.49–4.62 |
| 0.69–0.71 | 1.30–1.34 | 2.45–2.52 | 4.62–4.76 |
| 0.71–0.73 | 1.34–1.38 | 2.52–2.60 | 4.76–4.90 |
| 0.73–0.75 | 1.38–1.42 | 2.60–2.67 | 4.90–5.04 |
| 0.75–0.77 | 1.42–1.46 | 2.67–2.75 | 5.04–5.19 |
| 0.77–0.80 | 1.46–1.50 | 2.75–2.83 | 5.19–5.34 |
| 0.80–0.82 | 1.50–1.55 | 2.83–2.91 | 5.34–5.49 |
| 0.82–0.84 | 1.55–1.59 | 2.91–3.00 | 5.49–5.65 |
| 0.84–0.87 | 1.59–1.64 | 3.00–3.09 | 5.65–5.82 |
| 0.87–0.89 | 1.64–1.69 | 3.09–3.18 | 5.82–5.99 |
| 0.89–0.92 | 1.69–1.73 | 3.18–3.27 | 5.99–6.16 |
| 0.92–0.95 | 1.73–1.79 | 3.27–3.37 | 6.16–6.34 |
| 0.96–0.97 | 1.79–1.84 | 3.37–3.46 | 6.34–6.53 |
| 0.97–1.00 | 1.84–1.89 | 3.46–3.57 | 6.53–6.72 |
| 1.00–1.03 | 1.89–1.95 | 3.57–3.67 | 6.72–6.92 |
| 1.03–1.06 | 1.95–2.00 | 3.67–3.78 | 6.92–7.12 |
| 1.06–1.09 | 2.00–2.06 | 3.78–3.89 | 7.12–7.33 |
| 1.09–1.12 | 2.06–2.12 | 3.89–4.00 | 7.33–7.54 |
| Particle diameter ranges | | | |
| (μm) | (μm) | (μm) | (μm) |
| 7.54–7.76 | 14.20–14.62 | 26.75–27.53 | 50.37–51.84 |
| 7.76–7.99 | 14.62–15.04 | 27.53–28.33 | 51.84–53.36 |
| 7.99–8.22 | 15.04–15.48 | 28.33–29.16 | 53.36–54.91 |
| 8.22–8.46 | 15.48–15.93 | 29.16–30.01 | 54.91–56.52 |
| 8.46–8.71 | 15.93–16.40 | 30.01–30.89 | 56.52–58.17 |
| 8.71–8.96 | 16.40–16.88 | 30.89–31.79 | 58.17–59.86 |
| 8.96–9.22 | 16.88–17.37 | 31.79–32.72 | 59.86–61.61 |
| 9.22–9.49 | 17.37–17.88 | 32.72–33.67 | 61.61–63.41 |
| 9.49–9.77 | 17.88–18.40 | 33.67–34.65 | 63.41–65.26 |
| 9.77–10.05 | 18.40–18.94 | 34.65–35.67 | 65.26–67.16 |
| 10.05–10.35 | 18.94–19.49 | 35.67–36.71 | 67.16–69.12 |
| 10.35–10.65 | 19.49–20.06 | 36.71–37.78 | 69.12–71.14 |
| 10.65–10.96 | 20.06–20.65 | 37.78–38.88 | 71.14–73.22 |
| 10.96–11.28 | 20.65–21.25 | 38.88–40.02 | 73.22–75.36 |
| 11.28–11.61 | 21.25–21.87 | 40.02–41.18 | 75.36–77.56 |
| 11.61–11.95 | 21.87–22.51 | 41.18–42.39 | 77.56–79.82 |
| 11.95–12.30 | 22.51–23.16 | 42.39–43.62 | 79.82–82.15 |
| 12.30–12.66 | 23.16–23.84 | 43.62–44.90 | 82.15–84.55 |
| 12.66–13.03 | 23.84–24.54 | 44.90–46.21 | 84.55–87.01 |
| 13.03–13.41 | 24.51–25.25 | 46.21–47.56 | 87.01–89.55 |

TABLE-continued

| | | | |
|---|---|---|---|
| 13.41–13.80 | 25.25–25.99 | 47.56–48.94 | 89.55–92.17 |
| 13.80–14.20 | 25.99–26.75 | 48.94–50.37 | 92.17–94.86 |
| Particle diameter ranges | | | |
| (μm) | (μm) | (μm) | |
| 94.86–97.63 | 178.63–183.84 | 336.37–346.19 | |
| 97.63–100.48 | 183.84–189.21 | 346.19–356.29 | |
| 100.48–103.41 | 189.21–194.73 | 356.29–366.69 | |
| 103.41–106.43 | 194.73–200.41 | 366.69–377.40 | |
| 106.43–109.53 | 200.41–206.26 | 377.40–388.41 | |
| 109.53–112.73 | 206.26–212.28 | 388.41–400.00 | |
| 112.73–116.02 | 212.28–218.48 | | |
| 116.02–119.41 | 218.48–224.86 | | |
| 119.41–122.89 | 224.86–231.42 | | |
| 122.89–126.48 | 231.42–238.17 | | |
| 126.48–130.17 | 238.17–245.12 | | |
| 130.17–133.97 | 245.12–252.28 | | |
| 133.97–137.88 | 252.28–259.64 | | |
| 137.88–141.90 | 259.64–267.22 | | |
| 141.90–146.05 | 267.22–275.02 | | |
| 146.05–150.31 | 275.02–283.05 | | |
| 150.31–154.70 | 283.05–291.31 | | |
| 154.70–159.21 | 291.31–299.81 | | |
| 159.21–163.86 | 299.81–308.56 | | |
| 163.86–168.64 | 308.56–317.56 | | |
| 168.64–173.56 | 317.56–326.83 | | |
| 173.56–178.63 | 326.83–336.37 | | |

As a specific measuring method, 10 ml of ion-exchanged water from which impurity solid matter has been removed is put in a container, and as a dispersant a surface-active agent, preferably alkylbenzene sulfonate, is added therein. Thereafter, 0.02 g of a measuring sample is further added therein, followed by uniform dispersion. As a means for the dispersion, an ultrasonic dispersion machine UH-50 (manufactured by SMT Co.) to which a 5 mm diameter titanium alloy chip is attached as a vibrator is used, and dispersion treatment is made for 5 minutes to prepare a dispersion for measurement. Here, the dispersion is appropriately cooled so that its temperature does not exceed 40° C.

The toner shape is measured using the above flow type particle image analyzer. Concentration of the dispersion is again so adjusted that the toner particles are in a concentration of from 3,000 to 10,000 particles/μl at the time of measurement, and 1,000 or more particles are measured. After measurement, the data obtained are used to determine the circle-corresponding diameter and circularity frequency distribution of the toner.

The wax component usable in the present invention may specifically include petroleum waxes such as paraffin wax, microcrystalline wax and petrolatum and derivatives thereof, montan wax and derivatives thereof, hydrocarbon waxes obtained by Fischer-Tropsch synthesis and derivatives thereof, polyolefin waxes typified by polyethylene wax and derivatives thereof, and naturally occurring waxes such as carnauba wax and candelilla wax and derivatives thereof. The derivatives include oxides, block copolymers with vinyl monomers, and graft modified products. The wax component may also include alcohols such as higher aliphatic alcohols, fatty acids such as stearic acid and palmitic acid, acid amides, esters, ketones, hardened caster oil and derivatives thereof, vegetable waxes, and animal waxes. Any of these may be used alone or in combination.

Of these, the use of polyolefin waxes, hydrocarbon waxes obtained by Fischer-Tropsch synthesis, petroleum waxes, higher alcohol waxes or higher ester waxes brings about a much higher effect of improving developing performance and transfer performance. To these wax components, an antioxidant may be added as long as it does not affect the charging performance of toner. Also, any of these wax components may preferably be used in an amount of from 1 to 3 parts by weight based on 100 parts by weight of the binder resin.

The wax component according to the present invention may preferably be, in cross-sectional observation of toner particles through a transmission electron microscope (TEM), dispersed in the binder resin in the form of substantially a spherical and/or spindle-shaped island or islands in such a state that it does not dissolve in the binder resin and vice versa.

In the present invention, the state of dispersion of the wax component as in the above is defined in the following way: Of toner particles having the length of from D4×0.9 to D4×1.1 with respect to the weight-average particle diameter D4 ($\mu$m) which means an average value of weight-based particle size frequency distribution of toner as measured with the flow type particle image analyzer as described previously, twenty (20) planes of cross sections are picked out. Then, the length R of each toner particle cross-sectional plane thus picked up and the length r of the largest among phase-separated structures ascribable to the wax component present in the toner particle cross-sectional plane having the length R are measured to determine the arithmetic mean value of r/R, $(r/R)_{st}$. In an instance where the wax component is dispersed in such a state that the resultant arithmetic mean value of r/R, $(r/R)_{st}$, satisfies $0.05 \leqq (r/R)_{st} \leqq 0.95$, the wax component is defined to be in a state of dispersion in the form of substantially a spherical and/or spindle-shaped island or islands in such a state that the wax component does not dissolve in the binder resin and vice versa.

When the wax component is so dispersed that the arithmetic mean value of r/R, $(r/R)_{st}$, satisfies $0.05 \leqq (r/R)_{st} \leqq 0.95$, the oxycarboxylic acid can be made localized on the toner particle surfaces in a good efficiency, and hence this can contribute to the stabilization of charging performance of toner. Also, since the wax component is encapsulated into toner particles, the toner particle surfaces can be prevented from deteriorating or the image-forming apparatus can be prevented from contamination, and hence the effect of making the oxycarboxylic acid fixed at, and in the vicinity of, toner particle surfaces can be maintained. In addition, an instance where the wax component is dispersed in such a state that the arithmetic mean value of r/R, $(r/R)_{st}$, satisfies $0.25 \leqq (r/R)_{st} \leqq 0.90$ is preferred because good charging performance can be maintained and toner images having a superior dot reproduction can be formed over a long period of time. Also, since the wax component can act in a good efficiency at the time of heat-fixing, good low-temperature fixing performance and anti-offset properties can be attained.

As a method for the cross-sectional observation of toner particles, it is preferable to use the electron dyeing method in which a contrast is formed between materials by making one component thereof have higher electron density than another by the aid of heavy metal, utilizing a difference in the minute structure of crystal phase and amorphous phase between the wax component used and the resin constituting its outer covering. Stated specifically, toner particles are well dispersed in a room-temperature curing epoxy resin, followed by curing in an environment of temperature 40° C. for 2 days, the cured product obtained is electron-dyed with ruthenium tetraoxide ($RuO_4$) and optionally in combination with osmium tetraoxide ($OsO_4$), and thereafter samples are sliced by means of a ultra microtome having a diamond cutter to observe the cross-sectional form of the toner particles using a transmission electron microscope (TEM).

Figure 1B:
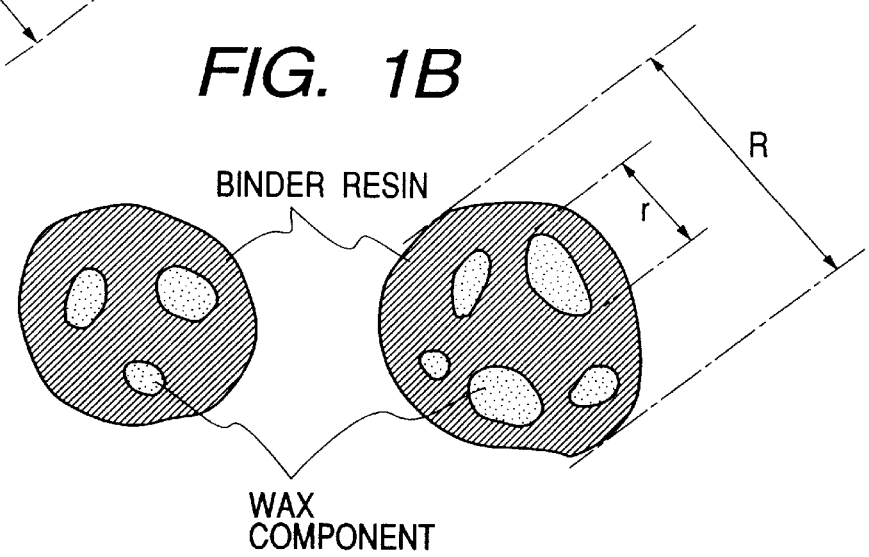

Typical examples of wax cross-sectional planes are shown in FIGS. 1A and 1B. It has been observed that in toner particles obtained in Examples given later the wax component stands encapsulated with the binder resin.

The wax component used in the present invention may preferably be a compound having an endothermic main peak temperature (melting point) in the range of from 30 to 120° C., and more preferably from 40 to 90° C., in the DSC (differential scanning calorimetry) curve measured according to ASTM D3418-82.

When the wax component having thermal properties as described above is used, the resulting toner has a good fixing performance, and besides, the release effect attributable to the wax component is exhibited in a good efficiency, a sufficient fixing region is ensured, and also any bad influence of conventionally known wax components on developing performance, blocking resistance and image-forming apparatus can be eliminated. Especially, since specific surface area of toner particles decreases as the toner particle shape is made spherical, it is very effective to control the thermal properties and state of dispersion of the wax component.

The endothermic main peak temperature (melting point) of the wax component is measured using, e.g., a differential scanning calorimeter DSC-7 (manufactured by Perkin Elmer Co.) The temperature at the detecting portion of the device is corrected on the basis of melting points of indium and zinc, and the calorie is corrected on the basis of heat of fusion of iridium. In the measurement, a measuring sample is put in a pan made of aluminum and an empty pan made of aluminum is set as a control. The endothermic main peak temperature (melting point) is determined from a DSC curve which is obtained when temperature is raised at a rate of temperature rise of 10° C./min in the temperature region of temperatures from 20° C. to 180° C. Here, when the measurement is made on the wax component alone, the temperature is previously raised-and-dropped once under the same conditions as those at the time of measurement, and measurement is started after the pre-history is removed. When the measurement is made on the wax component kept contained in toner particles, the measurement is made without the operation of removing the pre-history.

The wax component used in the present invention may also preferably have a number-average molecular weight (Mn) of from 400 to 3,000, a weight-average molecular weight (Mw) of from 400 to 3,000, and Mw/Mn of not more than 3.0. The use of such a wax is preferred. The use of wax components whose number-average molecular weight is less than 200 and weight-average molecular weight is less than 400 is not preferable because it results in a large proportion for the low-molecular weight component to consequently cause problems on the charging performance of toner and the matching to image-forming apparatus. The use of wax components whose number-average molecular weight is more than 2,000 and weight-average molecular weight is more than 3,000 is also not preferable in view of a lowering of color-mixing performance because it is difficult to make the fixed-image surface appropriately smooth. Also, since granulation and polymerization are carried out in an aqueous dispersion medium when the toner particles are obtained by polymerization, the use of such wax components is not preferable because the wax component may become deposited chiefly during granulation.

In the present invention, the molecular weight distribution of the wax component is measured by GPC (gel permeation chromatography) under conditions shown below.

GPC Measurement Conditions
Apparatus: GPC-150C (Waters Co.)
Columns: GMH-HT 30 cm, combination of two columns (available from Toso Co., Ltd.)
Temperature: 135° C.
Solvent: o-Dichlorobenzene (0.1% ionol-added)
Flow rate: 1.0 ml/min
Sample: 0.4 ml of 0.15% sample is injected.

Molecular weights are measured under conditions shown above. Molecular weight of the sample is calculated using a molecular weight calibration curve prepared from a monodisperse polystyrene reference sample. It is further calculated by converting the value in terms of polyethylene according to a conversion equation derived from the Mark-Houwink viscosity equation.

The binder resin of the toner, used in the present invention may include styrene-acrylate or methacrylate copolymers, polyester resins, epoxy resins, and styrene-butadiene copolymers. In the process where the toner particles are directly produced by polymerization, monomers for forming them are used. Stated specifically, they include styrene monomers such as styrene, o-, m- or p-methylstyrene, and m- or p-ethylstyrene; acrylic or methacrylic acid ester monomers such as methyl acrylate or methacrylate, ethyl acrylate or methacrylate, propyl acrylate or methacrylate, butyl acrylate or methacrylate, octyl acrylate or methacrylate, dodecyl acrylate or methacrylate, stearyl acrylate or methacrylate, behenyl acrylate or methacrylate, 2-ethylhexyl acrylate or methacrylate, dimethylaminoethyl acrylate or methacrylate, and diethylaminoethyl acrylate or methacrylate; and olefin monomers such as butadiene, isoprene, cyclohexene, acrylo- or methacrylonitrile and acrylic acid amide; any of which may preferably be used. Any of these may be used alone, or commonly used in the form of an appropriate mixture of monomers so mixed that the theoretical glass transition temperature (Tg) as described in a publication POLYMER HANDBOOK, 2nd Edition, III pp.139–192 (John Wiley & Sons, Inc.) ranges from 40 to 75° C. If the theoretical glass transition temperature is lower than 40° C., problems may arise in respect of storage stability or running stability of toner. If on the other hand it is higher than 75° C., the fixing point of the toner may become higher.

In the present invention, in order to improve the mechanical strength of toner particles, it is preferable to further use a cross-linking agent when the binder resin is synthesized.

The cross-linking agent used in the toner of the present invention may include, as bifunctional cross-linking agents, divinylbenzene, bis(4-acryloxypolyethoxyphenyl)propane, ethylene glycol diacrylate, 1,3-butylene glycol diacrylate, 1,4-butanediol diacrylate, 1,5-pentanediol diacrylate, 1,6-hexanediol diacrylate, neopentyl glycol diacrylate, diethylene glycol diacrylate, triethylene glycol diacrylate, tetraethylene glycol diacrylate, polyethylene glycol #200 diacrylate, polyethylene glycol #400 diacrylate, polyethylene glycol #600 diacrylate, dipropylene glycol diacrylate, polypropylene glycol diacrylate, polyester type diacrylates (MANDA, trade name; available from Nippon Kayaku Co., Ltd.), and the above diacrylates whose acrylate moiety has been replaced with dimethacrylate.

Polyfunctional cross-linking agents may include pentaerythritol triacrylate, trimethylolethane triacrylate, trimethylolpropane triacrylate, tetramethylolmethane tetraacrylate, oligoester acrylate, and the above compounds whose acrylate moiety has been replaced with methacrylate, and also 2,2-bis(4-methacyloxypolyethoxyphenyl)propane, diallylphthalate, triallylcyanurate, triallylisocyanurate and triallyltrimellitate.

Any of these cross-linking agents may preferably be used in an amount of 0.05 to 10 parts by weight, and more preferably from 0.1 to 5 parts by weight, based on 100 parts by weight of the above monomer.

In the present invention, the binder resin described above may be used in combination with a resin having a polarity (hereinafter "polar resin") such as polyester resin or polycarbonate resin. The addition of a polar resin in the toner makes it easy to control the state where the oxycarboxylic acid is incorporated in the toner, to bring it into the specific state as described above.

For example, when the toner is directly produced by suspension polymerization described later, such a polar resin may be added during polymerization reaction of from a dispersion step to a polymerization step, thus, the formation of toner particles can be so controlled that the polar resin added forms thin layers on the surfaces of toner particles or becomes present in the toner particles with a gradation from their surfaces to cores, in accordance with the balance of polarity shown by a toner-particle-forming polymerizable monomer composition and an aqueous dispersion medium. Therefore, such a polar resin as interacting with the oxycarboxylic acid may be used, whereby the state of the presence of the oxycarboxylic acid in the toner can be made into a desirable form. In particular, the state of the presence of the oxycarboxylic acid can be controlled with ease when a polar resin having an acid value of from 1 to 20 mg KOH/g is used.

The polar resin may preferably be added in an amount of from 1 to 25 parts by weight, and more preferably from 2 to 15 parts by weight, based on 100 parts by weight of the binder resin. Its addition in an amount less than 1 part by weight may make non-uniform the state of the presence of the polar resin in the toner. On the other hand, its use in an amount more than 25 parts by weight may make thick the thin layers of polar resin formed on the toner particle surfaces. Hence, in both instances, it may be difficult to control the state of the presence of the oxycarboxylic acid, so that the polar resin can not sufficiently exhibit its function.

A typical polyester resin used as the polar resin has the composition as described below.

As an alcohol component of the polyester resin, it may include ethylene glycol, propylene glycol, 1,3-butanediol, 1,4-butanediol, 2,3-butanediol, diethylene glycol, triethylene glycol, 1,5-pentanediol, 1,6-hexanediol, neopentyl glycol, 2-ethyl-1,3-hexanediol, hydrogenated bisphenol A, a bisphenol derivative represented by the following Formula (A) and a diol represented by the following Formula (B).

(A)

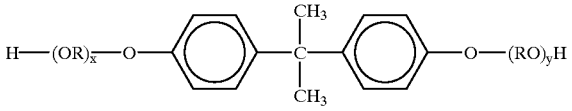

wherein R represents an ethylene group or a propylene group, x and y are each an integer of 1 or more, and an average value of x+y is 2 to 10;

(B)

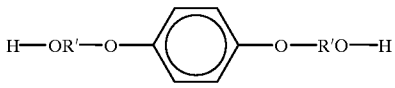

wherein R' represents

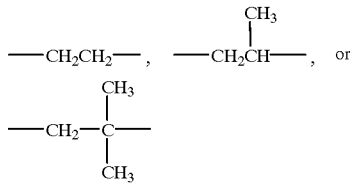

In an instance where a reactive polyester resin or a polycarbonate resin is used as the polar resin, the toner can be improved in charging performance, the image fog and spots around line images can be better prevented, and also high-grade images having superior dot reproducibility can be formed. In addition, it becomes possible to impart an appropriate mechanical strength to the toner particles, so that any influence of toner deterioration ascribable to image-forming apparatus can be confined to the minimum, bringing about improvements in running performance (or durability) against many-sheet printing and in the matching to image-forming apparatus detailed later. Moreover, when the toner particles are treated to be spherical so that the shape distribution of the toner as described previously can be achieved or when the toner is directly produced by suspension polymerization, any influence from toner production steps such as drying can be confined to the minimum. Also, the polar resin may be used in a combination of two or more types, and the chargeability inherent in themselves can be utilized.

The reactive polyester resin used in the present invention includes those obtained by condensation polymerization of a polybasic acid with a polyhydric alcohol; the former including terephthalic acid, isophthalic acid, adipic acid, maleic acid, succinic acid, sebacic acid, thiodiglycolic acid, diglycolic acid, malonic acid, glutaric acid, pimelic acid, suberic acid, azelaic acid, comphoric acid, cyclohexanedicarboxylic acid and trimellitic acid, and the latter including ethylene glycol, diethylene glycol, triethylene glycol, 1,2-propylene glycol, 1,3-propylene glycol, 1,4-butane diol, neopentyl glycol, 1,4-bis(hydroxymethyl)cyclohexane, 1,4-bis(2-hydroxyethyl)benzene, 1,4-cyclohexanedimethanol, polyethylene glycol, polypropylene glycol, bisphenol A, hydrogenated bisphenol, an ethylene oxide addition product of bisphenol A, a propylene oxide addition product of bisphenol A, glycerol, trimethylolpropane and pentaerythritol; and having a reactive group in the backbone chain or side chain of the resulting condensation polymer. The reactive group may include carboxylic acid (or a salt thereof), sulfonic acid (or a salt thereof), ethyleneimino acid, an epoxy group, an isocyanate group, a double bond, an acid anhydride and a halogen atom. This reactive polyester resin may be allowed to react with each other, or react with a polyfunctional cross-linking agent (e.g., polyhydric alcohols and polybasic acids), or the reactive polyester resin may further be allowed to react with a vinyl monomer (e.g., esterification or copolymerization) to obtain THF-insoluble matter. For example, when the toner is obtained by polymerization, an unsaturated polyester resin may be used as the reactive polyester resin, and this may be copolymerized with the vinyl monomer (optionally inclusive of a cross-linking agent such as divinylbenzene). In such a case, the unsaturated polyester resin having a polarity migrates to the vicinity of toner particle surfaces with progress of polymerization to form the thin layers on the toner particle surfaces. Thus, it is possible to obtain a toner having especially superior blocking resistance and anti-offset properties.

As the reactive polyester resin usable in the present invention, any resin may be used as long as it contain the reactive group as described above. However, if it has too low a molecular weight, polyester resin not taking part in cross-linking reaction may consequently be present on the toner particle surfaces to cause a lowering of blocking resistance in some cases. If on the other hand it has too high a molecular weight, the reactive polyester resin may be dissolved in the vinyl monomer with difficulty, making the production of toner difficult. Accordingly, the reactive polyester resin may preferably have a weight-average molecular weight of from about 3,000 to about 100,000 in order to obtain a toner having especially superior performances.

As for the polycarbonate resin, a polycarbonate resin having in its molecular structure a repeating unit represented by the following Formula (I) may preferably be used.

(I)

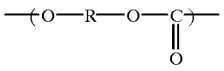

wherein R represents an organic group.

The repeating unit represented by the above Formula (I) may have various structures. All known polycarbonates produced by, e.g., allowing divalent phenols to react with carbonate precursors by a solution process or a melting process. For example, they may include polymers having a repeating unit represented by the following Formula (II)

(II)

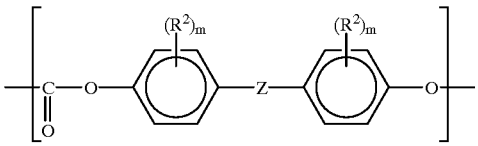

wherein $R^2$ represents a hydrogen atom, an aliphatic hydrocarbon group or an aromatic substituent, m represents an integer of 0 to 4, and when $R^2$ is in plurality, they may be the same or different; and Z represents a linkage represented by a single bond, an aliphatic hydrocarbon group, an aromatic substituent, or —S—, —SO—, —$SO_2$—, —O— or —CO— linkage.

There are no particular limitations on the molecular weight of the polycarbonate resin used in the present invention. The polycarbonate resin may preferably be those having a peak molecular weight within the range of from 1,000 to 500,000, and more preferably from 2,000 to 100,000, as measured by GPC. If the peak molecular weight is lower than 1,000, the resin may adversely affect the charging performance, and if it is higher than 500,000, the resin may have so high a melt viscosity as to cause a problem on fixing performance in some cases. Also, when the polycarbonate resin used in the present invention is produced, an appropriate molecular weight modifier, a branching agent for improving viscoelasticity, a catalyst for accelerating reaction and so forth may be used as occasion arises.

The polar resin as described above is by no means limited to one type of polymer for each entry. For example, two or more types of reactive polyester resins may simultaneously be used, or two or more types of vinyl monomers may be used. Polymers of quite different types also may optionally be added to the binder resin, as exemplified by polymers such as polyester resins having no reactivity, epoxy resins polycarbonate resins, polyolefins, polyvinyl acetate, polyvinyl chloride, polyalkyl vinyl ethers, polyalkyl vinyl ketones, polystyrene, polyacrylate or methacrylate, melamine formaldehyde resin, polyethylene terephthalate, nylons and polyurethanes.

Figure 1C:
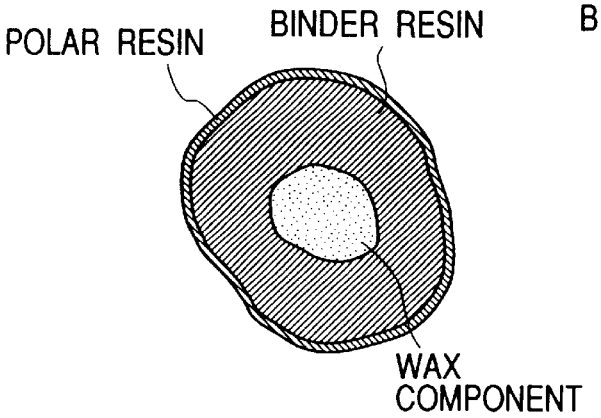
Figure 1D:
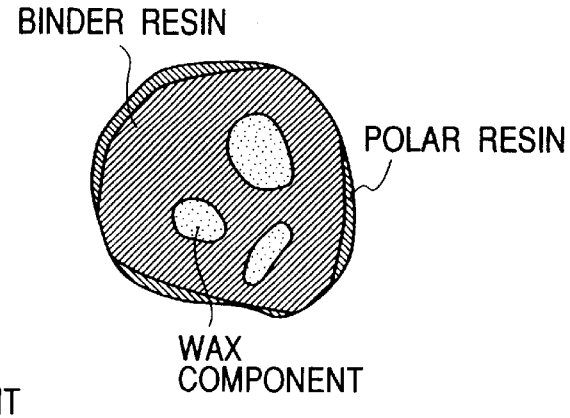

In general, the thin layers formed on the surfaces of toner particles by virtue of the polar resin as described above are distinguishable by a method of electron-dyeing with ruthenium tetraoxide ($RuO_4$) and/or osmium tetraoxide ($OSO_4$) in the observation of cross-sectional planes of toner particles that is made using a transmission electron microscope (TEM) as described previously. Here, there can be observed such a state that the binder resin and wax component are present in the direction inward from the thin layers formed on the surfaces of toner particles and the wax component is dispersed in the binder resin in the form of substantially a spherical and/or spindle-shaped island or islands. Typical examples are shown in FIGS. 1C and 1D. In addition, the state where as shown in FIG. 1C the thin layer substantially uniformly covers the surface of a toner particle is defined to be a continuous layer, and the state where as shown in FIG. 1D the thin layer partly covers the surface of a toner particle is defined to be a discontinuous layer.

The colorant used in the present invention may include yellow colorants, magenta colorants and cyan colorants shown below. Carbon black, magnetic materials, and colorants toned into black by the use of yellow, magenta and cyan colorants shown below may be used as black colorants.

The carbon black used in the present invention may preferably have a primary particle diameter of from 25 to 80 nm.

With regard to particle diameter of the carbon black, if it is smaller than 25 nm, primary particles are too fine to attain sufficient dispersion and are difficult to handle well. If it is larger than 80 nm, even in a well dispersed state, it tends to cause problems such that only images with a low density may be obtained or the toner is consumed in a large quantity, because of an insufficient coloring power as a toner.

With regard to particle diameter, the carbon black may more preferably have a primary particle diameter of from 35 to 70 nm. This enables the charge polarity and charge quantity of transfer residual toner to be more surely and uniformly controlled by a charging member, and is more advantageous in view of the stability of a charge quantity of toner and the coloring power of toner.

The particle diameter of the carbon black present in the toner of the present invention can be measured by taking a photograph of its perticle enlarged with a transmission electron microscope.

The carbon black used in the present invention may preferably have a DBP oil absorption of from 40 to 150 ml/100 g.

Carbon black with short structure, having a DBP oil absorption smaller than 40 ml/100 g, tends to make the charge quantity of toner too low. Carbon black having a DBP oil absorption larger than 150 ml/100 g is hard to finely disperse, because of its tough long structure.

The DBP oil absorption is measured according to ASTM D2414-79.

As yellow colorants usable in the present invention, compounds typified by condensation azo compounds, isoindolinone compounds, anthraquinone compounds, azo metal complexes, methine compounds and allylamide compounds are used. Stated specifically, e.g., C.I. Pigment Yellow 12, 13, 14, 15, 16, 17, 62, 74, 83, 93, 94, 95, 97, 109, 110, 111, 120, 127, 128, 129, 147, 168, 174, 176, 180, 181 and 191 are preferably used.

Magenta colorants usable in the present invention may include condensation azo compounds, diketopyropyyrole compounds, anthraquinone compounds, quinacridone compounds, basic dye lake compounds, naphthol compounds, benzimidazolone compounds, thioindigo compounds and perylene compounds. Stated specifically, there are C.I. Pigment Red 2, 3, 5, 6, 7, 23, 48:2, 48:3, 48:4, 57:1, 81:1, 144, 146, 166, 169, 177, 184, 185, 202, 206, 220, 221 and 254, which are particularly preferred used.

Cyan colorants usable in the present invention may include copper phthalocyanine compounds and derivatives thereof, anthraquinone compounds and basic dye lake compounds. Stated specifically, C.I. Pigment Blue 1, 2, 7, 15:1, 15:2, 15:3, 15:4, 60, 62 and 66 are particularly preferred.

These colorants may be used alone, in the form of a mixture, or in the state of a solid solution. In the case when a magnetic material is used as the colorant, the colorant to be incorporated in the toner may preferably be added in an amount of from 40 to 50 parts by weight based on 100 parts by weight of the binder resin. In the case when other colorant is used, it may preferably be added in an amount of from 5 to 20 parts by weight based on 100 parts by weight of the binder resin.

The toner of the present invention may also be incorporated with a magnetic material so that it can be used as a magnetic toner. In this case, the magnetic material may also serve as the colorant. The magnetic material usable in the present invention may include iron oxides such as magnetite, hematite and ferrite; metals such as iron, cobalt and nickel, or alloys of any of these metals with a metal such as aluminum, cobalt, copper, lead, magnesium, tin, zinc, antimony, beryllium, bismuth, cadmium, calcium, manganese, selenium, titanium, tungsten or vanadium, and mixtures of any of these.

As these magnetic materials used in the present invention, surface-modified magnetic material may also preferably be used. Especially when the toner particles are produced by polymerization, it is particularly preferable to use materials having been subjected to hydrophobic treatment with a surface modifier having no polymerization inhibitory action. Such a surface modifier may include, e.g., silane coupling agents and titanium coupling agents.

As these magnetic materials, those having an average particle diameter of 1 $\mu$m or smaller, and preferably from 0.1 to 1 $\mu$m, may also preferably be used. As the magnetic material, it is preferable to use those having a coercive force (Hc) of from 1.59 to 23.9 kA/m (20 to 300 oersted), a saturation magnetization ($\sigma s$) of from 50 to 200 $Am^2/kg$ (emu/g) and a residual magnetization ($\sigma r$) of from 2 to 20 $Am^2/kg$ (emu/g), as magnetic characteristics under application of 796 kA/m (10 kilo-oersted).

In the present invention, any known charge control agent may be used in combination with the oxycarboxylic acid described previously. In particular, a charge control agent which have a high charging speed and also can maintain a constant charge quantity stably is preferred. In the case when the toner particles are directly produced by polymerization, it is preferable to use charge control agents having no polymerization inhibitory action and free of any solubilizate into the aqueous dispersion medium. As specific compound, they may include, as negative charge control agents, metal compounds of aromatic carboxylic acids such as salicylic acid, naphthoic acid and dicarboxylic acid, polymer type compounds having sulfonic acid or carboxylic acid in the side chain, boron compounds, urea compounds, silicon compounds, and carixarene. As positive charge control agents, they may include quaternary ammonium salts, polymer type compounds having such a quaternary ammonium salt in the side chain, guanidine compounds, and imidazole compounds.

In the present invention, however, the addition of the charge control agent is not essential. In the case when two-component development is employed, the triboelectric charging with a carrier may be utilized. Also in the case when non-magnetic one-component blade-coating development is employed, the triboelectric charging with a blade member or a sleeve member may positively be utilized. Accordingly, the charge control agent is not necessarily required to be contained in the toner particles.

Adding an inorganic fine powder to the toner of the present invention is an embodiment preferable for the improvement in developing performance, transfer performance, charging stability, fluidity and running performance. As the inorganic fine powder, any known powder may be used, but may preferably be selected from fine powders of silica, alumina, titania or double oxides thereof. In particular, silica is more preferred. Such silica includes dry-process silica or fumed silica produced by vapor phase oxidation of silicon halides or alkoxides and wet-process silica produced from alkoxides or water glass, either of which may be used. The dry-process silica is preferred, as having less silanol groups at the surface and inside and leaving no production residues such as $Na_2O$ and $SO_3^{2-}$. In the dry-process silica, it is also possible to use, in its production step, other metal halide such as aluminum chloride or titanium chloride together with the silicon halide to obtain a composite fine powder of silica with other metal oxide. The fine silica powder includes these, too.

The inorganic fine powder used in the present invention may preferably have a specific surface area of 30 $m^2/g$ or above, and more preferably in the range of from 50 to 400 $m^2/g$, as measured by nitrogen gas adsorption according to the BET method. Such an inorganic fine powder can produce good results, and may be used in an amount of from 0.3 to 8 parts by weight, and preferably rom 0.5 to 5 parts by weight, based on 100 parts by weight of toner particles.

Where the inorganic fine powder whose BET specific surface area has been controlled as described above coexists with the oxycarboxylic acid present at, and in the vicinity, of toner particle surfaces, the adsorption of moisture to toner particles can be controlled to bring about a greater effect on the control of the quantity of triboelectricity or charging rate. Also, since an appropriate fluidity is imparted to the toner, the toner can be improved synergistically in uniform-charging performance, so that the above good effect can be maintained even when printing on many sheets is successively repeated.

If the inorganic fine powder has a specific surface area below 30 $m^2/g$, it is difficult to impart an appropriate fluidity to the toner. If it has a specific surface area above 400 $m^2/g$, the inorganic fine powder becomes buried in the toner particle surfaces at the time of continuous printing to lower the fluidity of toner in some cases.

To measure the specific surface area, nitrogen gas is adsorbed on sample surfaces using a specific surface area measuring device AUTOSOBE 1 (trade name; manufactured by Yuasa Ionics Co.), and the specific surface area is calculated by the BET multiple-point method.

If the inorganic fine powder is added in an amount less than 0.3 part by weight based on 100 parts by weight of toner particles, its addition can not be effective. If on the other hand it is in an amount more than 5 parts by weight, not only problems may occur on the charging performance and fixing performance of the toner, but also any inorganic fine powder having become liberated may make the matching to image-forming apparatus greatly poor.

If necessary, for the purposes of imparting hydrophobicity and controlling chargeability, the inorganic fine powder used in the present invention may preferably be treated with a treating agent such as silicone varnish, modified silicone varnish of various types, silicone oil, modified silicone oil of various types, a silane coupling agent, a silane coupling agent having a functional group, or other organosilicon compound or organotitanium compound, or in combination with various treating agents.

In order to maintain a high charge quantity and achieve a low consumption and a high transfer efficiency, the inorganic fine powder may further preferably be treated with silicone oil.

In the toner of the present invention, other additives may also be used in a small quantity as long as they substantially do not adversely affect the toner, which may include lubricant powders as exemplified by Teflon powder, stearic acid zinc powder and polyvinylidene fluoride powder; abrasives as exemplified by cerium oxide powder, silicon carbide powder and strontium titanate powder; fluidity-providing agents or anti-caking agents as exemplified by titanium oxide powder and aluminum oxide powder; conductivity-providing agents as exemplified by carbon black powder, zinc oxide powder and tin oxide powder; and developability improvers as exemplified by reverse-polarity organic particles and inorganic particles.

The toner of the present invention may be used as a one-component developer as it is, or may be used in combination with a carrier so as to be used as a two-component developer.

When used as the two-component developer, for example, a magnetic carrier blended with the toner may be constituted in the state of ferrite containing an element selected from iron, copper, zinc, nickel, cobalt, manganese and chromium alone or in plurality. The magnetic carrier may have spherical, flat or amorphous shape, any of which may be used. A magnetic carrier whose particle surface microstructure (e.g., surface unevenness) has appropriately been controlled may also be used. Resin-coated carriers surface-coated with a resin and magnetic-powder disperse type resin carriers may also preferably be used. The carrier used may have an average particle diameter of from 10 to 100 $\mu$m, and more preferably from 20 to 50 $\mu$m. Also, when such a carrier and the toner are blended to prepare the two-component developer, the toner in the developer may preferably be in a concentration of from about 2 to 15% by weight.

{Toner Production Process}

As methods for producing the toner of the present invention, any known methods may be used, such as a pulverization method in which the binder resin, the colorant, the wax component and so forth are melt-kneaded by means of a pressure kneader, thereafter the kneaded product is cooled and then pulverized to have the desired toner particle diameter, and the pulverized product is further brought to classification to adjust its particle size distribution to produce a toner; the method as disclosed in Japanese Patent Publication 36-10231, and Japanese Patent Applications Laid-open No. 59-53856 and No. 59-61842, in which toner is directly produced by suspension polymerization; the method as disclosed in Japanese Patent Publication 56-13945, in which a melt-kneaded product is atomized in the air by means of a disk or a multiple fluid nozzle to obtain spherical toner particles; and an emulsion polymerization method as typified by soap-free polymerization. The toner in which a state of the incorporated oxycarboxylic acid has been specified, may preferably be produced by suspension polymerization while controlling pH in the aqueous dispersion medium at the time of the reaction to polymerize polymerizable vinyl monomer.

The oxycarboxylic acid incorporated in the toner of the present invention has so many hydrophilic functional groups that, when particles formed by the granulation of a polymerizable monomer composition are polymerized in an aqueous dispersion medium to form toner particles, it tends to dissolve out in the aqueous dispersion medium. When the oxycarboxylic acid is dissolved, the resulting toner particles are not sufficiently improved in charge quantity and charging rate. Also, the oxycarboxylic acid having dissolved out assumes behavior like a surface-active agent to make it very difficult for the toner particles to retain their shape in the step of polymerization, so that the toner can not be controlled to have the desired particle size distribution and particle shape. Especially when the oxycarboxylic acid dissolves out in a large quantity, particles having a finer particle diameter than the toner particles may secondarily be formed to bring about a difficulty in the matching to image-forming apparatus.

As a measure against such a problem, the present inventors have discovered that the polymerization conversion of polymerizable vinyl monomers and the pH of aqueous dispersion medium may be controlled whereby the oxycarboxylic acid can be prevented from dissolving out and the oxycarboxylic acid can be made fixed at, and in the vicinity of, toner particle surfaces in a good state. Thus, they have accomplished a first toner production process of the present invention.

Stated in detail, when the reaction is carried out to polymerize the polymerizable monomer composition in the course of from the granulation step to the polymerization step, in a first reaction step taken to enhance the polymerization conversion of polymerizable monomers to 10% or higher, the pH of the aqueous dispersion medium is kept at 4.5 to 8.5, preferably 4.5 to 7.0, and particularly preferably 4.5 to 6.0, whereby the oxycarboxylic acid is prevented from dissolving out in the aqueous dispersion medium and the oxycarboxylic acid is encapsulated in toner particles. Then, pH of the aqueous medium is re-adjusted to 9 to 13 after the first reaction step, and a second reaction step is taken to further enhance the polymerization conversion, whereby the oxycarboxylic acid encapsulated in toner particles can be drawn out to the vicinity of the surfaces of toner particles capable of participating in triboelectric charging and simultaneously the oxycarboxylic acid present at the surfaces can partly be dissolved and removed in an alkaline atmosphere.

Thus, the oxycarboxylic acid can be made fixed at, and in the vicinity of, toner particle surfaces in a good state, so that the resulting toner can have a very good charging performance. Also, the particle size distribution and shape distribution of the toner particles can be controlled as desired, without causing any secondary formation of the particles with fine particle diameter. Hence, the charging performance can be improved synergistically and also the matching to image-forming apparatus can be made very well. Especially when the pH of the aqueous medium in the first reaction step is kept at 4.5 to 6.0, the oxycarboxylic acid can be encapsulated in a much better condition, hence the effect on the improvement as stated above can be made much better.

In the present invention, the "polymerization conversion" of polymerizable monomers is found according to the following equation by determining a total weight (W2) of unreacted polymerizable monomers on the basis of a total weight (W1) of polymerizable monomers used in the polymerizable monomer composition.

$$\text{Polymerization conversion } (\%)=\{(\mathbf{W1}-\mathbf{W2})/\mathbf{W1}\}\times 100$$

The weight of unreacted polymerizable monomers can be determined by adding, immediately after sampling from a reaction vessel, a polymerization terminator or cold methanol to the collected sample to terminate the polymerization reaction, and by using a known method such as (i) a method making use of thermogravimetry (TG) which makes measurement as weight loss at the time of heating by means of a thermobalance or (ii) a method making use of gas chromatography (GC). In particular, the method making use of GC is an especially effective method.

In the present invention, at the time of switching the first reaction step to the second reaction step, the polymerization conversion and the pH of the aqueous dispersion medium are so adjusted that the weight A (mg) of oxycarboxylic acid extracted with methanol from 1 g of the toner and the weight B (mg) of oxycarboxylic acid extracted with 0.1 mol/liter of an aqueous sodium hydroxide solution from 1 g of the toner satisfies the relationship of:

$$1.05 \leqq A/B \leqq 3.00,$$

and $$0.10 \leqq B \leqq 3.50.$$

If the first reaction step is finished in such a state that the polymerization conversion is low or if the polymerization is made to proceed at a little higher pH, the oxycarboxylic acid is encapsulated in a poor condition, and hence the oxycarboxylic-acid weight B at the toner particle surfaces becomes small in quantity. In the first reaction step, oxycarboxylic-acid weight B at the toner particle surfaces can be controlled within the stated range by enhancing the polymerization conversion of polymerizable vinyl monomer to 10% or higher while keeping the pH at 4.5 to 8.5. However, if the pH of the aqueous dispersion medium is higher than 8.5, not only the oxycarboxylic-acid weight B is hard to control, but also particles having a finer particle diameter than the toner particles may be secondarily formed. If on the other hand the pH of the aqueous dispersion medium is set lower than 4.5, the reaction vessel, its pipings and so forth may greatly corrode or usable dispersants must be restricted, thus such a pH is not preferable.

Meanwhile, the present inventors have discovered that, when the toner particles are produced by polymerizing a polymerizable vinyl monomer in an aqueous dispersion medium, the pH of the aqueous dispersion medium may be controlled in the step of distillation whereby the oxycarboxylic acid contained in the polymerizable vinyl monomer can be incorporated inside toner particles (the vicinity of surfaces) and at toner particle surfaces and hence a toner not causative of any lowering of the quantity of triboelectricity and charging rate and moreover having a good matching to image-forming apparatus can be produced in a good efficiency. Thus, they have accomplished a second toner production process of the present invention.

Stated in detail, the reaction to polymerize the polymerizable monomer composition in the course of from the granulation step to the polymerization step is carried out while keeping the pH of the aqueous dispersion medium at 4.5 to 8.5 (preferably at pH of 4.5 to 7.0, and particularly preferably 4.5 to 6.0), thereafter the pH of the aqueous dispersion medium is re-adjusted to 9 to 13, and then the distillation step is carried out at a temperature not lower than the glass transition temperature of the binder resin of the toner. By this process too, the oxycarboxylic acid can be made fixed at, and in the vicinity of, toner particle surfaces in a good state, so that a toner having good performances can be produced. In addition, in the step of distillation a water-soluble polymerization initiator may be added in the aqueous dispersion medium, whereby unreacted polymerizable monomers can be removed in a much better efficiency. Namely, in the step of distillation, the oxycarboxylic acid is made fixed in toner particles in a good state and at the same time the unreacted polymerizable vinyl monomer can be removed, hence the toner can efficiently be produced.

In the present invention, the glass transition temperature (Tg) of the resin in the toner is determined as the theoretical glass transition temperature as described previously, after the monomer composition constituting the binder resin is quantitatively and qualitatively analyzed according to a prescribed method. Besides this, it may also be measured with a differential scanning calorimeter (DSC). Stated specifically, it may be measured under the following conditions and may be determined by a middle-point method, where an endothermic peak ascribable to the glass transition of the binder resin is selected from the resultant DSC curve at its part corresponding to "Temperature rise II" as shown below, and the temperature at the point where a straight line lying at an equal distance in the ordinate direction from an extended straight line of base lines on the low-temperature side and high-temperature side of the endothermic peak intersects the endothermic peak is regarded as the glass transition temperature.

DSC Measurement Conditions

Apparatus:

DSC-7 (manufactured by Perking Elmer Corporation)

Sample:

Toner precisely weighed in an amount of 5 to 20 mg (preferably 10 mg) is put in a sample pan made of aluminum. As a control sample, an empty sample pan made of aluminum is used.

Measurement temperature range: 30° C. to 200° C.

Temperature rise pattern:

Temperature rise I (30° C.→200° C.; rate of temperature rise: 10° C./min)

Temperature drop I (200° C.→30° C.; rate of temperature drop: 10° C./min)

Temperature rise II (30° C.→200° C.; rate of temperature rise: 10° C./min)

The first and second toner production processes of the present invention not only can obtain toner particles having the desired particle size distribution and shape distribution, without causing any secondary formation of particles with fine particle diameter, but also can be effective for the cleanability of any contaminants adhering to inner walls and stirring blades of reaction vessel after the production of polymerization particles. Thus, the processes can contribute to the productivity of toners. The reason therefor is not necessarily clear, and it is presumed that the effect like a surface-active agent that is attributable to the oxycarboxylic acid present at the toner particle surfaces might have brought about less contamination on the inner walls and stirring blades of reaction vessel.

In the toner of the present invention, the polymerizable vinyl monomer remaining in the toner may preferably be 200 ppm or less, and more preferably 100 ppm or less. Controlling the polymerizable vinyl monomer remaining in the toner so as to be 200 ppm or less enables more improvement in the charging performance of toner and the matching to image-forming apparatus. If the polymerizable vinyl monomer in the toner is in a residue more than 200 ppm, the effect of the addition of the oxycarboxylic acid may be barely exhibited.

In the present invention, as methods for determining the monomer remaining in the toner, known methods may be used, e.g., (i) a method making use of thermogravimetry (TG) which makes measurement as weight loss at the time of heating by means of a thermobalance and (ii) a method making use of gas chromatography (GC). In particular, the method making use of GC is an especially effective method.

An example of the instance where the polymerizable vinyl monomer in the toner is determined by GC is shown below.

GC Measurement Conditions

Apparatus:

GC-14A (manufactured by Shimadzu Corporation)

Column:

Fused silica capillary column (manufactured by J & W Scientific Co; size: 30 m×0.249 mm; liquid phase: DBWAX; layer thickness: 0.25 μm)

Sample:

Using 2.55 mg of DMF as an internal reference, a solvent containing the internal reference is prepared by adding 100 ml of acetone. Next, 400 mg of toner is made into a 10 ml solution using the solvent. After treatment with an ultrasonic shaker for 30 minutes, the solution is left for 1 hour. Next, the solution is filtered with a 0.5 μm filter. The sample is injected in an amount of 4 μl.

| | |
|---|---|
| Carrier gas: | $N_2$ gas |
| Oven temperature: | 70° C. → 220° C. (temperature rise at a rate of 5° C./min after standing by at 70° C. for 2 minutes) |
| Injection temperature: | 200° C. |
| Detection temperature: | 200° C. |
| Preparation of calibration curve: | A reference sample prepared by adding a target polymerizable vinyl monomer to the same DMF-acetone solution as the sample solution is similarly measured by gas chromatography to determine the value of weight ratio/area ratio of the polymerizable vinyl monomer and the internal reference DMF. |

In the toner production process of the present invention, any known inorganic or organic dispersant may be used as a dispersant used when the aqueous dispersion medium is prepared. Stated specifically, inorganic dispersants may include, e.g., tricalcium phosphate, magnesium phosphate, aluminum phosphate, zinc phosphate, magnesium carbonate, calcium carbonate, calcium hydroxide, magnesium hydroxide, aluminum hydroxide, calcium metasilicate, calcium sulfate, barium sulfate, bentonite, silica and alumina. Organic compounds may include, e.g., polyvinyl alcohol, gelatin, methyl cellulose, methyl hydroxypropyl cellulose, ethyl cellulose, carboxymethyl cellulose sodium salt, and starch.

Commercially available nonionic, anionic or cationic surface active agents may also be used. For example, the following may be used: sodium dodecylsulfate, sodium tetradecylsulfate, sodium pentadecylsulfate, sodium octylsulfate, sodium oleate, sodium laurate, potassium stearate and calcium oleate.

In the toner production process of the present invention, a slightly water-soluble dispersant of an inorganic type is preferred, and besides, a slightly water-soluble inorganic dispersant which is soluble in acid may preferably be used. In the present invention, when the aqueous dispersion medium is prepared using the slightly water-soluble inorganic dispersant, such a dispersant may preferably be used in a proportion of from 0.2 to 2.0 parts by weight based on 100 parts by weight of the polymerizable vinyl monomer. Also, in the present invention, the aqueous dispersion medium may preferably be prepared by using water in an amount of from 300 to 3,000 parts by weight based on 100 parts by weight of the polymerizable monomer composition.

In the present invention, when the aqueous dispersion medium in which the slightly water-soluble inorganic dispersant as described above has been dispersed is prepared, a commercially available dispersant may be used as it is. In order to obtain dispersant particles having fine and uniform particle size, such a slightly water-soluble inorganic dispersant may be prepared in a liquid medium such as water under high-speed stirring. For example, when tricalcium phosphate is used as the dispersant, an aqueous sodium phosphate solution and an aqueous calcium chloride solution may be mixed to form fine particles of tricalcium phosphate, thus a preferable dispersant can be obtained.

The toner production process of the present invention, constituted as described above, can readily provide a toner which has been made to restrain a decrease in the quantity of triboelectricity in an environment of high humidity and the lowering of a triboelectric charging rate in a low humidity environment, which have conventionally occurred in toners containing charge control agents, and also to restrain the toner-carrying member and so forth from being contaminated.

The polymerizable monomer composition used in the toner production process of the present invention will be described below. The polymerizable monomer composition is prepared by dissolving or dispersing, and mixing at least the polymerizable vinyl monomer, the colorant, the wax component and the oxycarboxylic acid, and in addition thereto the charge control agent and further optionally various additives.

The polymerizable vinyl monomer used here is used as a mixture of the polymerizable monomers listed previously, which are appropriately so mixed so as to show the theoretical glass transition temperature (Tg) of from 40 to 75° C. In particular, too high Tg is not preferable because, when color toners for forming full-color images are produced, individual color toners may have a low color mixing performance at the time of fixing, resulting in a poor color reproducibility and also resulting in a low transparency of OHP images.

The polymerization initiator used in the toner production process of the present invention may specifically include azo or diazo type polymerization initiators such as 2,2'-azobis-(2,4-dimethylvaleronitrile), 2,2'-azobisisobutyronitrile), 1,1'-azobis-(cyclohexane-1-carbonitrile), 2,2'-azobis-4-methoxy-2,4-dimethylvaleronitrile and azobisisobutyronitrile; and peroxide type polymerization initiators such as benzoyl peroxide, methyl ethyl ketone peroxide, diisopropylperoxy carbonate, cumene hydroperoxide, 2,4-dichlorobenzoyl peroxide and lauroyl peroxide. The polymerization initiator may usually be used in an amount of from 5 to 20 parts by weight based on 100 parts by weight of the polymerizable vinyl monomer, which varies depending on the intended degree of polymerization. The polymerization initiators may a little differ in types depending on the methods for polymerization, and may be used alone or in the form of a mixture, referring to its 10-hour half-life period temperature.

In order to control the degree of polymerization, any known cross-linking agent, chain transfer agent and polymerization inhibitor may further be added to the polymerizable monomer composition. These additives may previously be added in the polymerizable monomer composition or may appropriately be added in the course of polymerization reaction as occasion arises.

{Image-forming Method}

The image-forming method of the present invention has at least a charging step, an exposure step, a developing step and a transfer step, and makes use of the toner described above, having a superior matching to image-forming apparatus.

The charging step will be described first.

As charging methods, known corona charging called corotron or scororotron may be used. Besides, a method making use of pin electrodes may be used. Contact charging may also be used which is a method of charging the photosensitive member surface by bringing a charging member into contact with it. In particular, the contact charging method is a preferred method because it requires no high voltage and may cause less ozone.

In the present invention, the toner of the present invention can especially be effective when the contact means is the contact charging method, where the charging means is brought into contact with the photosensitive member surface. That is, compared with non-contact corona discharge where the charging means is in non-contact with the photosensitive member surface, the contact charging method tends to cause the deterioration of the photosensitive member surface, hence the transfer performance of toner tends to lower during running, causing faulty cleaning due to an increase in transfer residual toner. Since, however, the toner according to the present invention has a high transfer performance, the faulty cleaning is kept from occurring during running.

As process conditions preferable when a charging roller is used as the contact charging member, the charging roller may preferably be set at a contact pressure of from 4.9 to 490 N/m (5 to 500 g/cm), and more preferably from 9.8 to 392 N/m (10 to 400 g/cm), and also a DC voltage may preferably be applied in order to make the polarity of the transfer residual toner the same polarity as the photosensitive member so that the transfer residual toner can be easily collected at the time of development. When a voltage produced by superimposing an AC voltage on the DC voltage is used, it is preferable to superimpose on the DC voltage an AC voltage having a peak-to-peak voltage of less than 2×Vth (V) [Vth: discharge starting voltage (V) in the application of DC voltage].

As other contact charging means, there is a method making use of a charging blade or a conductive brush.

As the contact charging member, in the case of the roller or the blade, a metal such as iron, copper or stainless steel, a carbon-dispersed resin, or a metal powder or metal oxide powder-dispersed resin may be used as its conductive substrate. In the case of the blade, it may have the shape of a rod or a plate. An elastic roller constituted of a conductive substrate, and an elastic layer, a conductive layer and a resistance layer provided thereon may be used.

To form the elastic layer, preferred is the use of rubbers such as chloroprene rubber, isoprene rubber, EPDM rubber, polyurethane rubber, epoxy rubber and butyl rubber, or a spongy any of these rubbers; thermoplastic elastomers such as a styrene-butadiene thermoplastic elastomer, a polyurethane thermoplastic elastomer, a polyester thermoplastic elastomer and an ethylene-vinyl acetate thermoplastic elastomer.

As the conductive layer, those having a volume resistivity of $10^7$ Ω·cm or below, and preferably $10^6$ Ω·cm or below, may preferably be used. For example, a metal-deposited film, a conductive particle-dispersed resin or a conductive resin may be used. As specific examples, it may include deposited films aluminum, indium, nickel, copper and iron; as examples of the conductive-particle-dispersed resin, those prepared by dispersing conductive particles such as carbon, aluminum, nickel or titanium oxide particles in a resin such as urethane, polyester, a vinyl acetate-vinyl chloride copolymer or polymethyl methacrylate. As the conductive resin, it may include quaternary ammonium salt-containing polymethyl methacrylate, polyvinyl aniline, polyvinyl pyrrole, polydiacetylene and polyethyleneimine.

The resistance layer is a layer having a volume resistivity of $10^6$ to $10^{12}$ Ω·cm. For example, a semiconductive resin or a conductive-particle-dispersed insulating resin may be used. As the semiconductive resin, preferred is the use of ethyl cellulose, nitro cellulose, methoxymethylated nylon, ethoxymethylated nylon, copolymer nylon, polyvinyl pyrrolidone and casein. As examples of the conductive-particle-dispersed insulating resin, named are resins prepared by dispersing conductive particles such as carbon, aluminum, indium oxide or titanium oxide particles in a small quantity in an insulating resin such as urethane, polyester, a vinyl acetate-vinyl chloride copolymer or polymethyl methacrylate.

The brush serving as the contact charging member may be comprised of a fiber commonly used and a conductive material dispersed therein for the purpose of resistance control. As the fiber, commonly known fibers may be used, including, e.g., nylon, acrylic, rayon, polycarbonate or polyester. As the conductive material, commonly known conductive materials may be used, including, e.g., metals such as copper, nickel, iron, aluminum, gold and silver; metal oxides such as iron oxide, zinc oxide, tin oxide, antimony oxide and titanium oxide; and conductive powders such as carbon black. These conductive powders may optionally previously be subjected to surface treatment for the purpose of imparting hydrophobicity or controlling resistance. When used, these conductive powders are selected taking account of dispersibility in fibers and productivity. As to the shape, the brush may have a fiber thickness of from 1 to 20 deniers (a fiber diameter of from about 10 to 500 μm), a fiber length of from 1 to 15 mm and a brush density of from 10,000 to 300,000 threads per square inch ($1.5\times10^7$ to $4.5\times10^8$ threads per square meter). Such a brush may preferably be used.

As development systems used in the image-forming method of the present invention, usable are (i) a two-component contact development system in which a developing sleeve internally having a magnet is used as a developer carrying member for holding thereon a two-component type developer having a toner and a carrier, the two-component type developer is carried on the surface of this developing sleeve, and a magnetic brush formed by this two-component type developer is brought into contact with the surface of a photosensitive member serving as an image-bearing member to make development, (ii) a one-component contact development system in which a toner which is a one-component type developer is coated on the surface of a toner-carrying member to form a toner layer and this toner layer is brought into contact with the surface of the photosensitive member serving as an image-bearing member, and (iii) a one-component non-contact development system in which a toner layer carried on a toner-carrying member and the photosensitive member are set in non-contact to make development.

In the one-component contact development system, the toner may be magnetic or non-magnetic, and it is important that the toner layer and the photosensitive member surface come into contact with each other. The toner-carrying member may preferably substantially come into contact with the photosensitive member surface, and this means that the toner-carrying member comes into contact with the photosensitive member when the toner layer is removed from the toner-carrying member. Here, an electric field may be formed through the toner across the photosensitive member and an elastic roller serving as the toner-carrying member, facing the photosensitive member surface. This enables formation of images kept from the edge effect. Hence, the elastic layer formed out of elastic rubber on the surface of a low-resistance core material of the elastic roller may be resistance-controlled in a medium-resistance region so as to keep the electric field while preventing its conduction with the photosensitive member surface, or a thin-layer insulating layer may be provided on the surface of a low-resistance conductive roller. The system may also be so constituted that a conductive roller is coated with an insulating substance on its surface side facing the photosensitive member surface or provided with a conductive layer on the inner side of an insulating sleeve not facing the photosensitive member. It may also be so constituted that a rigid roller is used as the toner-carrying member and a flexible member such as a belt is used as the photosensitive member.

When the one-component contact development system is used, the surface of a developing roller serving as the toner-carrying member for carrying the toner thereon and the surface of the photosensitive member may be rotated in the opposite direction, or may be rotated in the same direction. When these are rotated in the same direction, the developing roller may preferably be rotated in a peripheral speed of more than 100% with respect to the peripheral speed of the photosensitive member. If it is not more than 100%, a problem may be left on image quality, e.g., a poor line sharpness. With an increase in the peripheral speed ratio, the quantity of the toner fed to the developing zone increases, and the toner is more frequently attached to, and detached from, the latent image, where it is repeated that the toner is scraped off at the unnecessary part and imparted to the necessary part, so that an image faithful to the electrostatic latent image can be formed. Stated specifically, the movement speed of the toner-carrying member surface may preferably be a speed 1.05 time to 3.0 times the movement speed of the photosensitive member surface.

In the present invention, the image-forming method may have a cleaning step for removing the transfer residual toner not transferred in the transfer step and remaining on the surface of the photosensitive member. As this cleaning step, a "cleaning-before-development system" may be used in which a cleaning member is brought into contact with the image-bearing member surface after the transfer step and before the developing step to perform cleaning.

In this cleaning-before-development system, a cleaning zone may be provided which comprises a cleaning member coming into contact with the image-bearing member surface between the transfer zone and the charging zone and also serving to remove the transfer residual toner present on the surface of the image-bearing member. This is preferable because the transfer residual toner can be made to less affect the charging member.

In the present invention, as the cleaning member used in the cleaning-before-development system, a blade, a roller, a fur brush or a magnetic brush may be used. Any of these cleaning members may be used in combination.

The present inventors have discovered that any lowering of cleaning performance caused by excessive charging of the transfer residual toner can be prevented by the use of the toner in which the oxycarboxylic acid is included in a specific state, because the charge quantity of the developing toner on the photosensitive member can properly be controlled.

More specifically, once the transfer residual toner is charged in excess, the transfer residual toner may adhere to the photosensitive member in so high a force that the cleaning performance tends to lower. Especially when the toner particles have a shape close to spheres as in the case of the toner produced by polymerization such as suspension polymerization, the scrapability in the cleaning step tends to lower and the toner tends to slip through the cleaning member, bringing about a disadvantage for the cleaning. Also, the excessive charging of the transfer residual toner causes a great lowering of cleaning performance.

The charge of the transfer residual toner may change greatly also in accordance with transfer bias conditions and transfer medium resistance. As the transfer bias, a voltage having a polarity reverse to the charge polarity of the toner is commonly applied. In the case when the development is regular development (the toner charge polarity is opposite to the photosensitive member charge polarity) and when the transfer medium has a high resistance, such as cardboards and OHP films, toner particles having a high charge go forward to the cleaning step while being kept at that charge polarity, without being transferred because of their strong adhesion to the photosensitive member, and hence the photosensitive member tends not to be completely cleaned.

Accordingly, as the toner it is preferred that the charge of the toner having participated in development on the photosensitive member is kept controlled in an appropriate quantity so that any toner charged excessively may not participate in development on the photosensitive member. In order to make the toner charged excessively not participate in development on the photosensitive member, it is necessary to control the charging to the toner or the charging performance of the toner, whereas insufficient charging of the toner tends to cause difficulties such as toner scatter and a lowering of the transfer performance of the toner.

In the toner according to the present invention, an appropriate charge quantity can be imparted to the toner and the charging rate of the toner is brought into a good state, so that the transfer residual toner is prevented from being excessively charged and the cleaning performance in the cleaning step is improved. The toner is also improved in developing performance.

Meanwhile, in the present invention, an image-forming method employing a "cleaning-at-development system" is also one of preferred embodiments, in which the cleaning step for removing the transfer residual toner not transferred in the transfer step and remaining on the surface of the photosensitive member is carried out simultaneously with the developing step.

In the case when the development is reversal development (the toner charge polarity is the same polarity as the photosensitive member charge polarity) and when the transfer medium is one which readily transmits an electric field, such as thin paper, toner particles strongly charged in a reverse polarity are formed by transfer bias, and the toner particles strongly charged in a reverse polarity also have a strong adhesion to the photosensitive member, and hence the photosensitive member tends not to be completely cleaned.

To solve this problem, in the present invention, the toner having the oxycarboxylic acid included therein in a specific state is used, thus it has become possible to restrain any excessively reverse-charged toner particles from being formed. Also, the use of the toner having the oxycarboxylic acid included therein in a specific state according to the present invention facilitates the control of the toner charge quantity by transfer bias.

The reason therefor is not necessarily clear, but it is presumed according to the findings by the present inventors that the oxycarboxylic acid used in the present invention prevents the charge-up phenomenon, in which the toner becomes excessively charged in a high quantity, and also makes it hard for toner particles to hold any excessive reverse charge even when an electric field reverse to the charge polarity of the toner is applied in the transfer step, and in addition thereto the specific state of the oxycarboxylic acid incorporated in the toner makes triboelectricity uniform.

The principle of the cleaning-at-development system is to control the charge polarity and charge quantity of the toner on the photosensitive member in the respective steps in electrophotography and to employ a reversal development system.

It will be described by giving an example. When a negatively chargeable photosensitive member and a negatively chargeable toner are used, an image rendered visible is transferred to a transfer medium in the transfer step by means of a transfer member having a positive polarity, where the charge polarity of the transfer residual toner varies from positive to negative depending on the relation between types of transfer medium (difference in thickness, resistance and dielectric constant) and the area of images. However, by the charging member having a negative polarity when charging the negatively chargeable photosensitive member, the charge polarity can be uniformly adjusted to the negative side even if the polarity of the transfer residual toner is shifted to the positive side in the transfer step together with that of the photosensitive member surface. Hence, when the reversal development is employed as the developing system, the transfer residual toner, which stands negatively charged, remains at the light-area potential portions to be developed, even though toner particles uniformly charged to negative polarity at the time of development are present on the photosensitive member surface. At the dark-area potential portions not to be developed, the toner is attracted toward the toner-carrying member in relation to the development electric field and hence does not remain thereon.

However, in an attempt to form images at a higher process speed by the use of the cleaning-at-development system, it is difficult to charge the photosensitive member surface by means of the charging member and also to uniformly adjust the charge polarity of the transfer residual toner, in correlation with a decrease in charging time per unit area of the photosensitive member. Hence, when the reversal development is used as a development system, the transfer residual toner present on the toner's dark-area potential portions not to be developed can be attracted to and collected on the toner-carrying member with difficulty by the aid of the development electric field. Moreover, even if it has been collected on the toner-carrying member by mechanical force such as rubbing, the transfer residual toner, unless its charge is not uniformly adjusted, may adversely affect the charging performance of the toner present on the toner-carrying member, causing a lowering of developing performance.

The image-forming method employing the cleaning-at-development system is established by controlling in the charging step the charge polarity of the transfer residual toner simultaneously with the charging of the photosensitive member. However, in the case when the image-forming method employing the cleaning-at-development system is used in the formation of images at such a higher process speed, the charge polarity of the transfer residual toner can be controlled with difficulty, tending to cause faulty collection at development. In addition, since the development itself is performed at a higher seed, there is such a problem that the charge of the transfer residual toner collected at the developing step may more greatly affect the developing performance to cause a lowering of developing performance.

In addition, in the case when the image-forming method employing the cleaning-at-development system is used in the formation of images at a high process speed, faulty charging tends to occur because of contamination of the charging member.

Studies made by the present inventors have revealed that, in the image-forming method employing the cleaning-at-development system, when images are formed at such a high process speed as 120 mm/sec or above, or further 150 mm/sec or above, as the process speed of a developing roller, the charge polarity must be controlled more quickly in order to collect the transfer residual toner at the time of development, and, in order to keep developing performance, the charge polarity of the transfer residual toner must be controlled more surely and uniformly when passing through the charging member.

Accordingly, the present inventors made extensive studies on various toners to have discovered that, in the image-forming method employing the cleaning-at-development system, the charge control performance of the toner at the time it passes through the charging member is closely related to running performance and image quality characteristics, and have discovered that the charge control performance of the toner at the time it passes through the charging member can be improved especially by the oxycarboxylic acid present included in the specific state.

The photosensitive member usable in the present invention will be described below.

As the photosensitive member according to the present invention, a releasability may preferably be imparted to the photosensitive member surface, and the photosensitive member surface may preferably have a contact angle to water of 85 degrees or more. It may more preferably have a contact angle to water of 90 degrees or more.

The fact that the photosensitive member surface has a large contact angle shows that the photosensitive member surface has a high releasability, which is effective for enabling the transfer residual toner to be lessened very much, so that the load in the cleaning step can greatly be decreased and the faulty cleaning can more surely be prevented from occurring.

Moreover, since the photosensitive member surface has a high releasability, the transfer residual toner can be lessened very much and at the same time transfer residual toner can be collected in an improved efficiency in the cleaning step to prevent positive ghost images.

As means for imparting releasability to the photosensitive member surface, a means is available in which a surface layer constituted chiefly of a high-molecular weight resin is provided on the photosensitive member surface and;

(1) a material with a low surface energy is used as the resin constituting the surface layer;

(2) an additive capable of imparting water repellency or lipophilicity is added to the surface layer; or (3) a material having a high releasability is dispersed in the surface layer in a powdery form.

As an example of (1), a means is available in which a fluorine-containing group or a silicone-containing group is introduced into the resin structure. In the case of (2), a surface active agent or the like may be used as the additive. The material used in (3) may include a compound containing fluorine atoms, i.e., polytetrafluoroethylene, polyvinylidene fluoride and carbon fluoride.

Employment of such means can make the surface of the photosensitive member have a contact angle to water of 85 degrees or more. If the photosensitive member surface has a contact angle less than 85 degrees, the toner and the toner-carrying member tend to deteriorate as a result of running.

In particular, polytetrafluoroethylene is preferred. In the present invention, the means (3) is preferred, in which a powder with releasability such as a fluorine-containing resin is dispersed in the outermost surface layer.

In order to incorporate such powder into the surface portion, a layer comprising a binder resin with the powder dispersed therein may be provided on the outermost surface of the photosensitive member. Alternatively, in the case of an organic photosensitive member originally mainly comprised of a resin, the powder may merely be dispersed in the outermost layer without anew providing the surface layer.

The powder may preferably be added to the surface layer in an amount of from 1 to 60% by weight, and more preferably from 2 to 50% by weight, based on the total weight of the surface layer. Its addition in an amount less than 1% by weight can not well lessen the transfer residual toner, can not make the transfer residual toner removable in a sufficient cleaning efficiency, and can be less effective for preventing ghost. Its addition in an amount more than 60% by weight is not preferable since the film strength may lower or the amount of light incident on the photosensitive member may greatly decrease. As to particle diameter, the powder may have a particle diameter of 1 $\mu$m or smaller, and preferably 0.5 $\mu$m or smaller, in view of image quality. If it has a particle diameter larger than 1 $\mu$m, line images may have a poor sharpness because of scattering of incident light.

The present invention is also effectively applied especially to image-forming apparatus having a small-diameter drum type photosensitive member having a diameter of 50 mm or smaller. This is because the small-diameter photosensitive member has a large curvature with respect to a like linear pressure and the pressure tends to concentrate at the contact portion of the contact member. The like phenomenon is considered to be seen also in beltlike photosensitive members. The present invention is effective also for image-forming apparatus making use of a belt photosensitive member which forms a curvature radius of 25 mm or smaller at the contact portion.

A transfer process that is applicable to the image-forming method of the present invention will specifically be described below.

In the transfer step, a contact transfer system may preferably be used in which toner images are electrostatically transferred to a transfer medium while bringing a transfer means into contact with the photosensitive member surface, interposing the transfer medium between them. The transfer means may preferably be brought into contact with the photosensitive member surface at a linear pressure of 2.9 N/m (3 g/cm) or higher, and more preferably from 9.8 to 490 N/m (10 to 500 g/cm). If the linear pressure as contact pressure is lower than 2.9 N/m (3 g/cm), transport aberration of transfer mediums and faulty transfer tend to occur undesirably. Too high contact pressure may cause deterioration of the photosensitive member surface or adhesion of the toner, consequently causing melt-adhesion of the toner to the photosensitive member surface.

As the transfer means used in the contact transfer step, an assembly having a transfer roller or a transfer belt may be used. The transfer roller may be comprised of at least a mandrel and a conductive elastic layer provided on the mandrel. The conductive elastic layer may be an elastic material with a volume resistivity of about $10^6$ to $10^{10}$ Ω·cm, such as urethane resin and EPDM with a conductive material such as carbon dispersed therein.

The present invention is especially effectively used in an image-forming apparatus comprising a photosensitive member whose surface layer is formed of an organic compound. That is, when the organic compound forms the surface layer of the photosensitive member, the binder resin contained in the toner particles more tends to adhere to the surface layer than other cases where an inorganic material is used, bringing about a technical problem such that the transfer performance tends to more lower. Thus, the effect produced by the high transfer performance attributable to the toner used in the present invention can be more remarkable.

The image-forming method of the present invention will be described with reference to the accompanying drawings.

Figure 8:
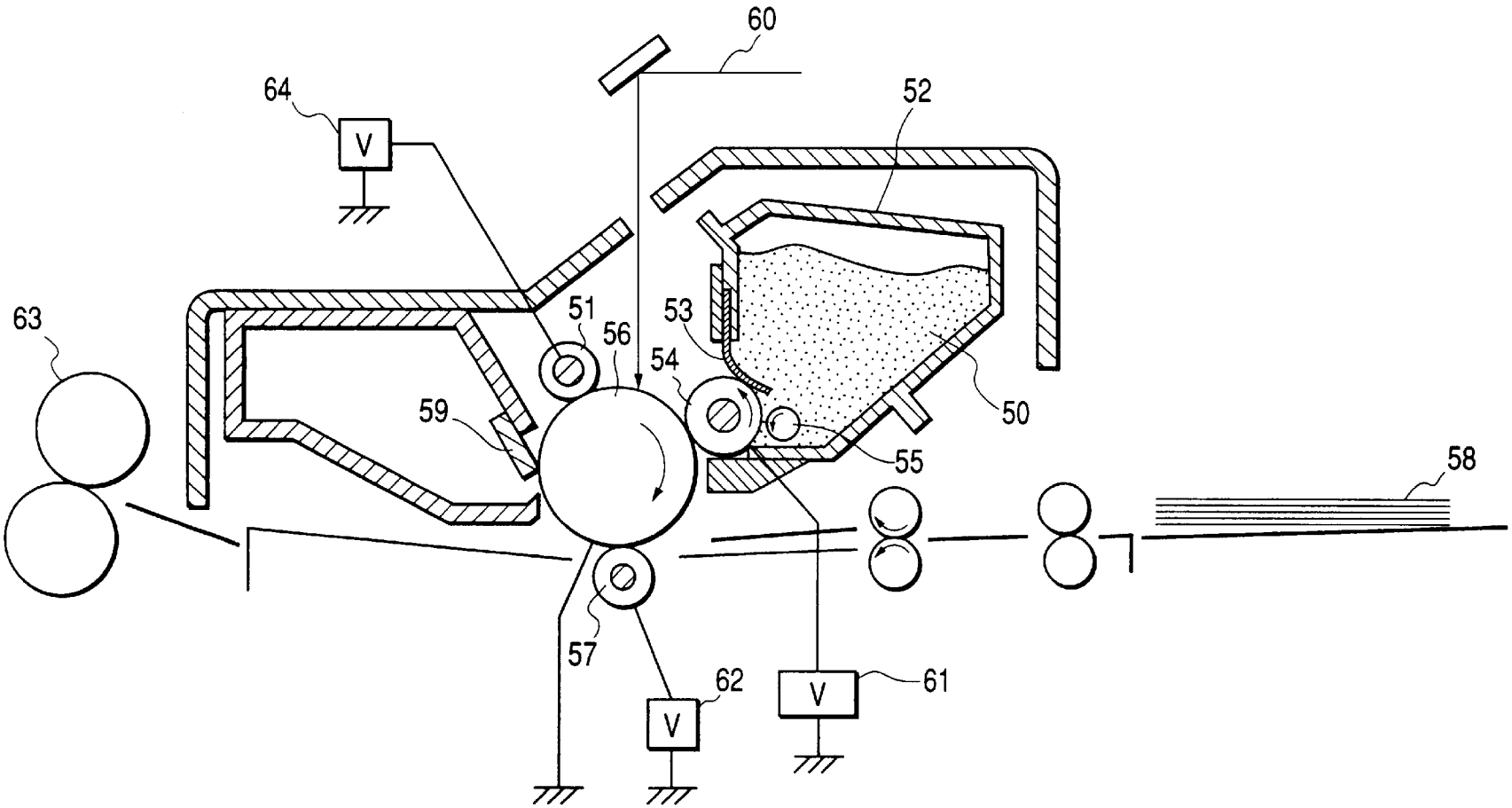
FIG. 8 is a diagrammatic illustration of an image-forming method employing a contact one-component developing assembly, used as an example of the image-forming method of the present invention.

FIG. 8 diagrammatically illustrates, as an example of the image-forming method of the present invention, an image-forming apparatus having a process cartridge. It employs the cleaning-before-development system.

A photosensitive member 56 is electrostatically charged by means of a charging roller 51 serving as the contact charging means, to which a bias is kept applied through a bias applying means 64, and image areas are exposed to laser light 60 to form an electrostatic latent image. A toner 50 held in a developing assembly 52 is applied on a toner-carrying member 54 by means of a toner coating roller 55 and a coating blade 53, and the electrostatic latent image formed on the photosensitive member 56 is developed by reversal development bringing a toner layer formed on the toner-carrying member 54 into contact with the surface of the photosensitive member 56 to form a toner image on the photosensitive member 56. To the toner-carrying member 54, at least a DC bias is applied through a bias applying means 61. The toner image on the photosensitive member 56 is transferred onto a transfer medium 58 transported to the transfer zone, by means of a transfer means transfer roller 57 to which a bias is applied through a bias applying means 62. The toner image transferred onto the transfer medium is fixed through a heat-and-pressure fixing means 63 having a heating roller and a pressure roller.

The image-forming apparatus has a blade-like cleaning member 59 provided in contact with the surface of the photosensitive member 56 between the transfer zone shared by a transfer roller 57 and the charging zone shared by a charging roller 51. The transfer residual toner remaining on the photosensitive member 56 after the step of transfer is scraped off by the cleaning member 59 and collected by a cleaner. The photosensitive member 56 from the surface of which the transfer residual toner has been removed is again electrostatically charged by the charging roller 51 and is, after charged, exposed to laser light 60, so that an electrostatic latent image is formed. The electrostatic latent image on the photosensitive member 56 is developed by the toner carried on the developer carrying member 54. A toner image formed on the photosensitive member 56 after the developing step is transferred by means of the transfer roller 57 onto a recording medium 58 transported to the transfer zone. After the transfer step, the photosensitive member 56 is cleaned by the cleaning member 59 to remove the transfer residual toner, and thereafter again electrostatically charged by means of the charging roller 51. A similar process is repeatedly carried out thereafter.

Figure 9:
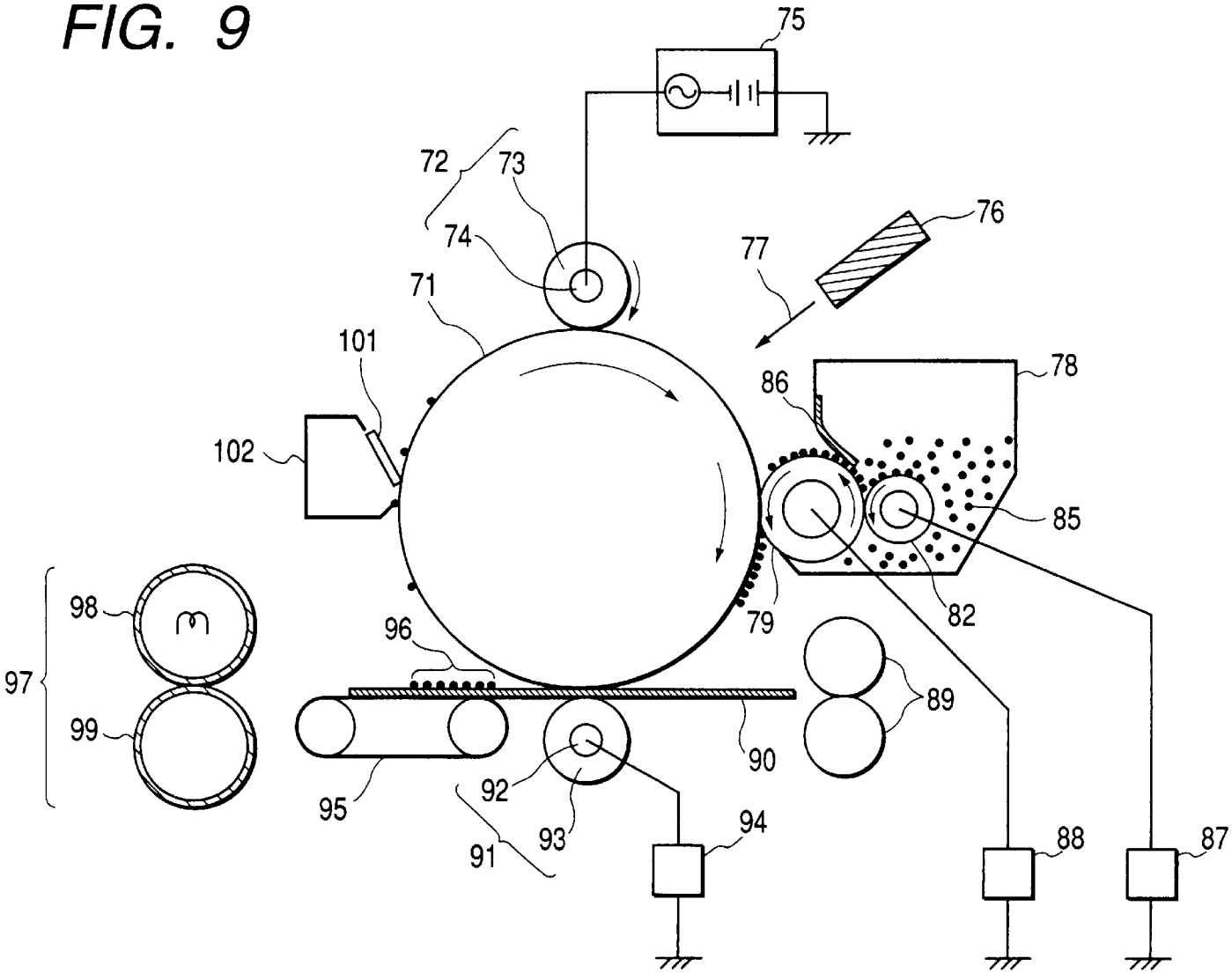
FIG. 9 is a diagrammatic illustration of an image-forming method employing a contact one-component developing assembly, used as another example of the image-forming method of the present invention.

FIG. 9 illustrates another example of the image-forming apparatus, in which the toner can be fed to a developing sleeve serving as the toner-carrying member and in addition thereto the toner having participated in development can smoothly be stripped off the developing sleeve.

In FIG. 9, reference numeral 71 denotes a photosensitive drum, around which a contact charging means primary charging roller 72, a developing means developing assembly 78, a contact transfer means transfer charging roller 91 and a resistor roller 89 are provided. Then, the photosensitive drum 71 is electrostatically charged to, e.g., −700 V by means of the primary charging roller 72. Voltage applied by a bias applying means 75 is DC voltage which is, e.g., −1,350 V. Then, the photosensitive drum 71 is exposed to laser light 7 emitted from a laser light generator 76 to form a digital electrostatic latent image. The electrostatic latent image on the the photosensitive drum 71 is developed by a non-magnetic one-component developer (toner) 85 held by the developing assembly 78, and is transferred onto a transfer medium recording medium 90 by means of the transfer roller 91 to which a bias voltage is kept applied through a bias applying means 94 brought into contact with the photosensitive drum 71 via the recording medium 90. The recording medium 90 holding thereon a toner image 96 is transported on a transfer belt 95 to a heat-and-pressure fixing assembly 97 having a heat roller 98 and a pressure roller 99, and the toner image is fixed to the recording medium 90. Reference numeral 102 denotes a cleaner having a cleaning member 101. The transfer residual toner remaining on the photosensitive drum after the transfer step is scraped off by the cleaning member 101 and collected by the cleaner 102.

The charging roller 72 is basically constituted of a mandrel 74 at the center and a conductive elastic layer 73 that forms its periphery.

The transfer roller 91 is basically constituted of a mandrel 92 at the center and a conductive elastic layer 93 that forms its periphery.

Figure 12:
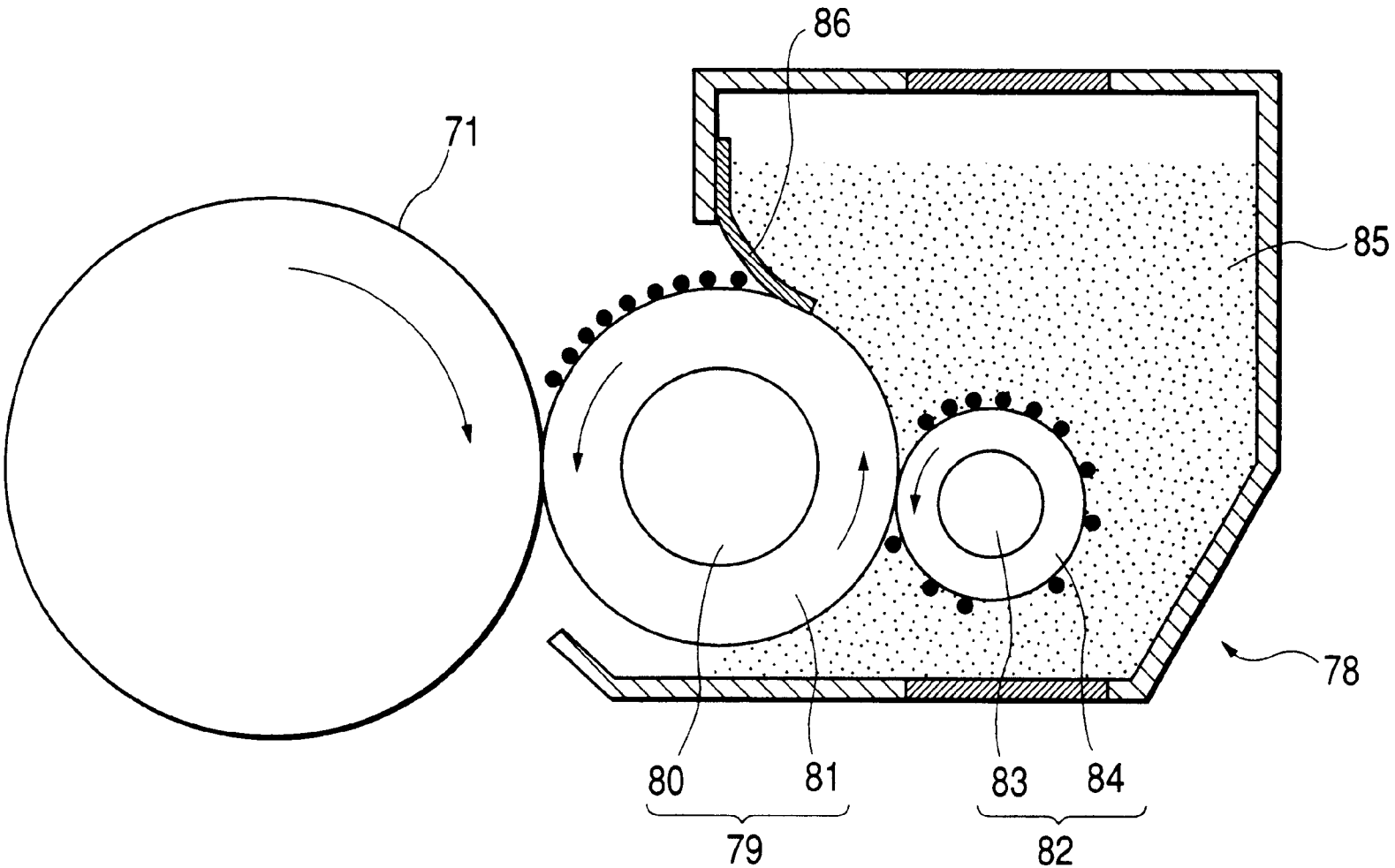
FIG. 12 is an enlarged view of a developing assembly of the image-forming apparatus shown in FIGS. 9 and 11.

The developing assembly 78 is, as shown in FIG. 12, provided with a developing sleeve serving as the toner-carrying member, which comprises an elastic roller 79 having a mandrel 80 to which a bias voltage is applied through a bias applying means 88 and an elastic layer 81. Inside the developing assembly 78, a toner coating roller 82 is provided which has a mandrel 83 to which a bias voltage is applied through a bias applying means 87 and an elastic layer 84. As a member for regulating the quantity of the toner transported while being attracted onto the developing sleeve 79, a toner regulating blade 86 is provided so that the quantity (or layer thickness) of the toner transported to the developing zone can be controlled in accordance with a pressure at which the toner regulating blade 86 is brought into touch with the developing sleeve 79. In the developing zone, a DC development bias is applied at least to the developing sleeve 79, and the toner layer on the developing sleeve comes into contact with the photosensitive drum 71 surface and is moved onto the photosensitive drum 71 in accordance with the electrostatic latent image to form a toner image thereon.

When the photosensitive drum 71 has a light-area potential of from 0 to 250 V and a dark-area potential of from 300 to 1,000 V, a feed bias voltage applied from the bias applying means 87 may preferably be from 100 to 900 V and a development bias voltage applied from the bias applying means 88 may preferably be from 100 to 900 V.

The feed bias voltage applied from the bias applying means 87 may also preferably be higher by 10 to 400 V as an absolute value, than the development bias voltage applied from the bias applying means 88. This is preferable because the feeding of the non-magnetic toner 85 to the developing sleeve 79 and the stripping of the non-magnetic toner from the developing sleeve 79 can be made smooth.

In view of the feeding and stripping of the non-magnetic toner, it is preferable for the toner coating roller 82 to be rotated in the same direction as the rotational direction of the developing sleeve 79 so that their both surfaces move in the counter direction each other as shown by arrows in FIG. 12.

In the image-forming apparatus shown in FIGS. 8 or 9, employed is an image-forming method of a type in which the toner image formed on the image-bearing member is directly transferred to a recording medium without use of any intermediate transfer member.

An image-forming method in which the toner image formed on the image-bearing member is primarily transferred to an intermediate transfer member and the toner image transferred onto the intermediate transfer member is secondarily transferred to the recording medium, will be described below with reference to an image-forming apparatus shown in FIG. 13.

Figure 13:
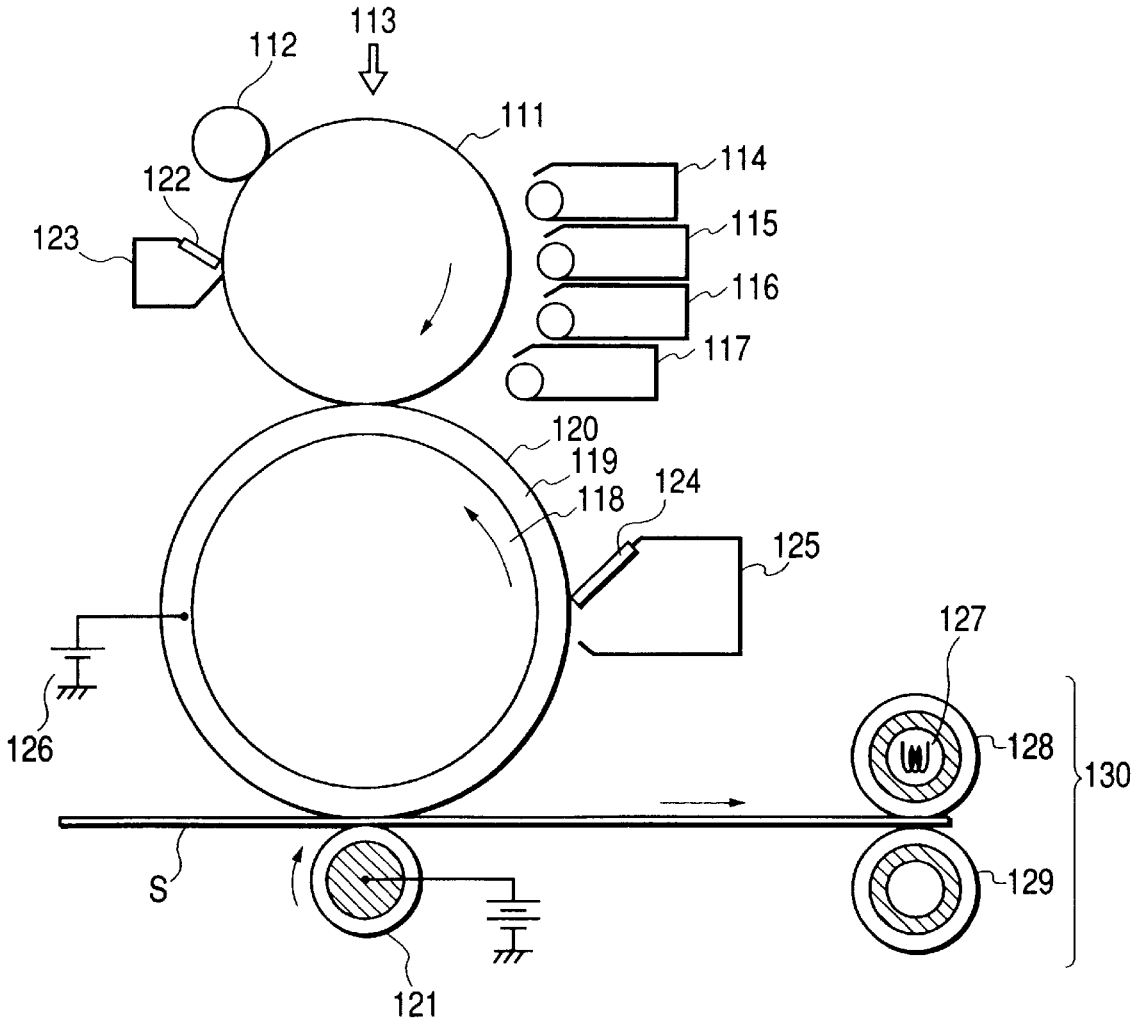
FIG. 13 is a diagrammatic illustration of an image-forming apparatus making use of an intermediate transfer member.

As shown in FIG. 13, by means of a charging roller 112 rotatable in contact with a photosensitive drum 111 serving as the image-bearing member, the photosensitive drum 111 is made to have a surface potential thereon, and an electrostatic latent image is formed by an exposure means 113. The electrostatic latent image is developed by means of developing assemblies 114, 115, 116 and 117 by the use of four color toners, magenta, cyan, yellow and black toners, to form a full-color toner image. At the time of development, any one of the developing assemblies 114, 115, 116 and 117 is moved and the toner-carrying member of the developing assembly is brought into proximity to or contact with the surface of the photosensitive drum 111 to carry out development. After the development, the developing assembly is moved back to the original position, so that the toner-carrying member comes apart from the surface of the photosensitive drum 111. This operation is repeated for each developing assembly, four times in total. The toner image is transferred color by color onto the intermediate transfer member 118, and this is repeated a plurality of times, so that a multiple toner image is formed.

A drum-like member is used as the intermediate transfer member 118, which may be provided with a holding member stretched over its periphery or may be comprised of a substrate and provided thereon an elastic layer (e.g., nitrile butadiene rubber) in which a conductivity-providing material as exemplified by carbon black, zinc oxide, tin oxide, silicon oxide or titanium oxide has been well dispersed. A belt-like intermediate transfer member may also be used.

The intermediate transfer member 118 may preferably be a drum-like member whose elastic layer 120 formed on a support member 119 has a hardness of from 10 to 50 degrees (JIS K-6301), or, in the case of the transfer belt, be constituted of a support member having an elastic layer with that hardness at the part where the toner image is transferred to the transfer medium (recording medium).

The toner image is transferred from the photosensitive drum 111 to the intermediate transfer member 118 by transfer electric currents produced by applying a bias voltage from a power source 126 to a mandrel 119 serving as the support member of the intermediate transfer member 118. Corona discharging or roller charging from the back of the holding member or belt may also be utilized.

The multiple toner image on the intermediate transfer member 118 is one time transferred on the recording medium S by a transfer means 121. As the transfer means, a corona charging assembly or a contact electrostatic transfer means making use of a transfer roller or a transfer belt may be used.

The recording medium S having the multiple toner image is passed through a contact nip formed between a fixing roller 128 and a pressure roller 129 of a heat-fixing assembly 130, so that the toner image is fixed to the recording medium S. The heat-fixing assembly 130 has the fixing roller 128 as a fixing member having a heating element 127 in its inside, and the pressure roller 129 comes into pressure contact with the fixing roller 128.

In FIG. 13, reference numeral 123 denotes a cleaner (a first cleaning means) having a cleaning member 122 for removing the toner remaining on the surface of the photosensitive drum 111 after the primary transfer. The cleaning member 122 is in contact with the surface of the photosensitive drum 111. Reference numeral 125 denotes a cleaner (a second cleaning means) having a cleaning member 124 for removing the toner remaining on the surface of the intermediate transfer member after the secondary transfer.

Figure 10:
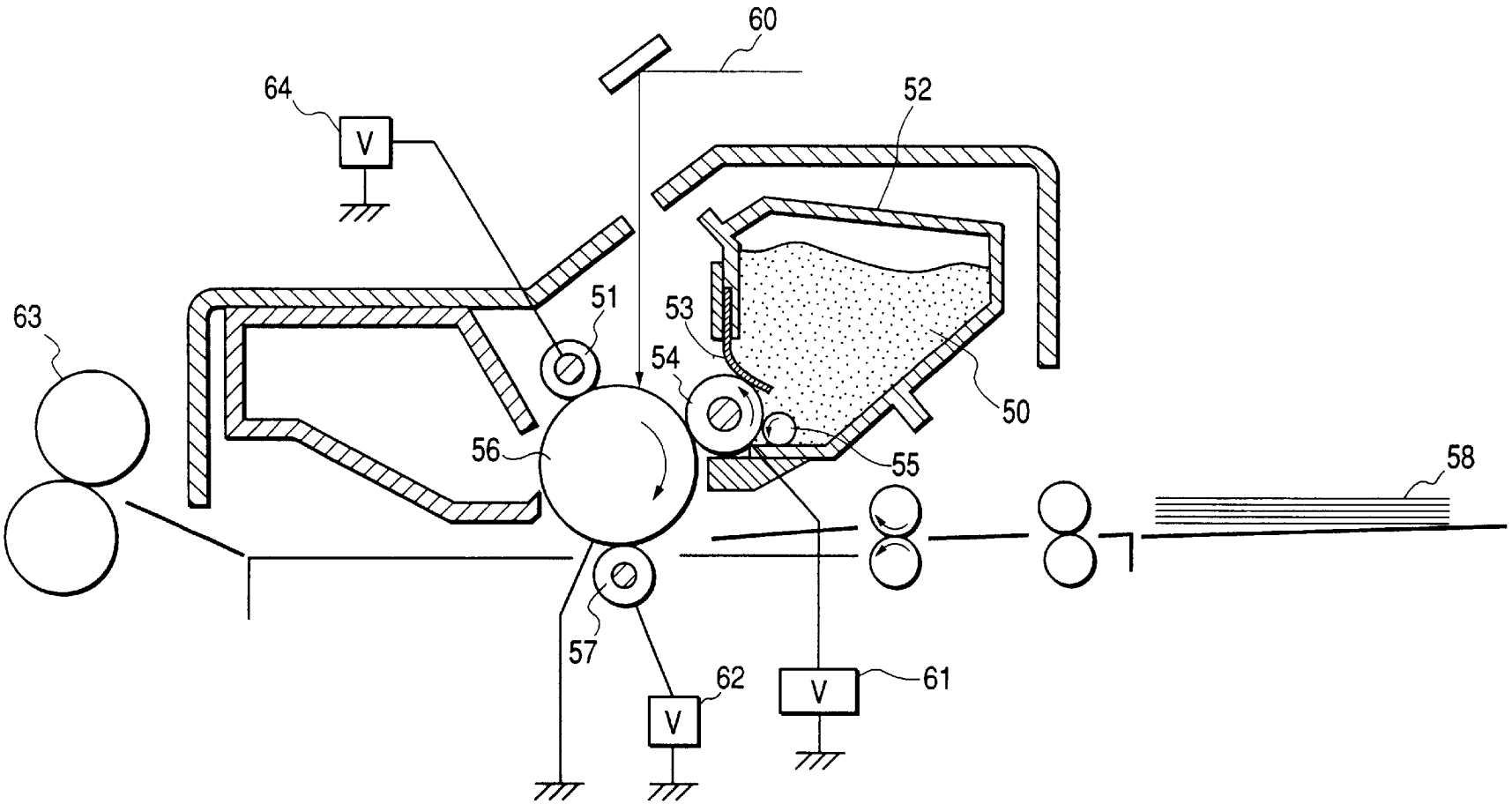
FIG. 10 is a diagrammatic illustration of an image-forming method employing a contact one-component developing assembly and also employing a cleaning-at-development system, used as a still another example of the image-forming method of the present invention.

Meanwhile, FIG. 10 diagrammatically illustrates, as an example for carrying out the image-forming method of the present invention, an image-forming apparatus having a process cartridge from which a cleaning unit having a cleaning member such as a cleaning blade has been removed. What is shown in FIG. 10 is the same as what is shown in FIG. 8 except that the cleaning blade 59 in FIG. 8 is not provided.

In the reverse development, as developing conditions preferable for carrying out the cleaning-at-development, the dark-area potential (Vd) and light-area potential (Vl) on the surface of the photosensitive member and the DC bias (Vdc) applied to the toner-carrying member are preferably so set as to satisfy the relationship:

$$|Vd-Vdc|>|Vl-Vdc|.$$

More preferably, the value of |Vd−Vdc| may be greater than the value of |Vl−Vdc| by 10 V or more.

Figure 11:
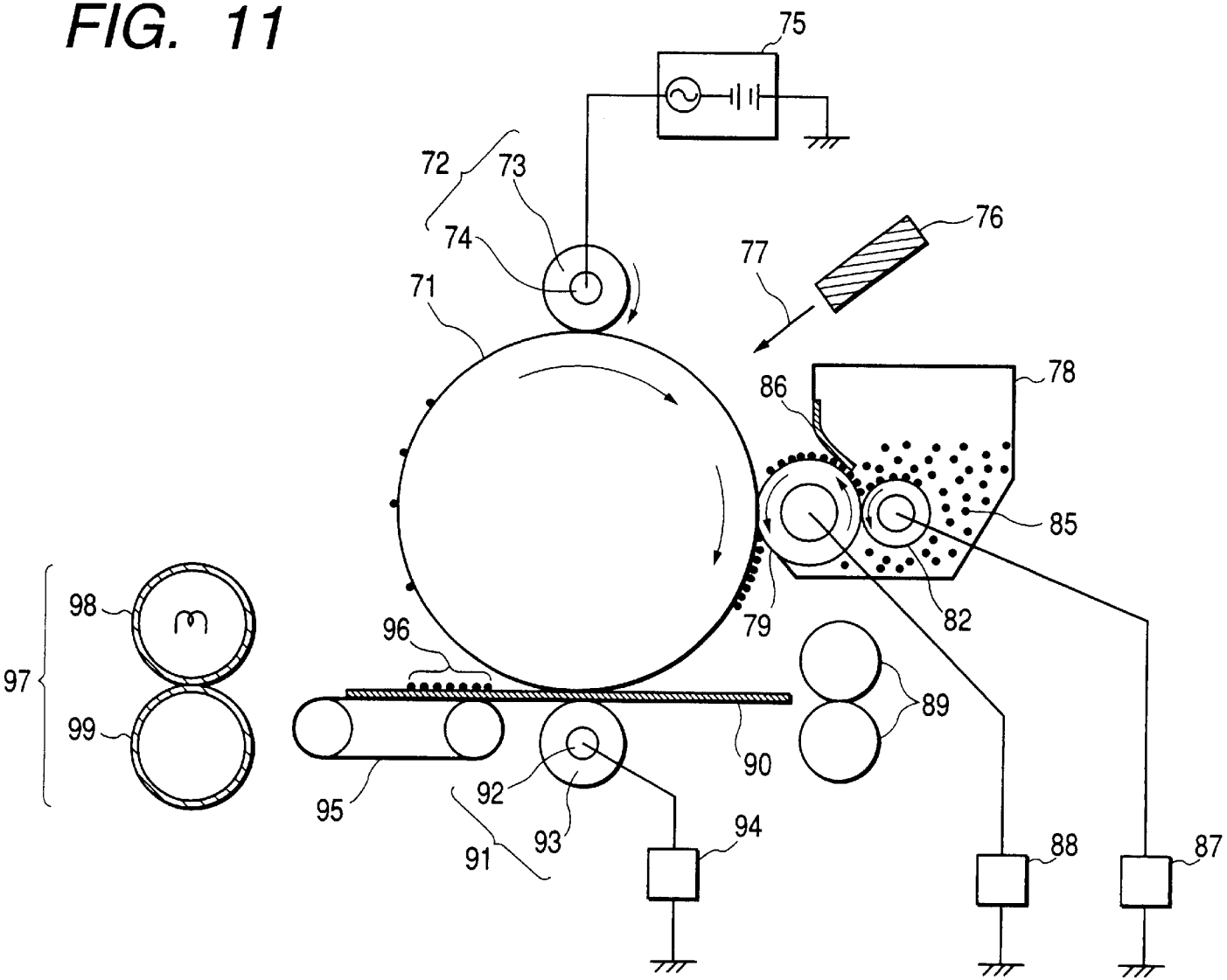
FIG. 11 is a diagrammatic illustration of an image-forming method employing a contact one-component developing assembly, used as a further example of the image-forming method of the present invention.

FIG. 11 illustrates another example of the image-forming apparatus, in which the toner can be fed to a developing sleeve serving as the toner-carrying member and in addition the toner having participated in the development can be smoothly stripped off the developing sleeve. What is shown in FIG. 11 is the same as what is shown in FIG. 9 except that the cleaner 102 in FIG. 9 is not provided.

Here, to carry out the cleaning-at-development, when the photosensitive drum 71 has a light-area potential of from 0 to 250 V and a dark-area potential of from 300 to 1,000 V as absolute value, a feed bias voltage applied from the bias applying means 87 may preferably be from 100 to 900 V as absolute value and a development bias voltage applied from the bias applying means 88 may preferably be from 100 to 900 V as absolute value. The feed bias voltage applied from the bias applying means 87 may also preferably be higher by 10 to 400 V as absolute value, than the development bias voltage applied from the bias applying means 88. This is preferable because the feeding of the non-magnetic toner 85 to the developing sleeve 79 and the stripping of the non-magnetic toner from the developing sleeve 79 can be made smooth.

Figure 14:
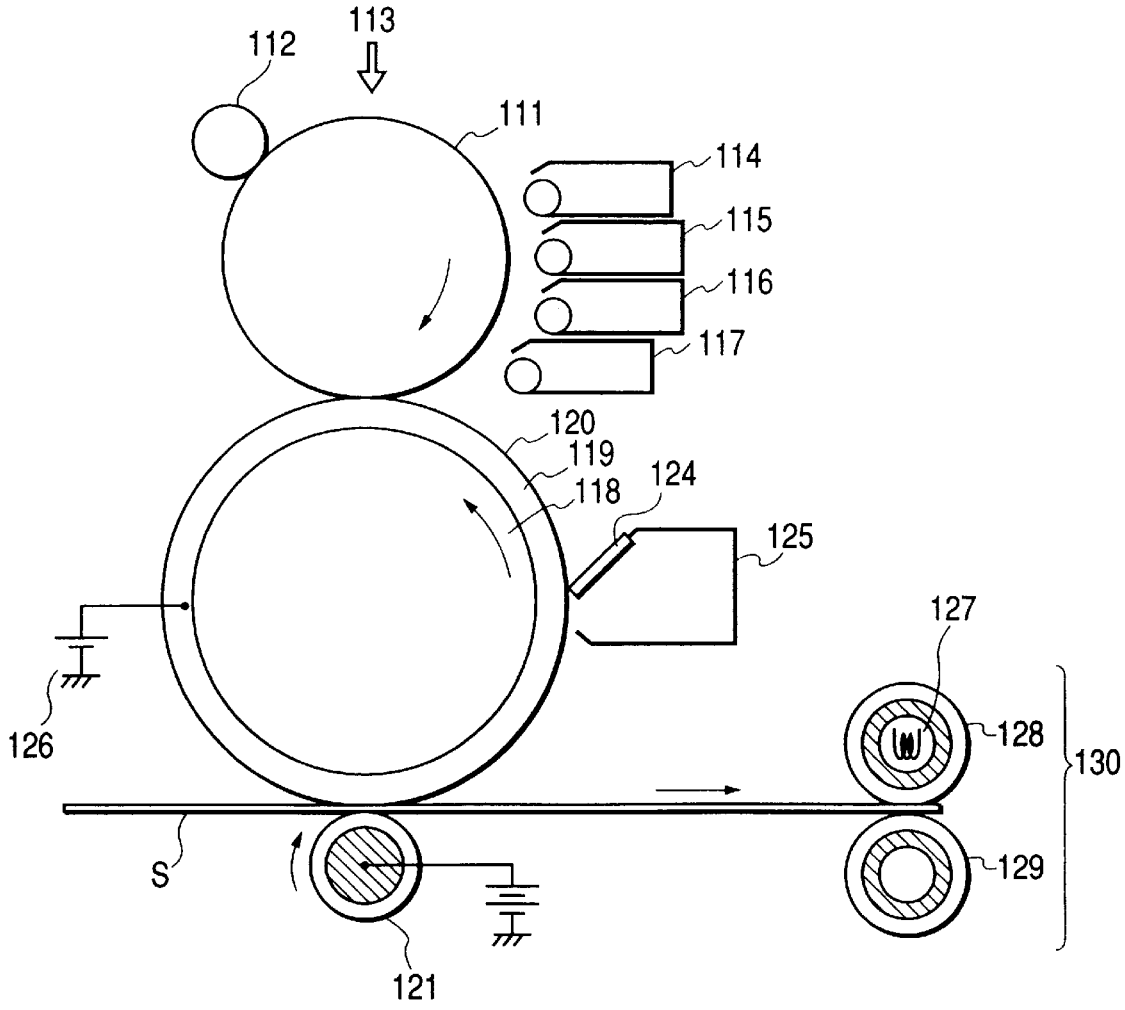
FIG. 14 is a diagrammatic illustration of another image-forming apparatus making use of an intermediate transfer member.

FIG. 14 shows an image-forming method in which the toner image formed on the image-bearing member is primarily transferred to an intermediate transfer member and the toner image transferred onto the intermediate transfer member is secondarily transferred to the recording medium, and which is the same as the one shown in FIG. 12 except that the cleaner 123 in FIG. 13 is not provided.

An image-forming apparatus employing two-component contact development will be described with reference to FIGS. 16 and 17.

Figure 16:
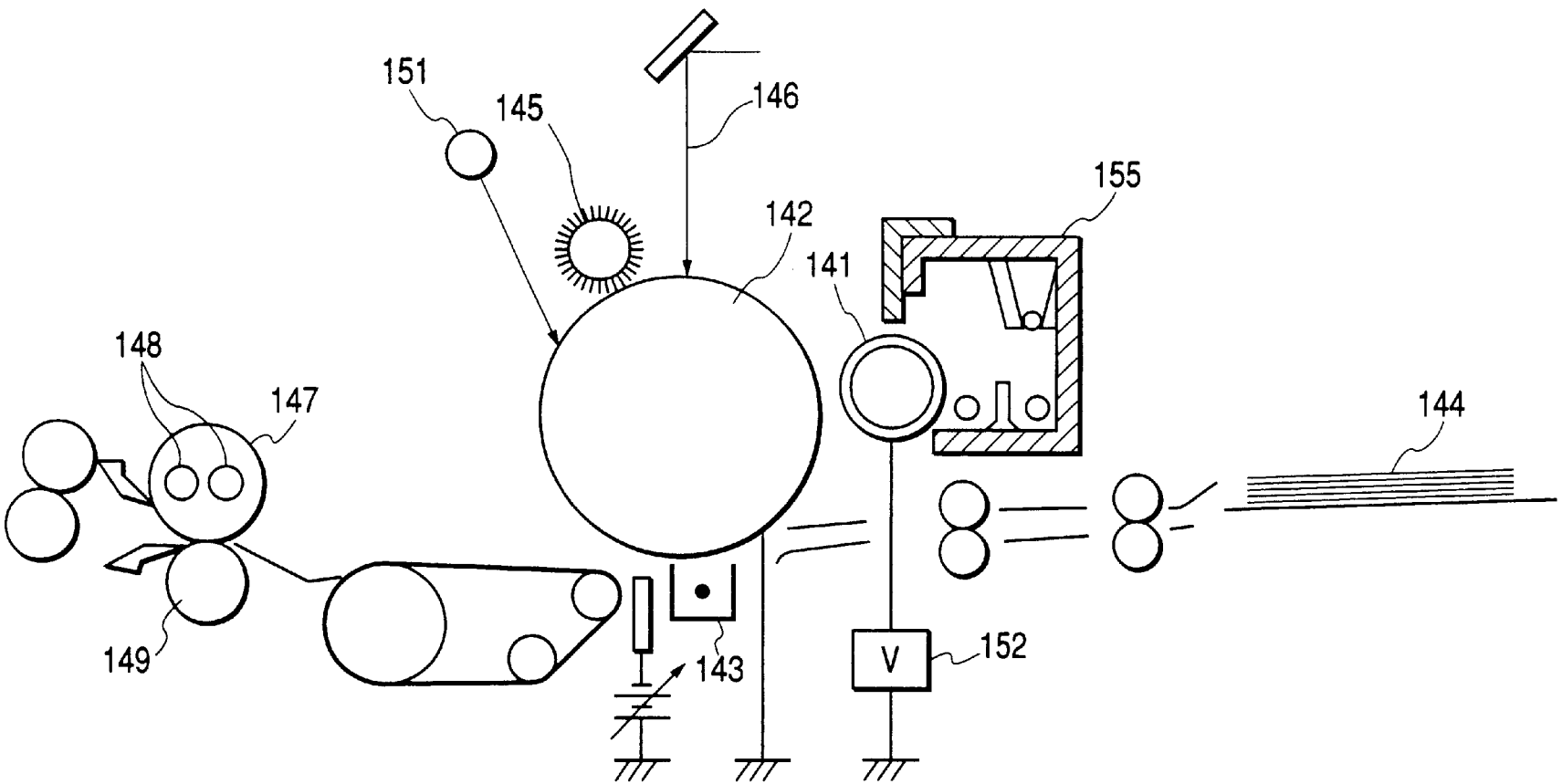
FIG. 16 is a diagrammatic illustration of an image-forming apparatus employing a contact two-component developing assembly making use of a two-component developer for magnetic brush development and also employing a cleaning-at-development system, used as an example of the image-forming method of the present invention.

FIG. 16 is a diagrammatic illustration of an image-forming apparatus having a developing assembly making use of a two-component type developer for magnetic brush development, which is used as an example for the image-forming method of the present invention in Examples given later.

As shown in FIG. 16, a charging brush roller 145 (resistance-controlled by dispersing carbon black in nylon fibers, having a fiber thickness of 6 deniers, a brush fiber length of 3 mm and a brush density of 100,000 threads per square inch, and rotatable at a peripheral speed of 120% in the direction reverse to the rotation of the photosensitive member) which is a charging means for a photosensitive member 142 is brought into contact with the photosensitive member 142 to electrostatically charge it by applying a bias voltage. The photosensitive member 142 is exposed to laser light 146 (600 dpi, binary) to form thereon an electrostatic latent image. A magnetic brush formed of a two component type developer having a toner and a magnetic carrier, on a developer-carrying member 141 of a developing assembly 155 is brought into contact with the photosensitive member 142, and the electrostatic latent image formed on the photosensitive member 142 is developed by reverse development to form a toner image.

To the developer-carrying member 141, at least a DC bias is applied through a bias applying means 152 (so set that development contrast is 500V as a DC component, and a voltage of 1.8 kV is applied as an AC component).

The toner image on the photosensitive member 142 is transferred onto a recording medium 144 as a transfer medium transported to the transfer zone, by means of a transfer means transfer corona charging assembly 143 (non-contact with the photosensitive member 142). The toner image transferred onto the recording medium 144 is fixed to the recording medium 144 through a heat-and-pressure fixing means having a pressure roller 149 and a heating roller 147 internally provided with a heater 148. The transfer residual toner remaining on the photosensitive member 142 after the transfer step does not pass through the cleaning step. The photosensitive member 142 decharged by erase exposure 151 is again electrostatically charged by the charging brush roller 145, and another electrostatic latent image is formed upon exposure 146. On the photosensitive member 142 having the transfer residual toner, the electrostatic latent image is developed by the magnetic brush formed on the developer-carrying member 141 and at the same time the transfer residual toner is collected to the developer-carrying member 141. A toner image formed on the photosensitive member 142 having passed through the cleaning-at-development step is transferred onto another recording medium 144 transported to the transfer zone. After the transfer step, the photosensitive member 142 is decharged by erase exposure 151, and is again electrostatically charged by means of the charging brush roller 145. A similar process is repeated thereafter.

Figure 17:
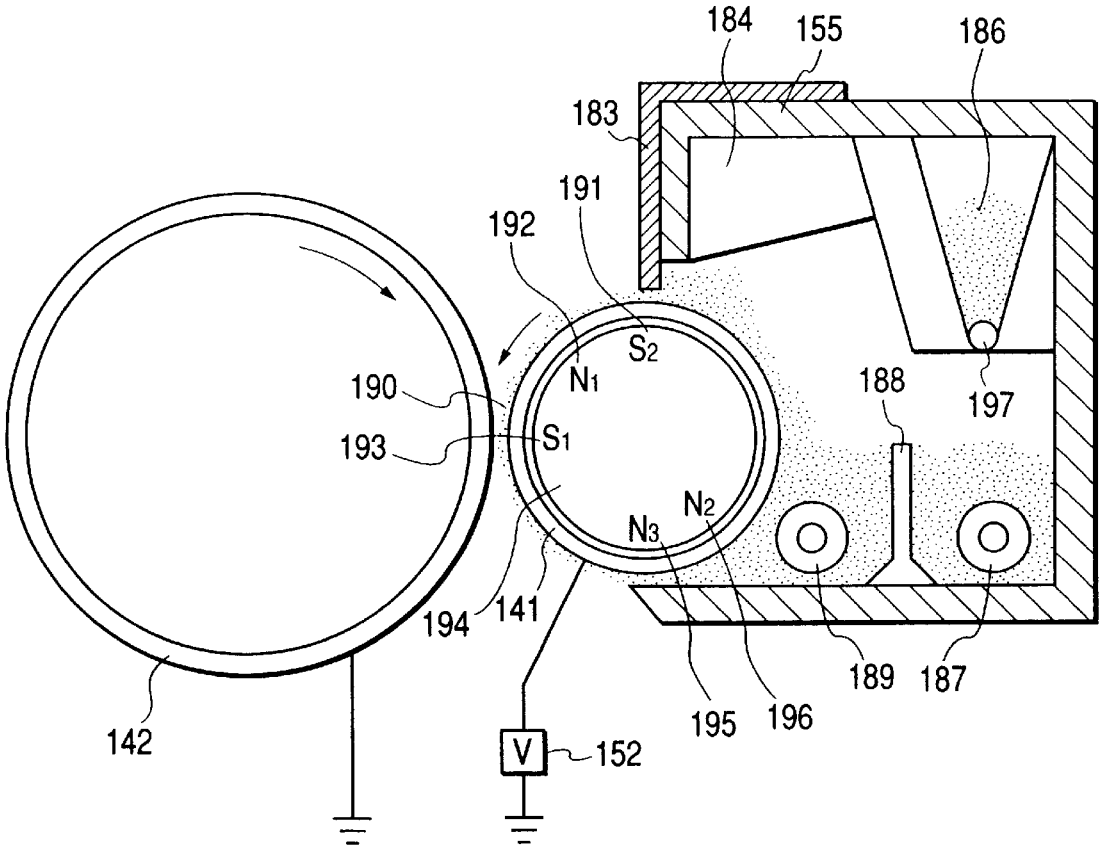
FIG. 17 is an enlarged view of the developing assembly shown in FIG. 16.

FIG. 17 shows an enlarged view of the developing part shown in FIG. 16. In FIG. 16, the photosensitive member 142 comes into contact with the magnetic brush formed of the two-component type developer on the developer-carrying member 141.

The developer-carrying member 141 is comprised of a non-magnetic material as exemplified by aluminum or SUS316 stainless steel. The developer-carrying member 141 is laterally provided in a rotatably supported state on a shaft in such a manner that it is thrust into the developing assembly 155 by substantially the right half of its periphery, from an oblong opening formed in the longitudinal direction of the container in the wall on the left lower side of the developing assembly 155, and is exposed to the outside of the container of the assembly by substantially the left half of its periphery, and is rotated in the direction of an arrow.

A stationary permanent magnet 194 serving as a means for generating stationary magnetic fields, provided inside the developer-carrying member 141 and arranged at the position and posture as shown in the drawing, is stationarily held at the position and posture as shown in the drawing, even when the developer-carrying member 141 is rotatively driven. This magnet 194 has five magnetic poles of north (N) magnetic poles 192, 195 and 196 and south (S) magnetic poles 191 and 193. As the magnet 194, an electromagnet may be disposed in place of the permanent magnet.

Reference numeral 183 denotes a non-magnetic blade serving as a developer regulation member, provided on the upper edge of the opening of a developer-feeding device at which the developer-carrying member 141 is disposed, in such a manner that its base is fixed on the side wall of the container. The blade is made of, e.g., SUS316 stainless steel so worked as to be bent in the L-form in its lateral cross section.

Reference numeral 184 denotes a magnetic carrier return member the top surface of which is brought into contact with the under surface side of the non-magnetic blade 183 (developer regulation member) and the front end face of which is made to serve as a developer guide face. The part defined by the non-magnetic blade 183, the magnetic carrier return member 184 and so forth is a regulation zone.

Reference numeral 190 denotes a developer layer having the toner and the magnetic carrier. Reference numeral 186 denotes the non-magnetic toner.

Reference numeral 197 denotes a toner-replenishing roller which is operated in accordance with an output obtained from a toner density detecting sensor (not shown). As the sensor, it is possible to utilize a system by which the volume of the developer is detected, an antenna system in which a piezoelectric device, an inductance variation detecting device and an alternating current bias are utilized, or a system by which an optical density is detected. The non-magnetic toner 186 is replenished by the rotating or stopping of the roller. A fresh developer replenished with the non-magnetic toner 186 is blended and agitated while it is transported by means of a developer transport screw 187. Hence, the toner replenished is triboelectrically charged in the course of this transportation. Reference numeral 188 denotes a partition plate, which is cut out at the both ends of its longitudinal direction, and at these cutouts the fresh developer transported by the screw 187 is delivered to another developer transport screw 189.

The north (N) magnetic pole 196 serves as a transport pole. It enables a recovered developer to be collected into the container after development has been carried out, and also the developer in the container to be transported to the control zone.

In the vicinity of the north (N) magnetic pole 196, the fresh developer transported by the screw 189 provided in proximity to the developer-carrying member 141, and the developer collected after developing are intermingled.

The distance d between the lower end of the non-magnetic blade 183 and the surface of the developer-carrying member 141 is set to be 400 μm. The d may preferably be in the range of from 100 to 900 μm. If this distance is smaller than 100 μm, the carrier particles tend to cause clogging between them to provide an uneven developer layer and also may make it impossible to apply the developer in the quantity necessary for carrying out good development, bringing about only developed images with low density and much unevenness in some cases. If on the other hand this distance is larger than 900 μm, the quantity of the developer applied to the developer-carrying member 141 may increase to make it impossible to regulate the developer layer so as to have a given thickness, so that magnetic particles may adhere to the image-bearing member in a large quantity and at the same time the circulation of developer and the developer regulation attributable to the magnetic carrier return member 184 may become weak, tending to bring about the triboelectricity shortage of toner to cause fog.

The thickness of the developer layer on the developer-carrying member 141 may preferably be made a little larger than the opposing gap distance between the developer-carrying member 141 and the photosensitive member 142. This distance is set to be 400 μm. It may preferably be set to be from 50 to 800 μm.

EXAMPLES

The present invention will be specifically described below by giving Examples. The present invention is by no means limited to these.

Example 1

Into a 2-liter four-necked flask having a high-speed stirrer KUREA MIX (manufactured by M. Technique Co.), 700 parts by weight of ion-exchanged water and 800 parts by weight of an aqueous 0.1 mol/liter $Na_3PO_4$ solution were introduced, the number of revolutions of the high-speed stirrer was set to 15,000 rpm, and the mixture was heated to 65° C. Then, 70 parts by weight of an aqueous 0.1 mol/liter $CaCl_2$ solution was added thereto to prepare an aqueous dispersion medium containing a fine-particle slightly water-soluble dispersant $Ca_3(PO_4)_2$. Dilute hydrochloric acid was further so added that the pH of the aqueous dispersion medium was adjusted to 5.2.

| | (by weight) |
|---|---|
| Styrene | 77 parts |
| 2-Ethylhexyl acrylate | 23 parts |
| Divinylbenzene | 0.2 part |
| Cyan colorant (C.I. Pigment Blue 15) | 8 parts |
| Polycarbonate resin (peak molecular weight: 7,000) | 5 parts |
| Charge control agent (salicylic acid aluminum compound) | 2 parts |
| Oxycarboxylic acid (1-A) | 0.5 part |
| Ester wax (melting point: 60° C.) | 7 parts |

Meanwhile, as a disperse phase, a mixture comprised of the above materials was dispersed for 3 hours by means of an attritor (manufactured by Mitsui Mining & Smelting Co., Ltd.), followed by addition of 7 parts by weight of a polymerization initiator 2,2'-azobis(2,4-dimethylvaleronitrile) to prepare a polymerizable monomer composition.

Next, the polymerizable monomer composition was introduced into the above aqueous dispersion medium to granulate the polymerizable monomer composition with stirring for 15 minutes in an atmosphere of $N_2$ at an internal temperature of 70° C. and while maintaining the number of revolutions of the high-speed stirrer at 15,000 rpm. Thereafter, the stirrer was replaced with a stirrer having paddle stirring blades, and the same temperature was maintained while stirring the system at 80 rpm. At the time the polymerization conversion of the polymerizable vinyl monomer reached 90%, the first reaction step was finished. To the reaction mixture formed, an aqueous 0.1 mol/liter sodium hydroxide solution was added to change the pH of the aqueous dispersion medium to 10. The reaction temperature was further raised to 80° C., and the second reaction step was finished at the time the polymerization conversion reached substantially 100%. Thus the polymerization step was completed.

After the polymerization was completed, residual monomers were evaporated off under reduced pressure with heating, and then, after cooling, dilute hydrochloric acid was added thereto to dissolve the slightly water-soluble dispersion stabilizer. Washing with water was further repeated several times, followed by drying by means of a conical ribbon dryer (manufactured by Ohkawara Seisakusho K.K.), thus polymer particles A were obtained.

After the polymer particles were produced, how the flask inner walls and paddle stirring blades were contaminated was examined to make evaluation according to the following criteria. The results of evaluation were as shown in Table 1.

A: The greater part of contaminants was washable away by water jetting.

B: Contaminants stuck slightly.

C: Tough contaminants stuck, and had to be washed with an organic solvent.

100 parts by weight of the polymer particles A and 2 parts by weight of a hydrophobic oil-treated fine silica powder (BET specific surface area: 200 $m^2/g$) were dry-process mixed by means of a Henschel mixer (manufactured by Mitsui Mining & Smelting Co., Ltd.) to obtain Toner A of the present invention.

The weight A of oxycarboxylic acid extracted with methanol from 1 g of Toner A was 1.57 mg, and the weight B of oxycarboxylic acid extracted with 0.1 mol/liter of an aqueous sodium hydroxide solution therefrom was 1.15 mg. The value of A/B was 1.37.

The circle-corresponding number-average particle diameter of the toner was 5.4 μm. In its circularity frequency distribution, the average circularity was 0.988, the circularity standard deviation was 0.031 and the toner particles having an average circularity less than 0.950 were 1.9% by number. Also, in its molecular weight distribution as measured by GPC, the peak molecular weight was 13,000 and Mw/Mn was 14.

The total residue of polymerizable monomers in Toner A was 60 ppm (styrene monomer: 60 ppm; 2-ethylhexyl acrylate monomer and divinyl benzene monomer: 0 ppm). Cross-sectional observation of toner particles by TEM was further made to ascertain that, as shown diagrammatically in FIG. 1C, continuous thin layers were formed on toner particle surfaces, the binder resin and wax component were present in the inward direction of the toner particles, and the wax component stood dispersed in the binder resin in substantially a spherical form.

Using Toner A thus obtained, the quantity of triboelectricity in each environment of normal temperature/normal humidity (N/N; 25° C./60%RH) and high temperature/high humidity (H/H; 30° C./80%RH) was measured, and also how the charging rate decreased in the high-temperature/high-humidity environment with respect to the normal-temperature/normal-humidity environment was examined to make an evaluation.

Figure 3:
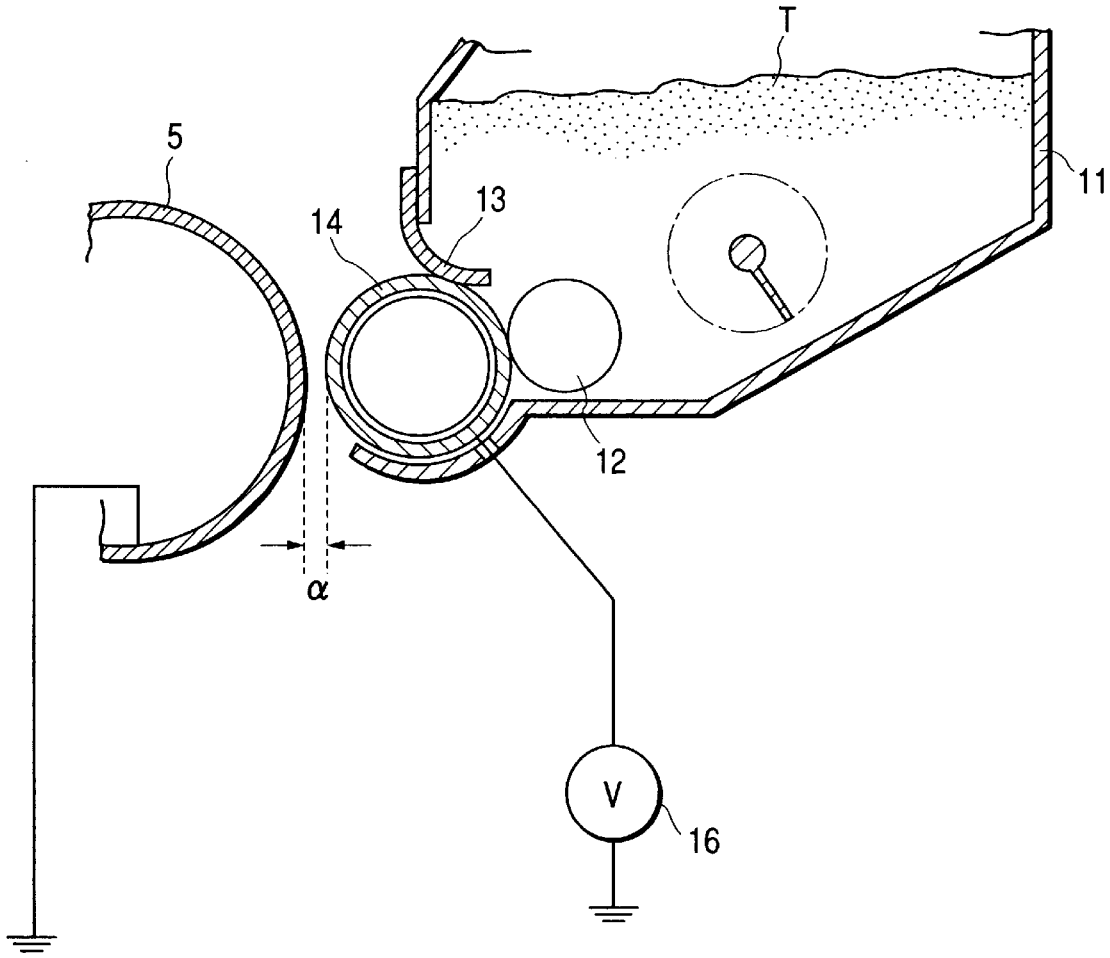
FIG. 3 is a transverse cross section of a process cartridge remodeled for non-magnetic one-component development.

For further evaluation, the process cartridge of a commercially available laser beam printer LBP-EX (manufactured by CANON INC.) was so remodeled as shown in FIG. 3 as to be usable for non-magnetic one-component jumping development, and a 5,000-sheet printing test was made in the normal-temperature/normal-humidity environment and the high-temperature/high-humidity environment while replenishing Toner A successively. Printed images thus obtained were evaluated. The results of evaluation were as shown in Table 3 [Table 3(A)–3(B)].

The image-forming method making use of the process cartridge shown in FIG. 3 is described below.

As shown in FIG. 3, on an electrostatic latent image bearing member, photosensitive drum 15, latent images are formed by an electrophotographic processing means or electrostatic recording means. Substantially the right-half periphery of a toner-carrying member (developing sleeve) 14 comprised of a non-magnetic sleeve is always in contact with a heap of toner in a toner container 11. A toner T in the toner container 11 is fed onto the toner-carrying member 14 by a toner feed member, toner-coating roller 12. The surface movement direction of the toner-coating roller 12 is set opposite to the surface movement direction of the toner-carrying member 14. The toner-coating roller 12 feeds the toner onto the toner-carrying member and, after development, strips the toner not having participated in the development. The toner fed onto the toner-carrying member 14 is applied uniformly in a thin layer by a toner layer thickness regulation member 13 comprised of an elastic blade. The photosensitive drum 15 and the toner-carrying member 14 are set to leave a gap $\alpha$ of 180 $\mu$m between them.

Meanwhile, a development bias is applied across the toner-carrying member 4 and the photosensitive drum 15 by a bias power source 16.

Examples 2 to 5 & Comparative Examples 1 and 2

Polymer particles B to E and comparative polymer particles a and b were obtained and thereafter Toners B to E of the present invention and Comparative Toners a and b were produced in the same manner as in Example 1 except that the types and amounts of the oxycarboxylic acid and wax component added were changed and also the pH of the aqueous dispersion medium in the first reaction step, the polymerization conversion at the time the first reaction step was finished (polymerization conversion at a change of reaction steps) and the pH of the aqueous dispersion medium in the second reaction step were changed.

The types and amounts of the oxycarboxylic acid and wax component, the pH of the aqueous dispersion mediums in the first and second reaction steps and the polymerization conversion at a change of reaction steps in the respective Examples and Comparative Examples are shown in Table 1. Properties of Toners B to E and Comparative Toners a and b were as shown in Table 2.

Using Toners B to E and Comparative Toners a and b thus obtained, evaluation was further made in the same manner as in Example 1, obtaining the results as shown in Table 3.

Evaluation items in the above Examples and Comparative Examples and their evaluation criteria are as described below.

Evaluation on Quantity of Triboelectricity and Decrease in Charging Rate

In the present invention, the quantity of triboelectricity and charging rate of the toner was measured by suction gauging. First, 0.5 g of the toner and 9.5 g of a carrier (EFV-200/300, available from Powder Teck Co.) are weighed out. These are put in a 50-ml polyethylene container, and left for 2 days in the measuring environments. Thereafter, in each environment, the container is stoppered and shaked for 5 minutes by means of a tumbling mixer (manufactured by WAB Co.) to prepare a toner-carrier mix sample.

Figure 2:
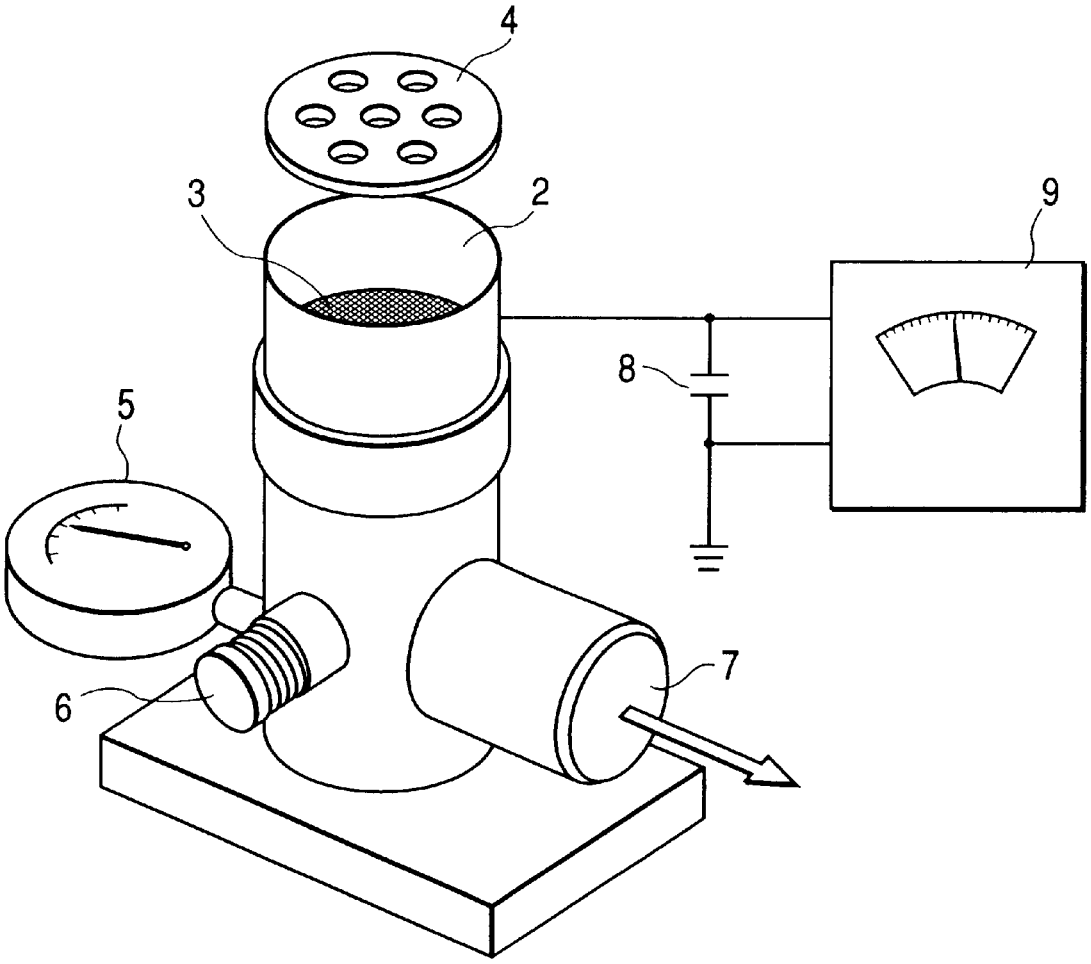
FIG. 2 is a perspective view of a device for measuring the quantity of triboelectricity of toner, used in the present invention.

A charge quantity measuring device used in the present invention is shown in FIG. 2. In a measuring container 2 made of a metal and provided at the bottom with a conductive screen 3 having a mesh size of 25 $\mu$m (500 meshes) the opening diameter of which can capture the carrier and remove only the toner by suction, 1 g of the above mix sample is weighed out and put, and the container is covered with a plate 4 made of a metal. Next, using a suction device connected with the measuring container 2 via an insulating portion, the sample is sucked for 2 minutes from a suction opening 7 by operating an air-flow control valve 6 to control the pressure indicated by a vacuum indicator 5 so as to be 250 $mmH_2O$. Here, the charge quantity calculated from the voltage value V (V) indicated by a potentiometer 9 and the electrostatic capacity C ($\mu$F) of a capacitor 8 is divided by the weight W (g) of the toner having been removed by suction, and the value obtained is regarded as quantity of triboelectricity (mC/kg).

$$\text{Quantity of triboelectricity (mC/kg)} = CV/W$$

The quantity of triboelectricity was evaluated according to the following criteria.

In the normal-temperature/normal-humidity environment;

A: −40 mC/kg or above.

B: From −30 mC/kg to less than −40 mC/kg.

C: From −20 mC/kg to less than −30 mC/kg.

D: Less than −20 mC/kg.

In the high-temperature/high-humidity environment;

A: −30 mC/kg or above.

B: From −20 mC/kg to less than −30 mC/kg.

C: From −10 mC/kg to less than −20 mC/kg.

D: Less than −10 mC/kg.

With regard to the decrease in charging rate, a sample prepared by blending a toner and a carrier was shaked using a tumbling mixer in each of the normal-temperature/normal-humidity environment and the high-temperature/high-humidity environment, where the charging rate was determined from the amount of change in the quantity of triboelectricity with respect to the shaking time. Evaluation was made on the basis of the difference in the charging rate between the environments.

A: Excellent.

B: Good.

C: A little poor.

D: Poor.

Printed-Image Evaluation (1) Image density:

Evaluated by image density at the time the printing was completed on 5,000 sheets, using usual plain paper (75 $g/m^2$) for copying machines. The image density was measured with MACBETH REFLECTION DENSITOMETER (manufactured by Macbeth Co.), as relative density with respect to an image printed on a white ground area with a density of 0.00 of an original.

A: 1.40 or more.
B: From 1.35 to less than 1.40.
C: From 1.00 to less than 1.35.
D: Less than 1.00.

Figure 4A:
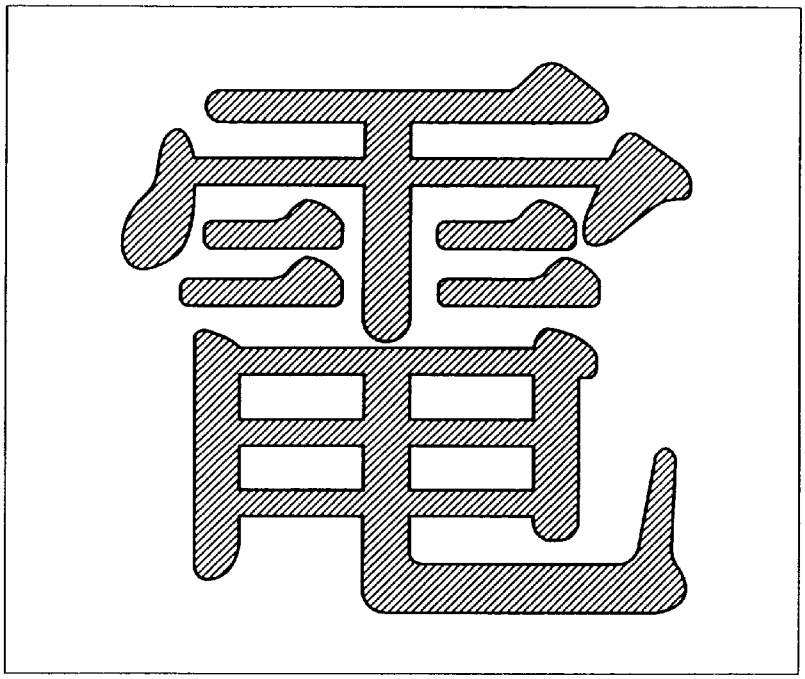
FIGS. 4A and 4B are diagrammatic views showing how black spots appear around a character image.
Figure 4B:
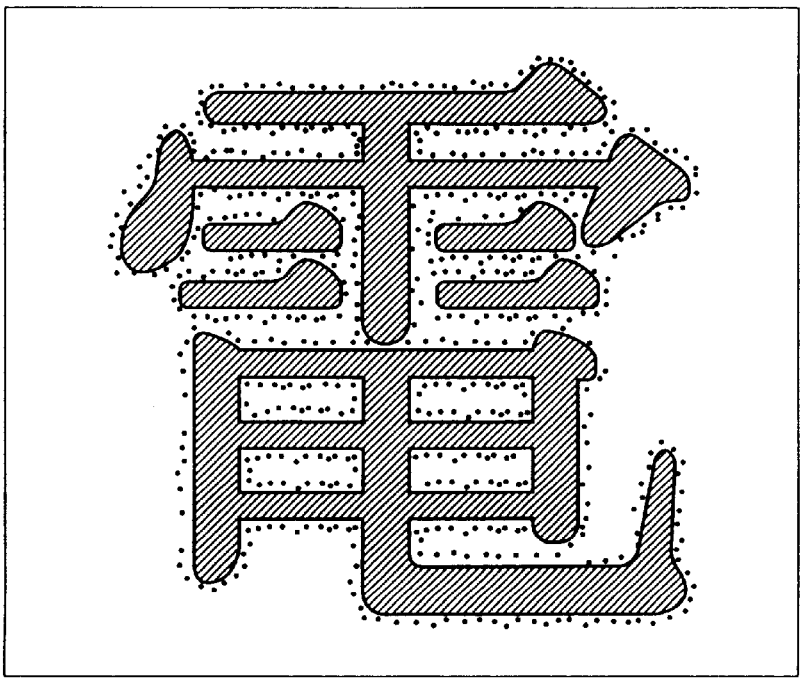

(2) Spots around line images:

After the 5,000-sheet printing test was finished, a character pattern as shown in FIG. 4A was printed on plain paper, where any spots (toner scatter) around line images (the state shown in FIG. 4B) was examined to make an evaluation visually.

A: Spots around line images little occur.
B: Slight spots around line images are seen.
C: Spots around line images are a little seen.
D: Conspicuous spots around line images are seen.

Figure 5A:
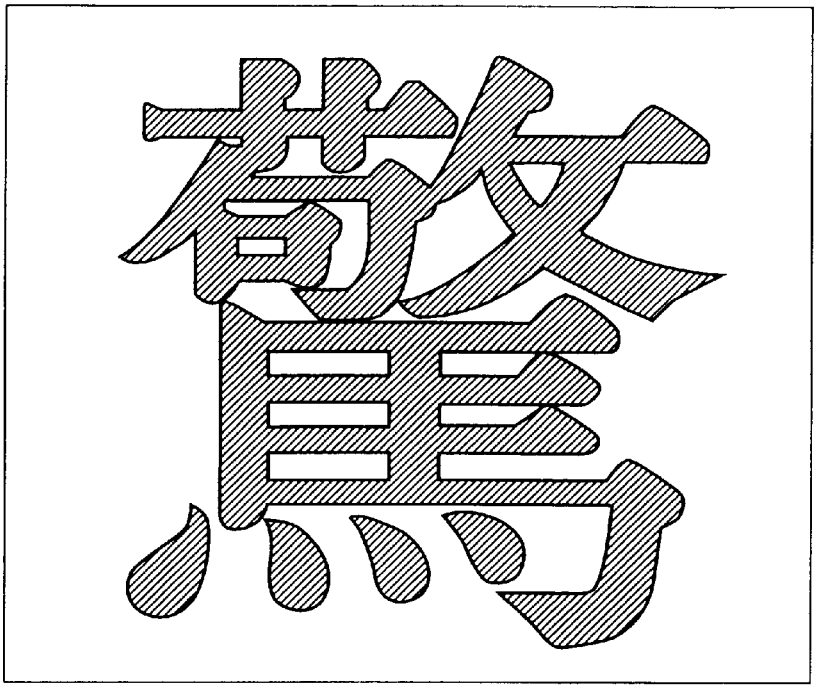
FIGS. 5A and 5B are diagrammatic views showing how blank areas appear in a character image.
Figure 5B:
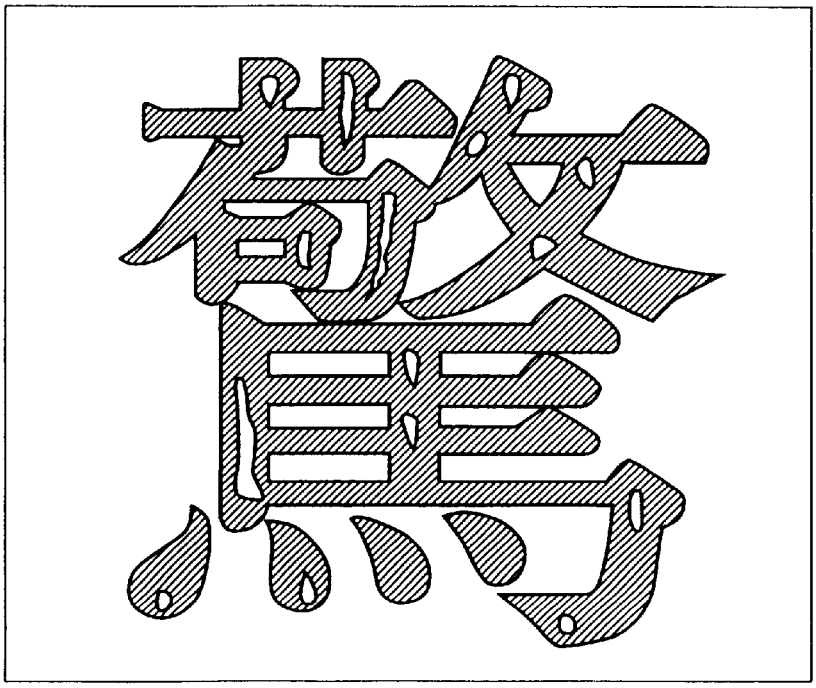

(3) Image blank areas:

After the 5,000-sheet printing test was finished, a character pattern as shown in FIG. 5A was printed on a card board (128 g/m$^2$), where any blank areas in characters (the state shown in FIG. 5B) was examined to make an evaluation visually.

A: Blank areas little occur.
B: Slight blank areas are seen.
C: Blank areas are a little seen.
D: Conspicuous blank areas are seen.

Evaluation on Matching to Image-Forming Apparatus (1) Matching to toner-carrying member:

After the printing test was finished, evaluation was visually made by examining the state of the sticking of residual toner to the toner-carrying member surface and the effect thereof on printed images.

A: No sticking occurs.
B: Contamination has occurred, but sticking little occurs.
C: Sticking is seen, but has no serious effect on images.
D: Sticking is greatly seen, and uneven images occur.

(2) Matching to toner regulation blade:

After the printing test was finished, evaluation was visually made by examining the state of scratches on the toner regulation blade surface and the sticking of toner thereto, and the effect thereof on printed images.

A: No sticking occurs.
B: Scratches have occurred on the blade surface, but sticking little occurs.
C: Sticking is seen, but has no serious effect on images.
D: Sticking is greatly seen, and faulty images occur.

(3) Matching to toner-coating roller:

After the printing test was finished, evaluation was visually made by examining the state of the sticking of toner to the toner-coating roller and the effect thereof on printed images.

A: No sticking occurs.
B: Contamination has occurred, but sticking little occurs.
C: Sticking is seen, but has no serious effect on images.
D: Sticking is greatly seen, and uneven images occur.

Example 6

Into a 2-liter four-necked flask having a high-speed stirrer KUREA MIX (manufactured by M. Technique Co.), 1,000 parts by weight of ion-exchanged water and 450 parts by weight of an aqueous 0.1 mol/liter $Na_3PO_4$ solution were introduced, the number of revolutions of the high-speed stirrer was set to 15,000 rpm, and the mixture was heated to 65° C. To this mixture, 20 parts by weight of 1N hydrochloric acid was added, and thereafter 65 parts by weight of an aqueous 0.1 mol/liter $CaCl_2$ solution was slowly added thereto to prepare an aqueous dispersion medium containing a fine-particle slightly water-soluble dispersant $Ca_3(PO_4)_2$. At this stage the pH of the aqueous dispersion medium was 5.3.

| | (by weight) |
|---|---|
| Styrene | 83 parts |
| n-Butyl acrylate | 17 parts |
| Cyan colorant (copper phthalocyanine pigment) | 7 parts |
| Polyester resin (acid value: 12 mg KOH/g) | 5 parts |
| Charge control agent (salicylic acid aluminum compound) | 1 part |
| Oxycarboxylic acid (1-A) | 0.5 part |
| Ester wax (melting point: 60° C.) | 15 parts |

As a disperse phase, a mixture comprised of the above materials was dispersed for 3 hours by means of an attritor (manufactured by Mitsui Mining & Smelting Co., Ltd.), followed by addition of 3 parts by weight of a polymerization initiator 2,2'-azobis(2,4-dimethylvaleronitrile) to prepare a polymerizable monomer composition.

Next, the polymerizable monomer composition was introduced into the above aqueous dispersion medium to granulate the polymerizable monomer composition with stirring for 8 minutes in an atmosphere of $N_2$ with internal temperature of 70° C. and while maintaining the number of revolutions of the high-speed stirrer at 15,000 rpm. Thereafter, the stirrer was replaced with a stirrer having paddle stirring blades, and the same temperature was maintained while stirring the system at 80 rpm, to carry out polymerization for 8 hours.

After the polymerization was completed, $NaHCO_3$ was added in the aqueous dispersion medium to adjust the pH to 11, and 1 part by weight of a water-soluble initiator $K_2S_2O_8$ (KPS) was further added, followed by distillation carried out for 5 hours at an internal temperature of 80° C. under heating reduced pressure of 350 mmHg to evaporate off residual monomers. Then, after cooling, dilute hydrochloric acid was added thereto to dissolve the slightly water-soluble dispersion stabilizer. After solid-liquid separation by pressure filtration, washing was further carried out with 20,000 parts by weight of water, followed by drying at 45° C. for 4 hours by means of a fluidized bed dryer (manufactured by Ohkawara Seisakusho K.K.). Thus, cyan-color polymer particles F were obtained.

After the polymer particles were produced, how the flask inner walls and paddle stirring blades were contaminated was examined and evaluated according to the criteria shown in Example 1. The results of evaluation were as shown in Table 4.

100 parts by weight of the polymer particles F, 0.7 part by weight of a hydrophobic oil-treated fine silica powder (BET specific surface area: 200 m$^2$/g) and 0.7 part by weight of a hydrophobic fine titanium oxide powder (BET specific surface area: 50 m$^2$/g) were dry-process mixed by means of a Henschel mixer (manufactured by Mitsui Mining & Smelting Co., Ltd.) to obtain Toner F of the present invention, having a good fluidity.

The weight A of oxycarboxylic acid extracted with methanol from 1 g of Toner F was 1.22 mg, and the weight B of oxycarboxylic acid extracted with 0.1 mol/liter of an aqueous sodium hydroxide solution therefrom was 1.01 mg. The value of A/B was 1.21.

The circle-corresponding number-average particle diameter of the toner was 5.9 $\mu$m. In its circularity frequency distribution, the average circularity was 0.986, the circularity standard deviation was 0.030 and the toner particles having an average circularity less than 0.950 were 2.3% by number. The glass transition temperature was 59° C.

The total residue of polymerizable monomers in Toner F was 40 ppm (styrene monomer: 40 ppm; n-butyl acrylate monomer: 0 ppm).

Cross-sectional observation of toner particles by TEM was further made to ascertain that, as shown diagrammatically in FIG. 1C, continuous thin layers were formed on toner particle surfaces, the binder resin and wax component were present in the inward direction of the toner particles, and the wax component stood dispersed in the binder resin in substantially a spherical form.

Using Toner F thus obtained, the quantity of triboelectricity in each environment of normal temperature/normal humidity (N/N; 25° C./60%RH) and high temperature/high humidity (H/H; 30° C./80%RH) was measured, and also how the charging rate decreased in the high-temperature/high-humidity environment with respect to the normal-temperature/normal-humidity environment was examined and evaluated.

For further evaluation, 8 parts by weight of Toner F and 92 parts by weight of a binder type carrier coated with a silane type coupling agent were uniformly blended to prepare a two-component type developer. The developer was put in the compartments R1 and R2 of the developing assembly unit shown in FIG. 7. This was set in the image-forming apparatus shown in FIG. 6, and a 10,000-sheet printing test was made in the normal-temperature/normal-humidity environment and the high-temperature/high-humidity environment while replenishing Toner F successively. Printed images thus obtained were evaluated. The results of evaluation were as shown in Table 6.

Figure 6:
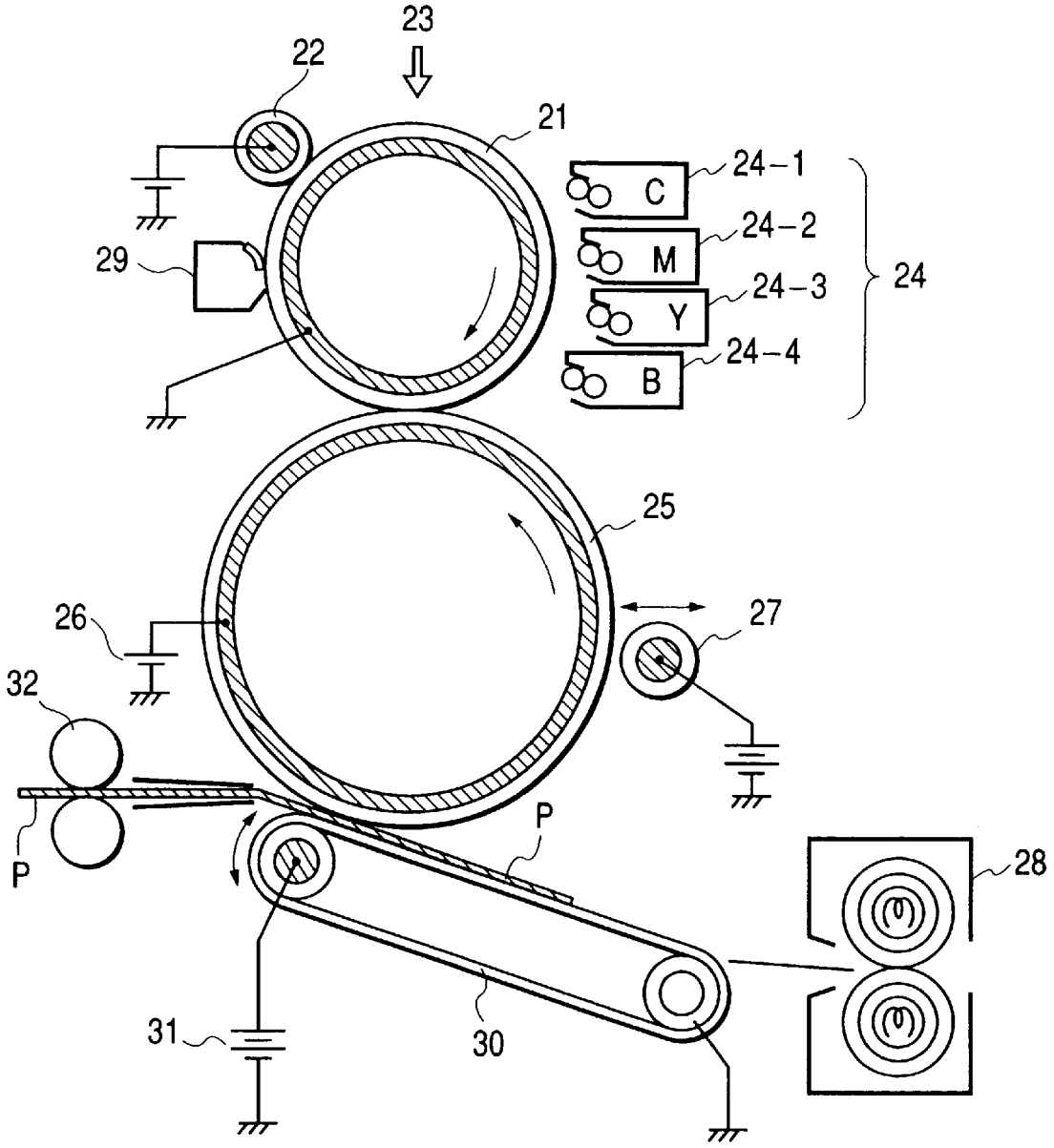
FIG. 6 is a schematic illustration showing an example of an image-forming apparatus to which the toner of the present invention is applicable.

The image-forming method making use of the image-forming apparatus shown in FIG. 6 is described below.

As shown in FIG. 6, around an electrostatic latent image bearing member, photosensitive drum 21 disposed are developing assemblies 24-1, 24-2, 24-3 and 24-4, a contact charging means primary charging roller 22, an intermediate transfer member 25 and a photosensitive member cleaning assembly 29.

The photosensitive drum 21 surface is electrostatically charged by a charging roller 22. The photosensitive drum 21 thus charged is exposed to light 23 by an exposure means, thus an electrostatic latent image is formed on the photosensitive drum 21.

Figure 7:
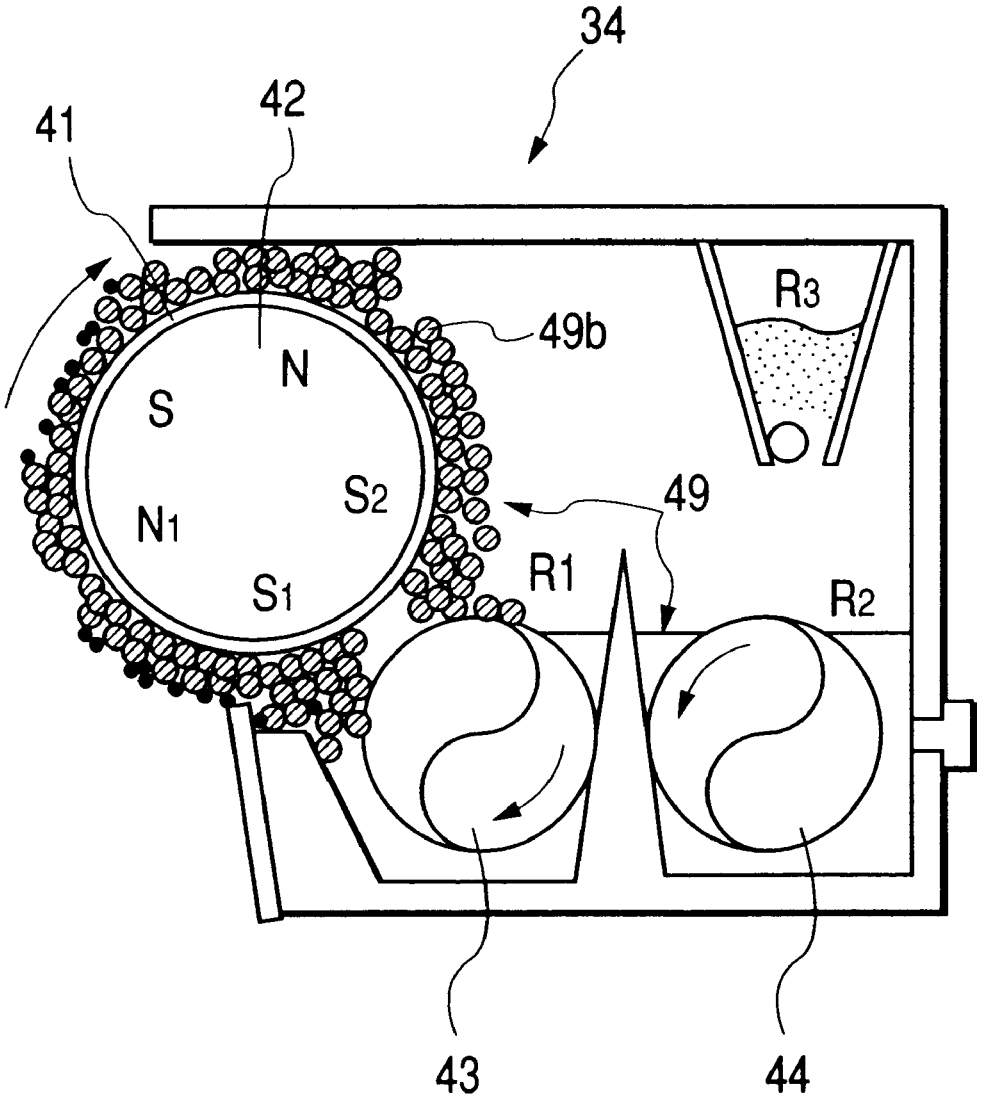
FIG. 7 is a schematic illustration showing an example of a developing assembly unit of the image-forming apparatus shown in FIG. 6.

FIG. 7 is a schematic illustration of a developing assembly common to the developing assemblies 24-1, 24-2, 24-3 and 24-4. In developer chambers R1 and agitation chambers R2 of these assemblies, two-component type developers 49 are respectively loaded which are obtained by blending first to fourth different-color toners (e.g., cyan, magenta, yellow and black toners) with magnetic carriers. Each two-component type developer 49 is transported while being mixed and agitated by screws 43 and 44, and is circulated through the developer chamber R1 and agitation chamber R2. At the upper part of the agitation chamber R2, a stock room R3 holding a replenishing toner is provided. As a developing sleeve 41 is rotated, the two-component type developer 49 transported to the developer chamber R1 is carried on the surface of the developing sleeve 41 by the aid of the magnetic force a magnet roller 42 has, to form a magnetic brush 49*b*. Then, the magnetic brush is brought into contact with the surface of the photosensitive drum 21, so that the electrostatic latent image on the photosensitive drum 21 is developed. Thus, first to fourth color toner images are sequentially formed, and are successively primarily transferred to the intermediate transfer member 25 to which a primary transfer bias is kept applied through a primary transfer bias power source 26. Transfer residual toner on the photosensitive drum 21 is collected by the photosensitive member cleaning assembly 29.

A transfer belt 30 provided in contact with the bottom part of the intermediate transfer member 25 is supported by a bias roller and a tension roller. To the bias roller, a secondary transfer bias is applied through a secondary transfer bias power source, where the toner images are secondarily transferred from the intermediate transfer member 25 to a transfer medium P.

To effect the secondary transfer of color toner images to the transfer medium P, the color toner images being superimposingly transferred onto the intermediate transfer member 25, the transfer belt 30 is brought into contact with the intermediate transfer member 25 and also the transfer medium P is transported at a preset timing from a paper feed cassette (not shown) and through a resist roller 32. At the same time, the secondary transfer bias is applied, and the color toner images are transferred to the transfer medium P from the intermediate transfer member 25.

The transfer belt 30 and an intermediate transfer member cleaning roller 27 is set separable from the intermediate transfer member 25. It is kept separate from the intermediate transfer member 25 in the course of the primary transfer step.

The transfer medium P to which the toner images have been transferred is guided to a heat-and-pressure fixing assembly 28, where the toner images are oil-less heat-fixed.

In addition, in the present Example, the printing test was made in a monochromatic mode, using the image-forming apparatus shown in FIG. 6.

Examples 7 to 15

Toners G to O of the present invention were produced in the same manner as in Example 6 except that the following items (1) to (4) were changed.

(1) To change the type and amount of the oxycarboxylic acid added;

(2) To change the amount of the polar resin added;

(3) To change the pH of the aqueous dispersion medium in the polymerization reaction of polymerizable monomers in the course of from the granulation step to the distillation step; and (4) To use or not use the water-soluble initiator.

The changes (1) to (4) made in the respective Examples were as shown in Table 4, and properties of Toners G to O obtained were as shown in Table 5.

Using Toners G to O thus obtained, two-component type developers G to O were also produced and evaluation was made in the same manner as in Example 6. Results obtained were as shown in Table 6.

Comparative Examples 3 and 4

Comparative Toners c and d were produced in the same manner as in Example 6 except that the above items (1) to (4) were changed.

The changes (1) to (4) made in the respective Comparative Examples were as shown in Table 4, and properties of Comparative Toners c and d obtained were as shown in Table 5.

Using Comparative Toners c and d thus obtained, comparative two-component type developers c and d were also prepared and evaluation was made in the same manner as in Example 6. Results obtained were as shown in Table 6.

Evaluation items in the above Examples and Comparative Examples and their evaluation criteria are as described below.

Measurement of Quantity of Triboelectricity and Charging Rate

Corresponding to the case shown in Table 3.

Evaluation on Carrier Contamination 0.5 g of the toner and 9.5 g of carrier (EFV-200/300, available from Powder Teck Co.) are weighed out. These are put in a 50-ml polyethylene container, and left for 2 days in the high-temperature/high-humidity environment. Thereafter, in that environment, the container is hermetically stoppered and shaked for 5 minutes by means of a tumbling mixer (manufactured by WAB Co.) to prepare a toner-carrier mix sample. The mix sample obtained is observed with a scanning electron microscope (SEM) to judge how fine particles present in the toner adhere to carrier surfaces.

A: Little adhere.

B: Seen to adhere slightly.

C: Seen to adhere greatly.

D: Seen to stick to carrier surfaces.

Printed-Image Evaluation (1) Image density:

Corresponding to the case shown in Table 3, provided that the evaluation was made on printed images after the 10,000-sheet printing was completed.

(2) Image fog:

An amber filter is set in REFLECTOMETER MODEL TC-6DS (trade name; manufactured by Tokyo Denshoku Co., Ltd.), and a reflectance (%) at non-image areas of printed images is measured. The reflectance measured is subtracted from a reflectance (%) measured in the same way on unused printing paper (reference paper). The numerical value (%) obtained is used evaluation. The smaller the numerical value is, the better the image fog is restrained. The evaluation on the image fog was made after the 10,000-sheet printing was completed.

A: Less than 0.5%.

B: From 0.5% to less than 1.0%.

C: From 1.0% to less than 2.0%.

D: More than 2.0%.

(3) Image blank areas:

Corresponding to the case shown in Table 3, provided that the evaluation was made on printed images after the 10,000-sheet printing was completed.

Toner Production Example 1

Into a 2-liter four-necked flask having a high-speed stirrer KUREA MIX (manufactured by M. Technique Co.), 700 parts by weight of ion-exchanged water and 800 parts by weight of an aqueous 0.1 mol/liter $Na_3PO_4$ solution were introduced, the number of revolutions of the high-speed stirrer was set to 15,000 rpm, and the mixture was heated to 65° C. Then, 70 parts by weight of an aqueous 0.1 mol/liter $CaCl_2$ solution was added thereto to prepare an aqueous dispersion medium containing fine-particle slightly water-soluble dispersant $Ca_3(PO_4)_2$. Dilute hydrochloric acid was further so added that the pH of the aqueous dispersion medium was adjusted to 5.6.

| | (by weight) |
|---|---|
| Styrene | 78 parts |
| 2-Ethylhexyl acrylate | 22 parts |
| Divinylbenzene | 0.15 part |
| Carbon black (particle diameter: 55 nm) | 7 parts |
| Polycarbonate resin (peak molecular weight: 7,000) | 5 parts |
| Charge control agent (azo type iron complex) | 2 parts |

-continued

| | (by weight) |
|---|---|
| Oxycarboxylic acid (1-A) | 1 part |
| Ester wax (melting point: 65° C.) | 5 parts |

As a disperse phase, a mixture comprised of the above materials was dispersed for 3 hours by means of an attritor (manufactured by Mitsui Mining & Smelting Co., Ltd.), followed by addition of 5 parts by weight of a polymerization initiator 2,2'-azobis(2,4-dimethylvaleronitrile) to prepare a polymerizable monomer composition.

Next, the polymerizable monomer composition was introduced into the above aqueous dispersion medium to granulate the polymerizable monomer composition with stirring for 15 minutes in an atmosphere of $N_2$ with internal temperature of 60° C. and while maintaining the number of revolutions of the high-speed stirrer at 15,000 rpm. Thereafter, the stirrer was replaced with a stirrer having paddle stirring blades, and the same temperature was maintained while stirring the system at 50 rpm. At the time the polymerization conversion of the polymerizable vinyl monomer reached 95%, the first reaction step was finished. To the reaction mixture formed, an aqueous 0.1 mol/liter sodium hydroxide solution was added to change the pH of the aqueous dispersion medium to 9. The reaction temperature was further raised to 80° C., and the second reaction step was finished at the time the polymerization conversion reached substantially 100%. Thus the polymerization step was completed.

After the polymerization was completed, residual monomers were evaporated off under reduced pressure with heating, and then, after cooling, dilute hydrochloric acid was added thereto to dissolve the slightly water-soluble dispersion stabilizer. Washing with water was further repeated several times, followed by drying by means of a conical ribbon dryer (manufactured by Ohkawara Seisakusho K.K.), thus polymer particles P were obtained.

100 parts by weight of the polymer particles P and 2 parts by weight of a hydrophobic oil-treated fine silica powder (BET specific surface area: 200 $m^2/g$) were dry-process mixed by means of a Henschel mixer (manufactured by Mitsui Mining & Smelting Co., Ltd.) to obtain Toner P of the present invention.

The weight A of oxycarboxylic acid extracted with methanol from 1 g of Toner P was 1.60 mg, and the weight B of oxycarboxylic acid extracted with 0.1 mol/liter of an aqueous sodium hydroxide solution therefrom was 0.96 mg. The value of A/B was 1.67. The value of (3/4)B+1 was 1.72.

The circle-corresponding number-average particle diameter of the toner was 5.5 $\mu$m. In its circularity frequency distribution, the average circularity was 0.985, and the circularity standard deviation was 0.033. Also, in its molecular weight distribution as measured by GPC, the peak molecular weight was 13,000 and Mw/Mn was 14.

Cross-sectional observation of the state of dispersion of the wax component by TEM was made to ascertain that, as shown diagrammatically in FIG. 1C, it stood dispersed in the binder resin in substantially a spherical form.

Toner Production Examples 2 to 5 & Comparative Toner Production Examples 1 and 2

Polymer particles Q to T and comparative polymer particles e and f were obtained and thereafter Toners Q to T of the present invention and Comparative Toners e and f were produced in the same manner as in Production Example 1 except that the types and amounts of the oxycarboxylic acid and wax component added were changed and also the pH of the aqueous dispersion medium in the first reaction step, the polymerization conversion at the time the first reaction step was finished (polymerization conversion at a change of reaction steps) and the pH of the aqueous dispersion medium in the second reaction step were changed.

The types and amounts of the oxycarboxylic acid and wax component, the pH of the aqueous dispersion mediums in the first and second reaction steps and the polymerization conversion at a change of reaction steps in the respective Production Examples and Comparative Production Examples are shown in Table 7. Properties of Toners Q to T and Comparative Toners e and f were as shown in Table 8.

Photosensitive Drum

Production Example 1

An aluminum cylinder of 30 mm diameter and 254 mm long was used as a substrate, and layers with configuration as shown below were successively formed thereon by dip coating. Thus, Photosensitive Drum 1 was produced.

(1) Conductive coating layer: Composed chiefly of powders of tin oxide and titanium oxide dispersed in phenol resin. Layer thickness: 15 μm.

(2) Subbing layer: Composed chiefly of a modified nylon and a copolymer nylon. Layer thickness: 0.6 μm.

(3) Charge generation layer: Composed chiefly of an azo pigment having absorption in a long wavelength range, dispersed in butyral resin. Layer thickness: 0.6 μm.

(4) Charge transport layer: Composed chiefly of a hole-transporting triphenylamine compound dissolved in polycarbonate resin (molecular weight: 20,000 as measured by Ostwald viscometry) in a weight ratio of 8:10, and in which polytetrafluoroethylene powder (average particle diameter: 0.2 μm) was further added in an amount of 10% by weight based on the total solid content and was uniformly dispersed. Layer thickness: 25 μm.

The contact angle to water of the surface of Photosensitive Drum 1 thus obtained was 95 degrees.

The contact angle was measured using pure water and using a contact angle meter Model CA-DS (manufactured by Kyowa Kaimen Kagaku K.K.)

Photosensitive Drum

Production Example 2

Photosensitive Drum 2 was produced in the same manner as in Photosensitive Drum Production Example 1 except that the charge transport layer with a layer thickness of 25 μm was formed without addition of the polytetrafluoroethylene powder. The contact angle to water of the surface of Photosensitive Drum 2 thus obtained was 79 degrees.

Example 16

As an image-forming apparatus, a 600-dpi laser printer LBP-8 Mark IV (manufactured by CANON INC.) was prepared for testing. This apparatus was remodeled, and images were printed at a process speed of 80 mm/sec (speed of toner-carrying member: variable), 12 sheets per minute in terms of LTR (letter) size paper. As shown in FIG. 8, this apparatus has the following process: The surface of the photosensitive member 56 (30 mm diameter) is uniformly charged using the charging roller 51 to which DC and AC components have been applied. Here, the DC component is controlled to a constant voltage and the AC component is controlled to a constant current. Subsequently to the charging, images areas are exposed to laser light 60 to form an electrostatic latent image, which is then made into a visible image by the use of the toner 50 to form a toner image, and thereafter the toner image is transferred to the transfer medium 58 by means of the transfer roller 57 to which a voltage has been applied.

Next, the developing assembly 52 of the process cartridge was also remodeled in the following way: In place of the toner-feeding member aluminum sleeve internally provided with a magnet, a medium-resistance rubber roller (diameter: 16 mm) formed of silicone rubber whose resistance had been controlled by dispersing carbon black was used as the toner-carrying member 54 and was brought into contact with the photosensitive member 56. The toner-carrying member 54 was so driven that the movement of its surface was in the same direction as that of the surface of the photosensitive member 56 at the contact part with each other and its rotational peripheral speed was 150% with respect to the rotational peripheral speed of the photosensitive member; i.e., the toner-carrying member was rotated at a peripheral speed of 120 mm/sec, and at a relative peripheral speed of 80 mm/sec with respect to the surface of the photosensitive member.

As a means for applying the toner on the toner-carrying member, the toner-coating roller 55 was provided inside the developer container and was brought into contact with the toner-carrying member. The toner-coating roller 55 was so rotated that the movement direction of its surface was opposite to the movement direction of the surface of the toner-carrying member at the contact part, and thus the toner was applied on the toner-carrying member. Also, for the purpose of coat layer control of the toner on the toner-carrying member, a resin-coated blade 53 made of stainless steel was attached. As the cleaning member 59, a blade made of urethane rubber was used.

Photosensitive Drum 1 was used as the photosensitive member and Toner P was used as the toner. Process conditions were so set as to provide the following development conditions.

Photosensitive member dark-area potential: −700 V
Photosensitive member light-area potential: −150 V
Development bias: −450 V (DC component only)

A 5,000 sheet continuous printing test was made in the normal-temperature/normal-humidity environment while replenishing the toner. As a result, good results were obtained on all of image density, prevention of black spots around line images, prevention of image blank areas, prevention of image fog, and dot reproducibility. Also, any faulty cleaning did not occur, and the image quality equal to that of initial stage was attained. The surfaces of the developing roller, photosensitive member and fixing assembly were examined. As a result, no melt-adhesion of toner was seen, and it was unnecessary to replace them with new ones.

Evaluation was made in the following way. Evaluation in Examples 17 to 22 and Comparative Examples 5 to 7 given later was also made in the same way.

Evaluation (1) Image density:

A square solid black image of 5 mm in one side was printed on usual plain paper (75 g/m$^2$) for copying machines. Relative density with respect to an image printed on a white ground area with a density of 0.00 of an original was measured with MACBETH REFLECTION DENSITOMETER RD918 (trade name; manufactured by Macbeth Co.).

A: 1.40 or more.
B: From 1.30 to less than 1.40.
C: From 1.00 to less than 1.30.
D: Less than 1.00.

(2) Spots around line images:

This is evaluation on spots around fine line images, concerning image quality of graphical images. Evaluation was visually made by examining the reproducibility of line images and any spots of toner around line images formed when one-dot line images, which are liable to cause spots around line images more than character images, were printed on plane paper (75 g/m$^2$).

A: Spots around line images little occur, showing a good line reproducibility.
B: Slight black spots around line images are seen.
C: Spots around line images are slightly seen, but has no serious effect on line reproducibility.
D: Conspicuous spots around line images are seen, showing a poor line reproducibility.

(3) Transfer performance:

A character pattern as shown in FIG. 5A was printed on a card board (128 g/m$^2$), where any blank areas in characters (the state shown in FIG. 5B) was examined to make an evaluation visually.

A: Blank areas little occur.
B: Slight blank areas are seen.
C: Blank areas are a little seen.
D: Conspicuous blank areas are seen.

(4) Image fog:

Transfer residual toner on the photosensitive member at the time of the formation of a solid white image was stripped off by taping with a Mylar tape, and this was stuck to paper, where its reflection density was measured with MACBETH REFLECTION DENSITOMETER RD918 (trade name; manufactured by Macbeth Co.). From the reflection density thus measured, the reflection density measured when the Mylar tape itself was stuck to paper was subtracted. The numerical value obtained was used to make an evaluation. The smaller the numerical value is, the better the image fog is restrained.

A: Less than 0.03%.
B: From 0.03% to less than 0.07%.
C: From 0.07% to less than 0.15%.
D: More than 0.15%.

Figure 15:
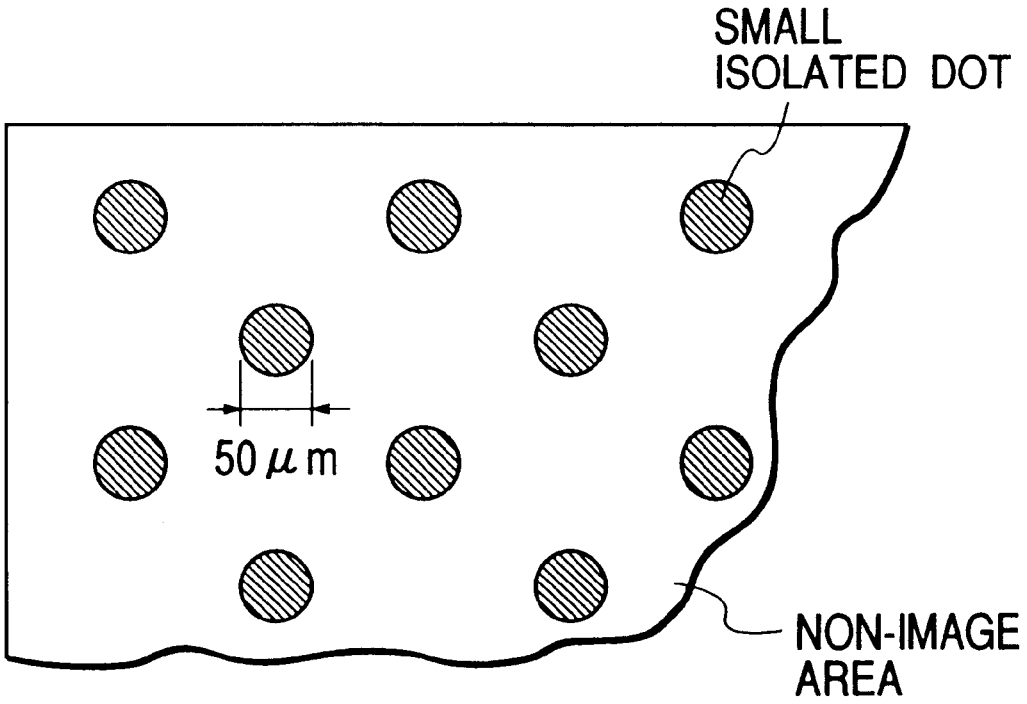
FIG. 15 illustrates an isolated dot pattern used to evaluate resolution.

(5) Dot reproducibility:

Images in a pattern of isolated dots with a small diameter (50 $\mu$m each) as shown in FIG. 15, which tend to form closed electric fields on account of latent image electric fields and are difficult to reproduce, were printed and the reproducibility of the dots was evaluated.

A: Missing dots are 2 or less per 100 dots.
B: Missing dots are 3 to 5 per 100 dots.
C: Missing dots are 6 to 10 per 100 dots.
D: Missing dots are 11 or more per 100 dots.

(6) Matching to developing roller:

After the printing test was finished, evaluation was visually made by examining the state of the sticking of residual toner to the developing roller surface and the effect thereof on printed images.

A: No sticking occurs.
B: Contamination a little occurs, but sticking little occurs.
C: Sticking occurs, but has no serious effect on images.
D: Sticking greatly occurs, and uneven images occur.

(7) Matching to photosensitive drum:

After the printing test was finished, evaluation was visually made by examining the state of the scratches on the photosensitive drum surface and the sticking of the toner remaining thereon, and the effect thereof on printed images.

A: No sticking occurs.
B: Scratches have occurred on the surface, but sticking little occurs.
C: Sticking is seen, but has no serious effect on images.
D: Sticking is greatly seen, and faulty images occur as vertical lines.

(8) Matching to fixing assembly:

After the printing test was finished, evaluation was visually made by examining the state of the scratches on the fixing roller surface and the sticking of the toner remaining thereon, and the effect thereof on printed images.

A: No sticking occurs.
B: Scratches have occurred on the surface, but sticking little occurs.
C: Sticking is seen, but has no serious effect on images.
D: Sticking is greatly seen, and faulty images occur.

The results of evaluation are shown in Table 9.

Example 17

The procedure of Example 16 was repeated except the following.

The toner-carrying member was so driven that the movement of its surface was in the same direction as that of the surface of the photosensitive member at the contact part with each other and its rotational peripheral speed was 200% with respect to that of the photosensitive member. The toner-carrying member was rotated at a peripheral speed of 160 mm/sec, and at a relative peripheral speed of 80 mm/sec with respect to the surface of the photosensitive member.

Process conditions were so set as to fulfill the following development conditions.

Development bias: −500 V (DC component only)

A 5,000-sheet continuous printing test was made while replenishing the toner. As a result, though slightly inferior to Example 16 because of severer conditions due to a higher process speed, good results were obtained on the whole. Any faulty cleaning also did not occur, and the image quality equal to that of initial stage was attained. The surfaces of the developing roller, photosensitive drum and fixing assembly were examined, but no melt-adhesion of toner was seen, and it was unnecessary to replace them with new ones.

The evaluation results are shown in Table 9.

Example 18

Evaluation was made in the same manner as in Example 16 except for using Photosensitive Drum 1 as the photosensitive member. As a result, though slightly inferior to Example 16 because of severer conditions due to a lower releasability of the surface of the photosensitive drum, good results were obtained on the whole.

The evaluation results are shown in Table 9.

Examples 19 to 22

Evaluation was made in the same manner as in Example 16 except that Toners Q to T were used, respectively, as the toner. As the result, as shown in Table 9, good results were obtained on the whole.

Comparative Example 5

Printing tests were made in the same manner as in Example 16 except that Comparative Toner e and Photosensitive Drum 2 were used.

Process conditions were so set as to fulfill the following development conditions.

Development bias: −350 V (DC component only)

Faulty cleaning occurred on the 500th-sheet printing. The printing test was continued while cleaning the cleaning blade at every time the faulty cleaning occurred. As a result, on the 1,000th-sheet print, white spots caused by the melt-adhesion of toner to the photosensitive drum surface occurred partly on solid black images.

Accordingly, the photosensitive drum was replaced with new one. As a result, the white spots came not to appear, but the image density was not restored to the level at the initial stage. The 50-$\mu$m isolated dots were not satisfactorily reproduced and also spots around line images were conspicuous.

The results of evaluation are shown in Table 9.

Comparative Examples 6 and 7

Evaluation was made in the same manner as in Example 16 except that Photosensitive Drum 1 was used as the photosensitive member and Comparative Toner e or f was used as the toner.

The results of evaluation are shown in Table 9.

Example 23

Images were formed in the same manner as in Example 16 except that, in the image-forming apparatus used therein, the toner-coating roller 55 in the developing assembly 52 was replaced with a sponge roller constituted of a single layer and a bias voltage was applied to the toner-coating roller 55 through a bias applying means (not shown).

In this development, only a DC component of −300 V was applied as the development bias voltage to the developing roller 54, and only a DC component of −450 V was applied as the coating bias voltage to the toner-coating roller 55.

Evaluation was made in the same manner as in Example 16. As a result, the image density and the prevention of image fog were both stable and good, any faulty cleaning did not occur, and good image quality was attained. The matching to image-forming apparatus was also good.

Example 24

Images were formed by using Toner P in the developing assembly 117 of the image-forming apparatus shown in FIG. 13.

In the image-forming apparatus, as shown in FIG. 13, a cleaner having a cleaning member coming into contact with the photosensitive member surface as a first cleaning means for removing the toner remaining on the photosensitive member surface after primary transfer is provided between the primary-transfer zone and the charging zone where the photosensitive member is charged, and a cleaner having a cleaning member coming into contact with the intermediate transfer member surface as a second cleaning means for removing the toner remaining on the intermediate transfer member surface after secondary transfer is provided on the downstream side of the secondary-transfer zone and the upstream side of the primary-transfer zone.

As the developing assembly 117, a developing assembly constructed like the developing assembly 78 shown in FIG. 12 was used.

A medium-resistance rubber roller (diameter: 16 mm) formed of silicone rubber whose resistance had been controlled by dispersing carbon black was used as the toner-carrying member 79 and was brought into contact with the photosensitive member surface. The toner-carrying member 79 was so driven that the movement of its surface was in the same direction as that of the surface of the photosensitive member surface at the contact part with each other the latter and its rotational peripheral speed was 150% with respect to the rotational peripheral speed of the photosensitive member. Namely, the toner-carrying member was rotated at a peripheral speed of 120 mm/sec and at a relative peripheral speed of 80 mm/sec with respect to the surface of the photosensitive member.

As a means for applying the toner on the toner-carrying member, a sponge roller constituted of a single layer was provided as the toner-coating roller 82 and was brought into contact with the toner-carrying member. The toner-coating roller 82 was so rotated that the movement direction of its surface was opposite to the movement direction of the surface of the toner-carrying member at the contact part, and thus the toner was applied on the toner-carrying member. Also, for the purpose of coat layer control of the toner on the toner-carrying member, a resin-coated blade 86 made of stainless steel was attached.

Photosensitive Drum 1 was used as the photosensitive member and Toner P as the toner. Image-forming conditions were so set as to fulfill the following development and transfer conditions.

Photosensitive member dark-area potential: −700 V

Photosensitive member light-area potential: −150 V

Development bias applied to the developing roller: −450 V (DC component only)

Bias applied to the toner-coating roller: −300 V (DC component only)

Transfer bias applied to the intermediate transfer member in the primary transfer step: 300 V (DC component only)

Transfer bias applied to the transfer roller in the secondary transfer step: 1,000 V (DC component only)

Under the above image-forming conditions, toner images transferred to recording mediums were heat-fixed to the recording mediums by means of the following heat fixing assembly.

As the heat fixing assembly 130, a fixing assembly of a heat roll system having no oil-applying function was used. Here, the fixing assembly used had fluorine resin surface layers on both the upper roller and the lower roller, and the rollers each had a diameter of 60 mm. The fixing temperature was set at 150° C., and the nip width in 7 mm.

Using the image-forming apparatus constituted as described above, a 10,000 sheet continuous printing test was made in the normal-temperature/normal-humidity environment. As a result, high-quality images with high density and free of image stains were obtained.

The matching to image-forming apparatus was also good.

Toner Production Example 6

Into a 2-liter four-necked flask having a high-speed stirrer KUREA MIX (manufactured by M. Technique Co.), 700 parts by weight of ion-exchanged water and 800 parts by weight of an aqueous 0.1 mol/liter $Na_3PO_4$ solution were introduced, the number of revolutions of the high-speed stirrer was set to 15,000 rpm, and the mixture was heated to 65° C. Then, 70 parts by weight of an aqueous 0.1 mol/liter $CaCl_2$ solution was added thereto to prepare an aqueous dispersion medium containing fine-particle slightly water-soluble dispersant $Ca_3(PO_4)_2$. Dilute hydrochloric acid was further so added that the pH of the aqueous dispersion medium was adjusted to 5.6.

| | (by weight) |
|---|---|
| Styrene | 78 parts |
| 2-Ethylhexyl acrylate | 22 parts |
| Divinylbenzene | 0.15 part |
| Carbon black (particle diameter: 45 nm; oil absorption: 70 ml/100 g) | 7 parts |
| Unsaturated polycarbonate resin (condensation copolymer of epoxidized bisphenol A with fumaric acid; weight-average molecular weight: 6,500) | 5 parts |
| Charge control agent (azo complex) | 2 parts |
| Oxycarboxylic acid (1-A) | 0.5 part |
| Ester wax (number-average molecular weight: 700; Mw/Mn: 1.3) | 7 parts |

As a disperse phase, a mixture comprised of the above materials was dispersed for 3 hours by means of an attritor (manufactured by Mitsui Mining & Smelting Co., Ltd.), followed by addition of 3 parts by weight of a polymerization initiator 2,2'-azobis(2,4-dimethylvaleronitrile) to prepare a polymerizable monomer composition.

Next, the polymerizable monomer composition was introduced into the above aqueous dispersion medium to granulate the polymerizable monomer composition with stirring for 15 minutes in an atmosphere of $N_2$ at an internal temperature of 65° C. and while maintaining the number of revolutions of the high-speed stirrer at 15,000 rpm. Thereafter, the stirrer was replaced with a stirrer having paddle stirring blades, and the same temperature was maintained while stirring the system at 50 rpm. At the time the polymerization conversion of the polymerizable vinyl monomer reached 95%, the first reaction step was finished. To the reaction mixture formed, an aqueous 0.1 mol/liter sodium hydroxide solution was added to change the pH of the aqueous dispersion medium to 10. The reaction temperature was further raised to 85° C., and the second reaction step was finished at the time the polymerization conversion reached substantially 100%. Thus the polymerization step was completed.

After the polymerization was completed, residual monomers were evaporated off under reduced pressure with heating, and then, after cooling, dilute hydrochloric acid was added thereto to dissolve the slightly water-soluble dispersion stabilizer. Washing with water was further repeated several times, followed by drying by means of a conical ribbon dryer (manufactured by Ohkawara Seisakusho K.K.), thus polymer particles U were obtained.

100 parts by weight of the polymer particles U and 2 parts by weight of a hydrophobic oil-treated fine silica powder (BET specific surface area: 200 $m^2/g$) were dry-process mixed by means of a Henschel mixer (manufactured by Mitsui Mining & Smelting Co., Ltd.) to obtain Toner U of the present invention.

The weight A of oxycarboxylic acid extracted with methanol from 1 g of Toner U was 1.66 mg, and the weight B of oxycarboxylic acid extracted with 0.1 mol/liter of an aqueous sodium hydroxide solution therefrom was 1.07 mg. The value of A/B was 1.55. The value of (3/4)B+1 was 1.80.

The circle-corresponding number-average particle diameter of the toner was 5.4 $\mu$m. In its circularity frequency distribution, the average circularity was 0.987, and the circularity standard deviation was 0.028. Also, in its molecular weight distribution as measured by GPC, the peak molecular weight was 13,000 and Mw/Mn was 14.

The total residue of polymerizable monomers in Toner U was 45 ppm (styrene monomer: 45 ppm; 2-ethylhexyl acrylate monomer and divinyl benzene monomer: 0 ppm). Cross-sectional observation of the state of the dispersion of the wax component by TEM was further made to ascertain that, as shown diagrammatically in FIG. 1A, it stood dispersed in the binder resin in substantially a spherical form.

Toner Production Examples 7 to 10 & Comparative Toner Production Examples 3 and 4

Polymer particles V to Y and comparative polymer particles g and h were obtained and thereafter Toners V to Y of the present invention and Comparative Toners g and h were produced in the same manner as in Production Example 6 except that the types and amounts of the oxycarboxylic acid and wax component added were changed and also the pH of the aqueous dispersion medium in the first reaction step, the polymerization conversion at the time the first reaction step was finished (polymerization conversion at a change of reaction steps) and the pH of the aqueous dispersion medium in the second reaction step were changed.

The types and amounts of the oxycarboxylic acid and wax component, the pH of the aqueous dispersion mediums in the first and second reaction steps and the polymerization conversion at a change of reaction steps in the respective Production Examples and Comparative Production Examples are shown in Table 10. Properties of Toners V to Y and Comparative Toners g and h were as shown in Table 11.

Example 25

As the image-forming apparatus shown in FIG. 10, a 600 dpi laser printer LBP-860 (trade name; manufactured by CANON INC.) was prepared for testing. Its process speed was changed to 94 mm/sec.

From the process cartridge, the cleaning rubber blade was detached. The charging system of the apparatus was changed to the contact charging system in which a rubber roller is brought into contact, and a voltage of a DC component (−1,400 V) was applied. The process speed was changed to 94 mm/sec, correspondingly to the process speed made higher, conditions were severer on uniform charging of the photosensitive member.

Photosensitive Drum 1 was used as the photosensitive member.

Next, the developing part of the process cartridge was remodeled. A medium-resistance rubber roller (diameter: 16 mm; hardness: ASKER C 45 degrees; resistance: $10^5$ Ω·cm) formed out of foamed urethane was used in place of the toner-carrying member stainless steel sleeve, and was brought into contact with the photosensitive member. The toner-carrying member was so driven that the movement of its surface was in the same direction as that of the surface of the photosensitive member at the contact part with each other and its rotational peripheral speed was 130% with respect to the rotational peripheral speed of the photosensitive member.

As a means for applying the toner on the toner-carrying member, a toner-coating roller was provided in contact with the toner-carrying member in the developing part. Also, for the purpose of coat layer control of the toner on the toner-carrying member, a resin-coated blade made of stainless steel was attached. The development bias applied to the toner-carrying member at the time of development was changed to a DC component (−450 V) only.

The image-forming apparatus was so remodeled and process conditions were so set as to fit such remodeling of the process cartridge.

With regard to the charge potential of the photosensitive member, its dark-area potential was set at −800 V, and light-area potential at −150 V. Paper of 75 g/m$^2$ in basis weight was used as transfer mediums.

Using Toner U, character images with a printed area percentage of 4% were successively printed on 100 sheets at the initial stage in the normal-temperature/normal-humidity environment, and thereafter, images were evaluated and any image stains due to faulty charging were examined. As a result, good results were obtained on all of image density, prevention of image stains, transfer performance, prevention of fog, and dot reproducibility. The quantity (mg) of toner adhering to the charging roller per unit surface area (cm$^2$) was also measured to find that it was as very small as 0.01 mg/m$^2$. After the evaluation at the initial 100-sheet printing was completed, images were further successively printed up to 3,000 sheets, and images were again evaluated, whereupon the same image quality as that of initial stage was attained. Also, the photosensitive member and the developing roller were both observed, where any melt-adhesion of toner did not occur, and it was unnecessary to replace them with new ones. There was also no problem on fixing performance.

Evaluation was made in the following way. Evaluation in Examples 26 to 30 and Comparative Examples 8 and 9 given later was also made in the same way.

Evaluation (1) Image density:

A square solid black image of 5 mm in one side was printed on usual plain paper (75 g/m$^2$) for copying machines. Relative density with respect to an image printed on a white ground area with a density of 0.00 of an original was measured with MACBETH REFLECTION DENSITOMETER RD918 (trade name; manufactured by Macbeth Co.).

A: 1.40 or more.
B: From 1.30 to less than 1.40.
C: From 1.00 to less than 1.30.
D: Less than 1.00.

(2) Image stains:

A halftone image constituted of one-dot lines and one-dot spaces was printed on plane paper (75 g/m$^2$), where evaluation was visually made by examining occurrence of any image stains when printed.

A: No stain occurs.
B: Stains are slightly seen.
C: Stains in fine black spots are seen.
D: Periodical belt-like stains or vertical-line stains are seen.

(3) Transfer performance:

Transfer residual toner on the photosensitive member at the time of the formation of a solid black image was stripped off by taping with a Mylar tape, and this was stuck to paper, where its reflection density was measured with MACBETH REFLECTION DENSITOMETER RD918 (trade name; manufactured by Macbeth Co.). From the reflection density thus measured, the reflection density measured when the Mylar tape itself was stuck to paper was subtracted. The numerical value obtained was used to make an evaluation. The smaller the numerical value is, the better the transfer performance is.

A: Less than 0.03%.
B: From 0.03% to less than 0.07%.
C: From 0.07% to less than 0.10%.
D: More than 0.10%.

(4) Image fog:

Transfer residual toner on the photosensitive member at the time of the formation of a solid white image was taken off by taping with a Mylar tape, and this was stuck to paper, where its reflection density was measured with MACBETH REFLECTION DENSITOMETER RD918 (trade name; manufactured by Macbeth Co.). From the reflection density thus measured, the reflection density measured when the Mylar tape itself was stuck to paper was subtracted. The numerical value obtained was used to make an evaluation. The smaller the numerical value is, the better the image fog is restrained.

A: Less than 0.03%.
B: From 0.03% to less than 0.07%.
C: From 0.07% to less than 0.15%.
D: More than 0.15%.

(5) Dot reproducibility:

Images of a pattern of isolated dots with a small diameter (50 $\mu$m each) as shown in FIG. 15, which tend to form closed electric fields on account of latent image electric fields and are difficult to reproduce, were printed and the reproducibility of the dots was evaluated.

A: Missing dots are 2 or less per 100 dots.
B: Missing dots are 3 to 5 per 100 dots.
C: Missing dots are 6 to 10 per 100 dots.
D: Missing dots are 11 or more per 100 dots.

(6) Charging roller contamination:

The weight of toner per unit area having adhered to the charging roller per unit surface area was measured. The less the weight of the toner adhesion is, the better.

A: Less than 0.20 mg/cm$^2$.
B: From 0.20 mg/cm$^2$ to less than 0.35 mg/cm$^2$.
C: From 0.35 mg/cm$^2$ to less than 0.55 mg/cm$^2$.
D: More than 0.55 mg/cm$^2$.

(7) Matching to developing roller:

After the printing test was finished, evaluation was visually made by examining the state of the sticking of residual toner to the developing roller surface and the effect thereof on printed images.

A: No sticking occurs.
B: Contamination a little occurs, but sticking little occurs.
C: Sticking occurs, but has no serious effect on images.
D: Sticking greatly occurs, and uneven images occur.

(8) Matching to photosensitive drum:

After the printing test was finished, evaluation was visually made by examining the state of the scratches on the photosensitive drum surface and the sticking of the toner remaining thereon, and the effect thereof on printed images.

A: No sticking occurs.
B: Scratches have occurred on the surface, but sticking little occurs.
C: Sticking is seen, but has no serious effect on images.
D: Sticking is greatly seen, and faulty images occur as vertical lines.

(9) Matching to fixing assembly:

After the printing test was finished, evaluation was visually made by examining any scratches on the fixing roller surface and any sticking of the toner remaining thereon, and how they affected printed images.

A: No sticking occurs.
B: Scratches have occurred on the surface, but sticking little occurs.
C: Sticking is seen, but less affects images.
D: Sticking is greatly seen, and faulty images occur.

The results of evaluation are shown in Table 12 [Table 12(A)–(B)].

Example 26

Evaluation was made in the same manner as in Example 25 except that the process speed was made higher to 120 mm/s. As the result, as shown in Table 12, though slightly inferior to Example 25 because of severer conditions due to a higher process speed, good results were obtained on the whole.

Examples 27 to 30

Evaluation was made in the same manner as in Example 25 except that Toners V to Y were used, respectively, as the toner.

The results of evaluation are shown in Table 12.

Comparative Example 8

Evaluation was made in the same manner as in Example 25 except that Comparative Toner g was used as the toner. As the result, as shown in Table 12, serious image stains occurred from the beginning. Accordingly, the evaluation test was inevitably stopped halfway because it was difficult to continue the 3,000-sheet printing.

Comparative Example 9

Evaluation was made in the same manner as in Example 25 except that Comparative Toner h was used as the toner.

The results of evaluation are shown in Table 12.

Example 31

Images were formed in the same manner as in Example 25 except that, in the image-forming apparatus used therein, the toner-coating roller 55 in the developing assembly 52 was replaced with a sponge roller constituted of a single layer and a bias voltage was applied to the toner-coating roller 55 through a bias applying means (not shown).

In this development, only a DC component of −300 V was applied as the development bias voltage to the developing roller 54, and only a DC component of −480 V was applied as the coating bias voltage to the toner-coating roller 55.

Evaluation was made in the same manner as in Example 16. As a result, the image density and the prevention of image fog were both stable and good, the cleaning-at-development was also achieved, and good image quality was attained. The matching to image-forming apparatus was also good.

Example 32

Images were formed by using Toner V in the developing assembly 117 of the image-forming apparatus shown in FIG. 14.

In the image-forming apparatus, as shown in FIG. 14, any cleaner having a first cleaning member for removing the toner present on the photosensitive member surface after the transfer step is not provided between the primary-transfer zone and the developing zone, and a cleaner having a cleaning member coming into contact with the intermediate transfer member surface as a cleaning means for removing the toner remaining on the intermediate transfer member surface after secondary transfer is provided on the downstream side of the secondary-transfer zone and the upstream side of the primary-transfer zone.

As the developing assembly 117, a developing assembly constructed like the developing assembly 78 shown in FIG. 12 was used. It was so constructed that at the charging zone a charging bias was applied to the toner remaining on the photosensitive drum surface to adjust its charging polarity to negative polarity and thereafter only the toner present in non-image areas at the developing zone was collected into the developing assembly at the time of development.

A medium-resistance rubber roller (diameter: 16 mm) formed out of silicone rubber whose resistance had been controlled by dispersing carbon black was used as the toner-carrying member 79 and was brought into contact with the photosensitive member surface. The toner-carrying member 79 was so driven that the movement of its surface was in the same direction as that of the surface of the photosensitive member surface at the contact part with each other and its rotational peripheral speed was 150% with respect to the rotational peripheral speed of the photosensitive member. Namely, the toner-carrying member was rotated at a peripheral speed of 120 mm/sec and at a relative peripheral speed of 80 mm/sec with respect to the surface of the photosensitive member.

As a means for applying the toner on the toner-carrying member, a sponge roller constituted of a single layer was provided as the toner-coating roller 82 and was brought into contact with the toner-carrying member. The toner-coating roller 82 was so rotated that the movement direction of its surface was opposite to the movement direction of the surface of the toner-carrying member at the contact part, and thus the toner was applied on the toner-carrying member. Also, for the purpose of coat layer control of the toner on the toner-carrying member, a resin-coated blade 86 made of stainless steel was attached.

Photosensitive Drum 1 was used as the photosensitive member and Toner V as the toner. Image-forming conditions were so set as to fulfill the following development and transfer conditions.

Photosensitive member dark-area potential: −700 V

Photosensitive member light-area potential: −150 V

Development bias applied to the developing roller: −450 V (DC component only)

Bias applied to the toner-coating roller: −300 V (DC component only)

Transfer bias applied to the intermediate transfer member in the primary transfer step: 350 V (DC component only)

Transfer bias applied to the transfer roller in the secondary transfer step: 1,000 V (DC component only)

Under the above image-forming conditions, toner images transferred to recording mediums were heat-fixed to the recording mediums by means of the following heat fixing assembly.

As the heat fixing assembly 130, a fixing assembly of a heat roll system having no oil-applying function was used. Here, the fixing assembly used had fluorine resin surface layers on both the upper roller and the lower roller, and the rollers each had a diameter of 60 mm. The fixing temperature was set at 150° C., and the nip width was 7 mm.

Using the image-forming apparatus constituted as described above, a successive 2,000-sheet printing test was made in the normal-temperature/normal-humidity environment. As a result, high-quality images with high density and free of image stains were obtained.

The weight of toner adhering to the charging roller surface was as small as 0.41 mg/cm$^2$. Besides, the matching to image-forming apparatus was also good.

Example 33

Toner U was blended with a carrier to produce a two-component type developer. This two-component type developer was used in the image-forming apparatus shown in FIGS. 16 and 17, and images were successively formed on 3,000 sheets at a process speed of 180 mm/sec in the normal-temperature/normal-humidity environment. As a result, high-quality images with high density and free of image stains were obtained. There was also no problem at all on fixing performance.

As the carrier of the above two-component type developer, a ferrite carrier having an average particle diameter of 60 μm was used the particle surfaces of which were coated with a silicone resin, and the toner concentration was set to be 7%.

The results of evaluation are shown in Table 13 [Table 13(A)–(B)].

Example 34

Evaluation was made in the same manner as in Example 33 except that Photosensitive Drum 2 produced in Photosensitive Member Production Example 2 was used as the photosensitive member. As shown in Table 13, though slightly inferior to Example 33, good results were obtained on the whole.

Examples 35 to 38

Evaluation was made in the same manner as in Example 33 except that Toners V to Y, respectively, were used. As shown in Table 13, good results were obtained on the whole.

Comparative Examples 10 and 11

Evaluation was made in the same manner as in Example 33 except that Comparative Toners g and h, respectively, were used. As shown in Table 13, the charging member was severely contaminated with the toner to provide seriously poor images due to faulty charging.

TABLE 1

| | Toner | Oxycarboxylic acid Type | Oxycarboxylic acid Amount (pbw) | First reaction step pH | Polymerization conversion at a change of reaction steps (%) | Second reaction step pH | Wax component Type | Wax component Amount (pbw) | Cleanability |
|---|---|---|---|---|---|---|---|---|---|
| Example: | | | | | | | | | |
| 1 | A | 1-A | 0.5 | 5.2 | 90 | 10 | Ester wax (m.p.: 60° C.) | 7 | A |
| 2 | B | 2-A | 0.5 | 4.7 | 35 | 12 | Paraffin wax (m.p.: 65° C.) | 7 | A |
| 3 | C | 1-G | 0.3 | 5.8 | 80 | 13 | Paraffin wax (m.p.: 65° C.) | 10 | A |
| 4 | D | 1-F | 0.1 | 6.4 | 15 | 12 | Paraffin wax (m.p.: 65° C.) | 15 | B |
| 5 | E | 1-J | 0.7 | 8.0 | 80 | 9 | Polyethylene wax (m.p.: 125° C.) | 5 | B |
| Comparative Example: | | | | | | | | | |
| 1 | a | 1–A | 0.04 | 4.3 | 65 | 8 | Polyethylene wax (m.p.: 125° C.) | 5 | C |
| 2 | b | 1–A | 0.5 | 7.1 | 5 | 9 | Paraffin wax (m.p.: 65° C.) | 7 | C |

TABLE 2

(* by number)

| | Toner | Oxycarboxylic acid A (mg) | Oxycarboxylic acid B (mg) | Oxycarboxylic acid A/B | Oxycarboxylic acid (¾)B + 1 | Circle=corresponding number=average particle diameter (μm) | Average circularity | Circularity standard deviation | Toner with circularity less than 0.950 (%)* | State of dispersion of wax component (r/R)st | Polymerizable monomer total residue (ppm) |
|---|---|---|---|---|---|---|---|---|---|---|---|
| Example: | | | | | | | | | | | |
| 1 | A | 1.57 | 1.15 | 1.37 | 1.86 | 5.4 | 0.988 | 0.031 | 1.9 | 0.44 | 60 |
| 2 | B | 2.61 | 1.35 | 1.93 | 2.01 | 5.1 | 0.983 | 0.033 | 10 | 0.35 | 70 |
| 3 | C | 1.22 | 0.48 | 2.54 | 1.36 | 4.9 | 0.990 | 0.034 | 0.9 | 0.78 | 140 |
| 4 | D | 0.38 | 0.16 | 2.38 | 1.12 | 4.8 | 0.981 | 0.036 | 16 | 0.91 | 110 |
| 5 | E | 3.63 | 3.38 | 1.07 | 3.54 | 3.4 | 0.926 | 0.037 | 23 | 0.07 | 220 |
| Comparative Example: | | | | | | | | | | | |
| 1 | a | 0.13 | 0.04 | 3.25 | 1.03 | 5.0 | 0.984 | 0.036 | 17 | 0.03 | 210 |
| 2 | b | 3.86 | 3.77 | 1.02 | 3.83 | 4.4 | 0.918 | 0.043 | 38 | 0.16 | 260 |

TABLE 3(A)

| | | Charging performance of toner | | | Evaluation of printed images | | | | | |
|---|---|---|---|---|---|---|---|---|---|---|
| | | Quantity of triboelectricity | | Charging rate | N/N | | | H/H | | |
| | Toner | N/N | H/H | decrease | Image density | Spots around line images | Blank areas | Image density | Spots around line images | Blank areas |
| Example: | | | | | | | | | | |
| 1 | A | A | A | A | A | A | A | A | A | A |
| 2 | B | A | B | B | A | A | A | A | B | A |
| 3 | C | B | A | A | A | A | A | B | A | A |
| 4 | D | c | c | B | B | B | B | B | C | B |
| 5 | E | C | C | C | B | C | C | C | C | C |
| Comparative Example: | | | | | | | | | | |
| 1 | a | C | D | D | C | D | C | D | D | C |
| 2 | b | D | D | D | C | C | C | D | D | D |

TABLE 3(B)

| | | Evaluation of matching to image-forming apparatus | | | | | |
|---|---|---|---|---|---|---|---|
| | | N/N | | | H/H | | |
| | Toner | Toner= carrying member | Toner regulation blade | Toner coating roller | Toner= carrying member | Toner regulation blade | Toner coating roller |
| Example: | | | | | | | |
| 1 | A | A | A | A | A | A | A |
| 2 | B | A | A | A | A | B | A |
| 3 | C | A | A | A | A | B | A |
| 4 | D | B | B | B | B | C | B |
| 5 | E | B | C | C | C | C | C |
| Comparative Example: | | | | | | | |
| 1 | a | C | C | C | D | C | C |
| 2 | b | C | D | D | D | D | D |

TABLE 4

| | | Oxycarboxylic acid | | Wax component | Polar resin | Polymerization | Distillation step | | |
|---|---|---|---|---|---|---|---|---|---|
| | Toner | Type | Amount (pbw) | Amount (pbw) | Amount (pbw) | reaction pH | pH | Water = soluble initiator *pbw | Cleanability |
| Example: | | | | | | | | | |
| 6 | F | 1-A | 0.5 | 15 | 5 | 5.3 | 11 | KPS (1)* | A |
| 7 | G | 2-A | 0.5 | 15 | 5 | 5.3 | 11 | KPS (1)* | A |
| 8 | H | 1-B | 2.3 | 16 | 5 | 5.3 | 11 | none | A |
| 9 | I | 2-C | 0.6 | 17 | 6 | 5.1 | 10 | none | A |
| 10 | J | 1-D | 0.5 | 25 | 10 | 6.0 | 10 | none | B |
| 11 | K | 1-E | 1.2 | 10 | 6 | 6.5 | 10 | none | B |
| 12 | L | 1-F | 5.1 | 15 | 10 | 7.0 | 11 | none | B |
| 13 | M | 1-G | 4.1 | 6 | 6 | 8.0 | 11 | none | B |
| 14 | N | 1-H | 2.5 | 1 | 8 | 8.0 | 11 | none | B |
| 15 | O | 1-I | 1.0 | 15 | 1 | 8.0 | 11 | none | B |
| Comparative Example: | | | | | | | | | |
| 3 | c | 1-A | 4.1 | 15 | 0.5 | 5.3 | 5.3 | none | C |
| 4 | d | 1-A | 0.8 | 15 | 30 | 9.5 | 11 | none | C |

TABLE 5

(* by number)

| Toner | Oxycarboxylic acid A (mg) | B (mg) | A/B | (¾)B + 1 | Circle=corresponding number=average particle diameter (μm) | Average circularity | Circularity standard deviation | Toner with circularity less than 0.950 (%)* | Tg (° C.) | State of dispersion of wax component (r/R)st | Toner particle surface thin layer formed |
|---|---|---|---|---|---|---|---|---|---|---|---|
| Example: | | | | | | | | | | | |
| 6 F | 1.22 | 1.01 | 1.21 | 1.76 | 5.9 | 0.986 | 0.030 | 2.3 | 59 | 0.51 | CL |
| 7 G | 1.23 | 1.00 | 1.23 | 1.75 | 5.8 | 0.987 | 0.031 | 1.4 | 59 | 0.49 | CL |
| 8 H | 2.24 | 2.00 | 1.12 | 2.5 | 5.5 | 0.984 | 0.031 | 7 | 58 | 0.53 | DL |
| 9 I | 0.60 | 0.40 | 1.50 | 1.3 | 5.2 | 0.992 | 0.029 | 9 | 58 | 0.57 | DL |
| 10 J | 1.20 | 0.50 | 2.40 | 1.38 | 6.1 | 0.957 | 0.033 | 14 | 57 | 0.82 | CL |
| 11 K | 1.70 | 1.20 | 1.42 | 1.9 | 5.4 | 0.946 | 0.036 | 19 | 60 | 0.33 | CL |
| 12 L | 5.00 | 2.00 | 2.50 | 2.5 | 5.3 | 0.948 | 0.038 | 22 | 59 | 0.50 | CL |
| 13 M | 4.00 | 3.00 | 1.33 | 3.25 | 5.4 | 0.942 | 0.036 | 20 | 60 | 0.20 | DL |
| 14 N | 2.40 | 1.20 | 2.00 | 1.9 | 5.4 | 0.944 | 0.036 | 20 | 60 | 0.03 | CL |
| 15 0 | 0.98 | 0.92 | 1.07 | 1.69 | 5.2 | 0.946 | 0.037 | 23 | 59 | 0.50 | NO |
| Comparative Example: | | | | | | | | | | | |
| 3 c | 4.00 | 0.05 | 80 | 1.04 | 6.0 | 0.983 | 0.031 | 1.5 | 59 | 0.52 | NO |
| 4 d | 0.80 | 0.80 | 1.00 | 1.6 | 5.8 | 0.918 | 0.041 | 32 | 59 | 0.34 | CL |

CL: continuous layer
DL: discontinuous layer
NO: Not observable

TABLE 6

| Toner | Charging performance of toner: Quantity of triboelectricity N/N | H/H | Charging rate decrease | Carrier contamination H/H | Evaluation of printed images N/N: Image density | Image fog | Blank areas | H/H: Image density | Image fog | Blank areas |
|---|---|---|---|---|---|---|---|---|---|---|
| Example: | | | | | | | | | | |
| 6 F | A | A | A | A | A | A | A | A | A | A |
| 7 G | A | A | A | A | A | A | A | A | A | A |
| 8 H | A | A | A | B | A | A | A | A | A | A |
| 9 I | B | A | A | B | A | B | A | A | B | A |
| 10 J | A | B | B | B | B | B | B | A | B | B |
| 11 K | A | B | B | C | B | C | C | B | A | C |
| 12 L | B | C | C | C | B | C | C | B | A | C |
| 13 M | C | C | C | C | B | B | C | C | C | C |
| 14 N | A | B | B | C | B | B | B | B | B | C |
| 15 0 | C | C | C | C | B | C | C | C | C | C |
| Comparative Example: | | | | | | | | | | |
| 3 c | D | D | C | C | C | D | C | C | D | C |
| 4 d | C | D | D | D | B | C | D | B | C | D |

TABLE 7

| Toner | Oxycarboxylic acid Type | Amount (pbw) | First reaction step pH | Polymerization conversion at a change of reaction steps (%) | Second reaction step pH | Wax component Type | Amount (pbw) |
|---|---|---|---|---|---|---|---|
| Toner Production Example: | | | | | | | |
| 1 P | 1-A | 0.5 | 5.5 | 95 | 9 | Ester wax (m.p.: 65° C.) | 5 |

TABLE 7-continued

| | Toner | Oxycarboxylic acid Type | Amount (pbw) | First reaction step pH | Polymerization conversion at a change of reaction steps (%) | Second reaction step pH | Wax component Type | Amount (pbw) |
|---|---|---|---|---|---|---|---|---|
| 2 | Q | 2-A | 0.3 | 5.0 | 40 | 11 | Paraffin wax (m.p.: 70° C.) | 5 |
| 3 | R | 1-G | 0.5 | 6.0 | 80 | 12 | Paraffin wax (m.p.: 70° C.) | 10 |
| 4 | S | 1-F | 0.1 | 6.7 | 15 | 11 | Paraffin wax (m.p.: 70° C.) | 15 |
| 5 | T | 1-J | 1.0 | 8.2 | 90 | 9 | Polypropylene wax (m.p.: 130° C.) | 4 |
| Comparative Toner Production Example: | | | | | | | | |
| 1 | e | 1-A | 0.1 | 4.3 | 60 | 8 | Polypropylene wax (m.p.: 130° C.) | 4 |
| 2 | f | 1-A | 1.0 | 7.6 | 5 | 9 | Paraffin wax (m.p.: 70° C.) | 5 |

TABLE 8

(* by number)

| | Toner | Oxycarboxylic acid A (mg) | B (mg) | A/B | (¾)B + 1 | Circle=corresponding number=average particle diameter (μm) | Average circularity | Circularity standard deviation | Toner with circularity less than 0.950 (%)* | State of dispersion of wax component (r/R)st |
|---|---|---|---|---|---|---|---|---|---|---|
| Toner Production Example: | | | | | | | | | | |
| 1 | P | 1.60 | 0.96 | 1.67 | 1.72 | 5.5 | 0.985 | 0.033 | 2.7 | 0.40 |
| 2 | Q | 0.89 | 0.44 | 2.02 | 1.33 | 5.3 | 0.982 | 0.034 | 5.0 | 0.35 |
| 3 | R | 2.75 | 2.15 | 1.28 | 2.61 | 5.1 | 0.988 | 0.032 | 3.7 | 0.76 |
| 4 | S | 0.38 | 0.13 | 2.92 | 1.10 | 5.0 | 0.982 | 0.036 | 16 | 0.92 |
| 5 | T | 3.72 | 3.41 | 1.09 | 3.56 | 4.1 | 0.927 | 0.038 | 31 | 0.06 |
| Comparative Toner Production Example: | | | | | | | | | | |
| 1 | e | 0.36 | 0.07 | 5.14 | 1.05 | 5.2 | 0.976 | 0.036 | 19 | 0.03 |
| 2 | f | 6.25 | 3.72 | 1.68 | 3.79 | 4.6 | 0.919 | 0.045 | 41 | 0.20 |

TABLE 9(A)

| | Toner | Photosensitive Drum | On 100th-sheet printing Evaluation of printed images: Image density | Spots around line images | Transfer performance | Image fog | Dot reproducibility |
|---|---|---|---|---|---|---|---|
| Example: | | | | | | | |
| 16 | P | 1 | A | A | A | A | A |
| 17 | P | 1 | A | A | A | A | A |
| 18 | P | 2 | A | A | A | A | A |
| 19 | Q | 1 | A | A | A | A | A |
| 20 | R | 1 | A | A | A | B | B |
| 21 | S | 1 | B | B | B | B | C |
| 22 | T | 1 | B | B | C | C | C |
| Comparative Example: | | | | | | | |
| 5 | e | 2 | C | D | B | C | D |
| 6 | e | 1 | C | C | B | C | C |
| 7 | f | 1 | D | C | D | D | D |

TABLE 9(B)

| | | | After 5,000-sheet printing | | | | | | | |
|---|---|---|---|---|---|---|---|---|---|---|
| | | | Evaluation of printed images | | | | | Evaluation of matching to image-forming apparatus | | |
| | Toner | Photosensitive Drum | Image density | Spots around line images | Transfer performance | Image fog | Dot reproducibility | Developing roller | Photosensitive drum | Fixing assembly |
| Example: | | | | | | | | | | |
| 16 | P | 1 | A | A | A | A | A | A | A | A |
| 17 | P | 1 | A | B | A | A | B | A | A | A |
| 18 | P | 2 | A | A | B | B | B | A | B | A |
| 19 | Q | 1 | A | A | A | A | A | A | A | A |
| 20 | R | 1 | A | B | B | B | B | A | B | B |
| 21 | S | 1 | B | C | C | C | C | B | C | C |
| 22 | T | 1 | B | C | C | C | C | C | C | C |
| Comparative Example: | | | | | | | | | | |
| 5 | e | 2 | (D) | (D) | (C) | (D) | (D) | (D) | (D) | (D) |
| 6 | e | 1 | D | D | B | D | D | D | C | D |
| 7 | f | 1 | D | D | D | D | D | D | D | C |

In the table, letter symbols in parentheses indicate the results of evaluation made after replacing photosensitive drums with new ones.

TABLE 10

| | | Oxycarboxylic acid | | | | | Wax component | |
|---|---|---|---|---|---|---|---|---|
| | Toner | Type | Amount (pbw) | First reaction step pH | Polymerization conversion at a change of reaction steps (%) | Second reaction step pH | Type | Amount (pbw) |
| Toner Production Example: | | | | | | | | |
| 6 | U | 1-A | 0.5 | 5.0 | 95 | 9 | Ester wax (Mn: 700, Mw/Mn: 1.3) | 7 |
| 7 | V | 2-A | 0.3 | 4.7 | 65 | 11 | Paraffin wax (Mn: 850, Mw/Mn: 1.9) | 7 |
| 8 | W | 1-G | 0.5 | 5.5 | 80 | 12 | Paraffin wax (Mn: 850, Mw/Mn: 1.9) | 10 |
| 9 | X | 1-F | 0.1 | 6.2 | 15 | 11 | Paraffin wax (Mn: 850, Mw/Mn: 1.9) | 15 |
| 10 | Y | 1-J | 1.0 | 8.0 | 90 | 9 | Modified polyethylene wax (Mn: 1,200, Mw/Mn: 2.2) | 4 |
| Comparative Toner Production Example: | | | | | | | | |
| 3 | g | 1-A | 0.1 | 4.3 | 60 | 8 | Modified polyethylene wax (Mn: 1,200, Mw/Mn: 2.2) | 4 |
| 4 | h | 1-A | 1.0 | 7.5 | 5 | 9 | Paraffin wax (Mn: 850, Mw/Mn: 1.9) | 7 |

TABLE 11

(* by number)

| | | Oxycarboxylic acid | | | | Circle=corresponding number=average particle diameter (μm) | Average circularity | Circularity standard deviation | Toner with circularity less than 0.950 (%)* | State of dispersion of wax component (r/R)st | Polymerizable monomer total residue (ppm) |
|---|---|---|---|---|---|---|---|---|---|---|---|
| | Toner | A (mg) | B (mg) | A/B | (¾)B + 1 | | | | | | |
| Toner Production Example: | | | | | | | | | | | |
| 6 | U | 1.66 | 1.07 | 1.55 | 1.80 | 5.7 | 0.987 | 0.028 | 2.5 | 0.41 | 45 |
| 7 | V | 1.27 | 0.59 | 2.15 | 1.44 | 5.5 | 0.984 | 0.034 | 6.6 | 0.33 | 55 |
| 8 | w | 2.70 | 2.40 | 1.13 | 2.80 | 5.4 | 0.989 | 0.027 | 3.7 | 0.75 | 120 |
| 9 | X | 0.43 | 0.15 | 2.87 | 1.11 | 5.1 | 0.978 | 0.037 | 16 | 0.90 | 100 |

TABLE 11-continued (* by number)

| Toner | Oxycarboxylic acid A (mg) | B (mg) | A/B | (¾)B + 1 | Circle=corresponding number=average particle diameter (μm) | Average circularity | Circularity standard deviation | Toner with circularity less than 0.950 (%)* | State of dispersion of wax component (r/R)st | Polymerizable monomer total residue (ppm) |
|---|---|---|---|---|---|---|---|---|---|---|
| 10 Y | 3.56 | 3.33 | 1.07 | 3.50 | 4.6 | 0.923 | 0.039 | 33 | 0.06 | 210 |
| Comparative Example: | | | | | | | | | | |
| 3 g | 0.18 | 0.02 | 9.00 | 1.02 | 5.5 | 0.985 | 0.036 | 16 | 0.03 | 220 |
| 4 h | 8.19 | 3.61 | 2.27 | 3.71 | 4.8 | 0.918 | 0.044 | 49 | 0.17 | 210 |

TABLE 12(A)

| Toner | Photosensitive Drum | On 100th-sheet printing: Evaluation of printed images: Image density | Image stains | Transfer performance | Image fog | Dot reproducibility | Charging roller contamination |
|---|---|---|---|---|---|---|---|
| Example: | | | | | | | |
| 25 U | 1 | A | A | A | A | A | A |
| 26 U | 1 | A | A | A | A | A | B |
| 27 V | 1 | A | A | A | B | A | B |
| 28 W | 1 | A | A | A | A | B | A |
| 29 X | 1 | B | B | B | C | C | C |
| 30 Y | 1 | B | B | C | B | C | B |
| Comparative Example: | | | | | | | |
| 8 g | 1 | C | C | B | D | C | D |
| 9 h | 1 | C | C | D | B | D | C |

TABLE 12(B)

| Toner | Photosensitive Drum | After 3,000-sheet printing: Evaluation of printed images: Image density | Image stains | Transfer performance | Image fog | Dot reproducibility | Evaluation of matching to image-forming apparatus: Developing roller | Photosensitive drum | Fixing assembly |
|---|---|---|---|---|---|---|---|---|---|
| Example: | | | | | | | | | |
| 25 U | 1 | A | A | A | A | A | A | A | A |
| 26 U | 1 | A | A | A | B | B | A | A | A |
| 27 V | 1 | A | A | A | B | A | A | B | A |
| 28 W | 1 | A | B | A | B | B | A | B | B |
| 29 X | 1 | B | C | B | C | C | B | C | C |
| 30 Y | 1 | B | B | C | C | C | C | C | C |
| Comparative Example: | | | | | | | | | |
| 8 g | 1 | — | — | — | — | — | — | — | — |
| 9 h | 1 | C | D | D | D | D | D | D | D |

TABLE 13(A)

| Toner | Photosensitive Drum | On 100th-sheet printing: Evaluation of printed images: Image density | Spot around line images | Transfer performance | Image fog | Dot reproducibility | Charging roller contamination |
|---|---|---|---|---|---|---|---|
| Example: | | | | | | | |
| 33 U | 1 | A | A | A | A | A | A |
| 34 U | 2 | A | A | A | A | A | B |
| 35 V | 1 | A | A | A | A | A | A |

TABLE 13(A)-continued

| | | | On 100th-sheet printing | | | | | |
|---|---|---|---|---|---|---|---|---|
| | | Photo- | Evaluation of printed images | | | | | Charging |
| | Toner | sensitive Drum | Image density | Spot around line images | Transfer performance | Image fog | Dot reproducibility | roller contamination |
| 36 | W | 1 | A | A | A | A | B | B |
| 37 | X | 1 | B | B | B | C | C | C |
| 38 | Y | 1 | B | B | C | B | C | B |
| Comparative Example: | | | | | | | | |
| 10 | g | 1 | C | C | B | C | C | D |
| 11 | h | 1 | D | C | D | C | D | C |

TABLE 13(B)

| | | | After 3,000-sheet printing | | | | | | | |
|---|---|---|---|---|---|---|---|---|---|---|
| | | | Evaluation of printed images | | | | | Evaluation of matching to image-forming apparatus | | |
| | Toner | Photo-sensitive Drum | Image density | Spots around line images | Transfer performance | Image fog | Dot reproducibility | Developing roller | Photo-sensitive drum | Fixing assembly |
| Example: | | | | | | | | | | |
| 33 | U | 1 | A | A | A | A | A | A | A | A |
| 34 | U | 2 | A | A | A | A | A | A | A | A |
| 35 | V | 1 | A | B | A | A | B | A | A | A |
| 36 | W | 1 | A | B | A | B | B | A | B | B |
| 37 | X | 1 | B | C | B | C | C | B | C | C |
| 38 | Y | 1 | B | B | C | C | C | C | C | C |
| Comparative Example: | | | | | | | | | | |
| 10 | g | 1 | — | — | — | — | — | — | — | — |
| 11 | h | 1 | D | D | D | D | D | D | D | D |

What is claimed is:

1. A toner comprising: toner particles containing at least a binder resin, a colorant, a wax component and an oxycarboxylic acid or its sodium, potassium, ammonium or aliphatic ammonium salt, wherein a weight of oxycarboxylic acid or its sodium, potassium ammonium or aliphatic ammonium salt extracted with methanol from 1 g of the toner is represented by A (mg) and a weight of oxycarboxylic acid or its sodium, potassium, ammonium or aliphatic ammonium salt extracted with an aqueous 0.1 mol/liter sodium hydroxide solution from 1 g of the toner is represented by B (mg), the toner satisfies:

$$1.05 \leqq A/B \leqq 3.00,$$

and $$0.10 \leqq B \leqq 3.50$$

and said oxycarboxylic acid or said salt thereof is selected from the groups consisting of compounds represented by the following Formulas (1) and (2):

Formula (1)

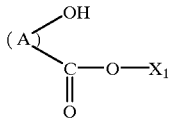

wherein (A) is selected from the group consisting of the following formulas (I) to (IX);

(I)

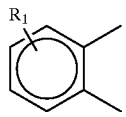

(II)

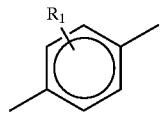

wherein $R_1$ represents a hydrogen atom, or at least one substituent selected from the group consisting of an alkyl group having 1 to 18 carbon atoms, an alkenyl group having 2 to 18 carbon atoms, an aralkyl group, an alkoxyl group, a halogen atom, a nitro group, a cyano group, an amino group, a carboxyl group and a hydroxyl group;

(III)

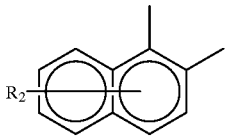

(IV)

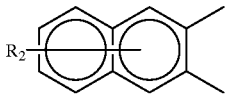

(V)

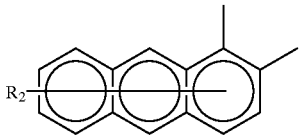

(VI)

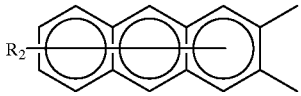

wherein $R_2$ represents a hydrogen atom, or at least one substituent selected from the group consisting of an alkyl group having 1 to 18 carbon atoms, an alkoxyl group having 1 to 18 carbon atoms, a halogen atom and a nitro group;

(VII)

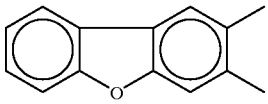

(VIII)

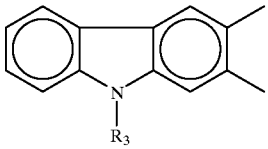

(IX)

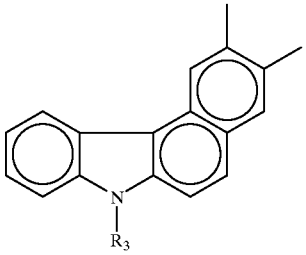

wherein $R_3$ represents a hydrogen atom, an alkyl group having 1 to 22 carbon atoms or an alkenyl group having 2 to 22 carbon atoms; and $X_1$ represents a hydrogen atom, a sodium atom, a potassium atom, an ammonium group or an aliphatic ammonium group, Formula (2)

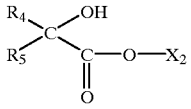

wherein $X_2$ represents a hydrogen atom, a sodium atom, a potassium atom, an ammonium group or an aliphatic ammonium group; $R_4$ represents an alkyl group having 1 to 22 carbon atoms, an alkenyl group having 2 to 22 carbon atoms or an aryl group; and $R_5$ represents a hydrogen atom, an alkyl group having 1 to 22 carbon atoms, an alkenyl group having 2 to 22 carbon atoms, an aryl group or an alkoxyl group.

2. The toner according to claim 1, wherein the weight A of oxycarboxylic acid extracted with methanol from the toner and the weight B of oxycarboxylic acid extracted with an aqueous 0.1 mol/liter sodium hydroxide solution therefrom satisfies:

$$A \leqq (3/4)B+1.$$

3. The toner according to claim 1, wherein, in a number-based circle-corresponding diameter/circularity scatter diagram of said toner as measured with a flow type particle image analyzer, a circle-corresponding number-average particle diameter D1 is from 2 μm to 10 μm, an average circularity is from 0.920 to 0.995 and a circularity standard deviation is less than 0.040.

4. The toner according to claim 3, wherein, in the circle-corresponding diameter/circularity scatter diagram, the average circularity is from 0.950 to 0.995 and the circularity standard deviation is less than 0.035.

5. The toner according to claim 3, wherein, in the circle-corresponding diameter/circularity scatter diagram, the average circularity is from 0.970 to 0.990 and the circularity standard deviation is less than 0.035.

6. The toner according to claim 1, wherein, in a number-based circle-corresponding diameter/circularity scatter diagram of said toner as measured with a flow type particle image analyzer, a toner having an average circularity less than 0.950 is in a content of 15% by number or less.

7. The toner according to claim 1, wherein said wax is dispersed in the form of substantially a spherical or spindle-shaped island or islands in such a way that, when in cross-sectional observation of toner particles with a transmission electron microscope (TEM);

(1) twenty planes of cross sections of toner particles having length R (μm) satisfying the relation of $0.9 \leqq R/D4 \leqq 1.1$ with respect to weight-average particle diameter D4 (μm) are selected; and (2) length r of the largest in phase-separated structure ascribable to the wax present in each of the cross-sectional planes of the toner particles thus selected is measured;

an arithmetic mean of r/R, $(r/R)_{st}$, satisfies:

$$0.05 \leqq (r/R)_{st} \leqq 0.95.$$

8. The toner according to claim 7, wherein the $(r/R)_{st}$ satisfies:

$$0.25 \leqq (r/R)_{st} \leqq 0.90.$$

9. A process for producing the toner of claim 1, comprising:

a granulation step of dispersing in an aqueous dispersion medium a polymerizable monomer composition containing at least a polymerizable vinyl monomer, a colorant, a wax component, a polymerization initiator and an oxycarboxylic acid or its sodium, potassium, ammonium or aliphatic ammonium salt, to form particles of the polymerizable monomer composition; and a polymerization step of polymerizing the polymerizable vinyl monomer present in the particles of the polymerizable monomer composition to form toner particles;

wherein a reaction to polymerize the polymerizable vinyl monomer in the course from the granulation step to the polymerization step comprises a first reaction step carried out to enhance a polymerization conversion of the polymerizable vinyl monomer to 10% or higher while keeping pH of the aqueous dispersion medium at 4.5 to 8.5, and a second reaction step carried out after the first reaction step while adjusting the pH of the aqueous dispersion medium to 9 to 13 to further enhance the polymerization conversion, said oxycarboxylic acid or said salt thereof is selected from the group consisting of compounds represented by the following Formulas (1) and (2):

Formula (1)

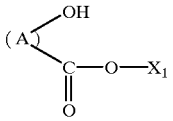

wherein (A) is selected from the group consisting of the following formulas (I) to (IX), (I)

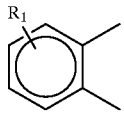

(II)

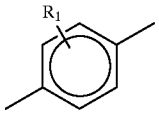

wherein $R_1$ represents a hydrogen atom, or at least one substituent selected from the group consisting of an alkyl group having 1 to 18 carbon atoms, an alkenyl group having 2 to 18 carbon atoms, an aralkyl group, an alkoxyl group, a halogen atom, a nitro group, a cyano group, an amino group, a carboxyl group and a hydroxyl group;

(III)

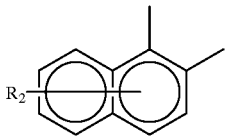

-continued (IV)

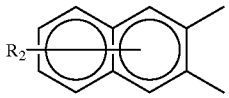

(V)

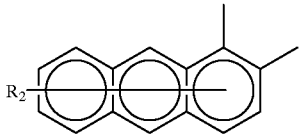

(VI)

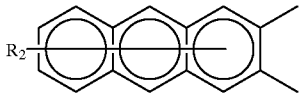

wherein $R_1$ represents a hydrogen atom, or at least one substituent selected from the group consisting of an alkyl group having 1 to 18 carbon atoms, an alkoxyl group having 1 to 18 carbon atoms, a halogen atom and a nitro group;

(VII)

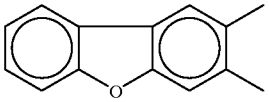

(VIII)

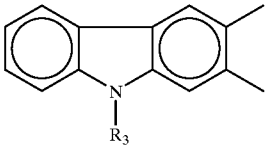

(IX)

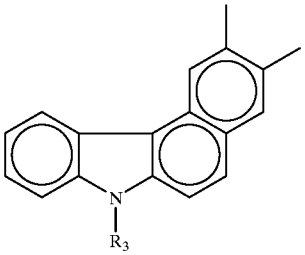

wherein $R_3$ represents a hydrogen atom, an alkyl group having 1 to 22 carbon atoms or an alkenyl group having 2 to 22 carbon atoms; and $X_1$ represents a hydrogen atom, a sodium atom, a potassium atom, an ammonium group or an aliphatic ammonium group;

Formula (2)

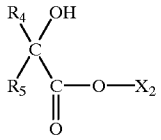

wherein $X_2$ represents a hydrogen atom, a sodium atom, a potassium atom, an ammonium group or an aliphatic ammonium group; $R_4$ represents an alkyl group having 1 to 22 carbon atoms, an alkenyl group having 2 to 22 carbon atoms or an aryl group; and $R_5$ represents a hydrogen atom, an alkyl group having 1 to 22 carbon atoms, an alkenyl group having 2 to 22 carbon atoms, an aryl group or an alkoxyl group.

10. The process according to claim 9, wherein the pH of the aqueous dispersion medium during the polymerization in the first reaction step is kept at 4.5 to 6.0.

11. A process for producing the toner of claim 1, comprising:

a granulation step of dispersing in an aqueous dispersion medium a polymerizable monomer composition containing at least a polymerizable vinyl monomer, a colorant, a wax component, a polymerization initiator and an oxycarboxylic acid or its sodium, potassium, ammonium or aliphatic ammonium salt, to form particles of the polymerizable monomer composition;

a polymerization step of polymerizing the polymerizable vinyl monomer present in the particles of the polymerizable monomer composition to form toner particles;

a distillation step of removing the polymerizable vinyl monomer remaining in the toner particles;

a filtration step of solid-liquid separating the toner particles from the aqueous dispersion medium; and a washing step of washing the toner particles;

wherein a reaction to polymerize the polymerizable vinyl monomer in the course from the granulation step to the polymerization step is carried out in the aqueous dispersion medium, kept at pH of 4.5 to 8.5, and then, after the pH of the aqueous dispersion medium is adjusted to 9 to 13, the distillation step is carried out at a temperature not lower than the glass transition temperature of the binder resin of the toner;

said oxycarboxylic acid or said salt thereof is selected from the group consisting of compounds represented by the following Formulas (1) and (2):

Formula (1)

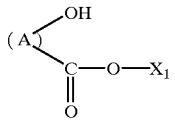

wherein (A) is selected from the group consisting of the following formulas (I) to (IX);

(I)

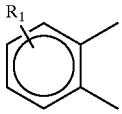

(II)

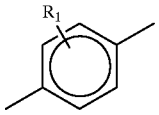

wherein $R_1$ represents a hydrogen atom, or at least one substituent selected from the group consisting of an alkyl group having 1 to 18 carbon atoms, an alkenyl group having 2 to 18 carbon atoms, an aralkyl group, an alkoxyl group, a halogen atom, a nitro group, a cyano group, an amino group, a carboxyl group and a hydroxyl group;

(III)

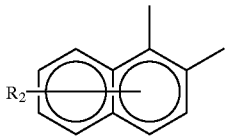

(IV)

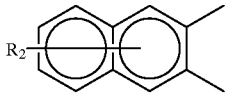

(V)

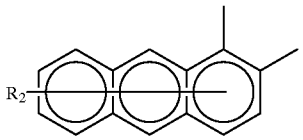

(VI)

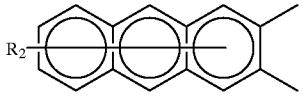

wherein $R_2$ represents a hydrogen atom, or at least one substituent selected from the group consisting of an alkyl group having 1 to 18 carbon atoms, an alkoxyl group having 1 to 18 carbon atoms, a halogen atom and a nitro group; and (VII)

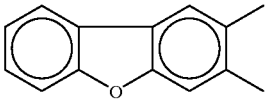

(VIII)

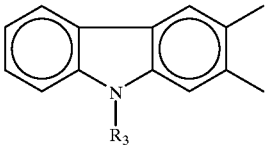

(IX)

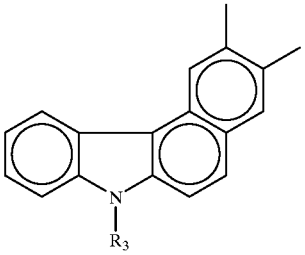

wherein $R_3$ represents a hydrogen atom, an alkyl group having 1 to 22 carbon atoms or an alkenyl group having 2 to 22 carbon atoms; and $X_1$ represents a hydrogen atom, a sodium atom, a potassium atom, an ammonium group or an aliphatic ammonium group;

Formula (2)

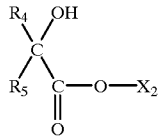

wherein $X_2$ represents a hydrogen atom, a sodium atom, a potassium atom, an ammonium group or an aliphatic ammonium group; $R_4$ represents an alkyl group having 1 to 22 carbon atoms, an alkenyl group having 2 to 22 carbon atoms or an aryl group; and $R_5$ represents a hydrogen atom, an alkyl group having 1 to 22 carbon atoms, an alkenyl group having 2 to 22 carbon atoms, an aryl group or an alkoxyl group.

12. The process according to claim 11, wherein the reaction to polymerize the polymerizable vinyl monomer in the course of from the granulation step to the polymerization step is carried out in the aqueous dispersion medium, kept at a pH of 4.5 to 6.0.

13. The process according to claim 11, wherein a water-soluble initiator is added in said aqueous dispersion medium.

14. An image-forming method comprising;

a charging step of charging an image-bearing member for holding thereon an electrostatic latent image;

an exposure step of subjecting the image-bearing member thus charged to exposure to form an electrostatic latent image;

a developing step of developing the electrostatic latent image by using a toner held on the surface of a toner-carrying member, to from a toner image; and a transfer step of transferring the toner image formed on the image-bearing member, to a transfer medium via, or not via, an intermediate transfer member; wherein;

said toner comprises toner particles containing at least a binder resin, a colorant, a wax component and an oxycarboxylic acid or a sodium, potassium, ammonium or aliphatic ammonium salt thereof; and where a weight of oxycarboxylic acid or said salt thereof extracted with methanol from 1 g of the toner is represented by A (mg) and a weight of oxycarboxylic acid or said salt thereof extracted with an aqueous 0.1 mol/liter sodium hydroxide solution from 1 g of the toner is represented by B (mg), the toner satisfies:

$$1.05 \leq A/B \leq 3.00,$$

and $$0.10 \leq B \leq 3.50$$

said oxycarboxylic acid or said salt thereof is selected from the groups consisting of compounds represented by the following Formulas (1) and (2):

Formula (1)

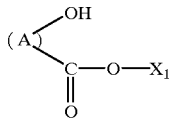

wherein (A) is selected from the group consisting of the following formulas (I) to (IX);

(I)

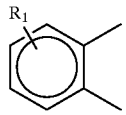

(II)

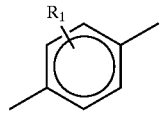

wherein $R_1$ represents a hydrogen atom, or at least one substituent selected from the group consisting of an alkyl group having 1 to 18 carbon atoms, an alkenyl group having 2 to 18 carbon atoms, an aralkyl group, an alkoxyl group, a halogen atom, a nitro group, a cyano group, an amino group, a carboxyl group and a hydroxyl group;

(III)

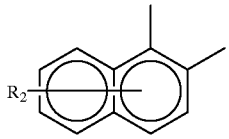

(IV)

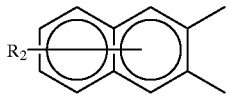

(V)

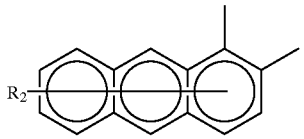

(VI)

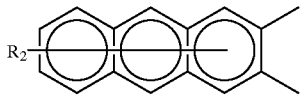

wherein $R_2$ represents a hydrogen atom, or at least one substituent selected from the group consisting of an alkyl group having 1 to 18 carbon atoms, an alkoxyl group having 1 to 18 carbon atoms, a halogen atom and a nitro group;

(VII)

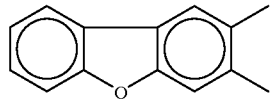

(VIII)

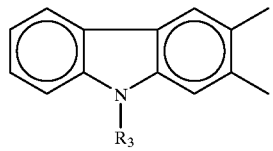

-continued (IX)

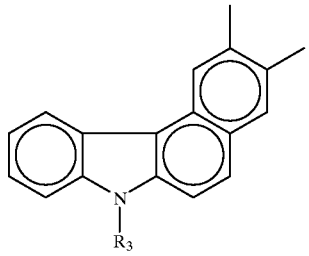

wherein $R_3$ represents a hydrogen atom, an alkyl group having 1 to 22 carbon atoms or an alkenyl group having 2 to 22 carbon atoms; and $X_1$ represents a hydrogen atom, a sodium atom, a potassium atom, an ammonium group or an aliphatic ammonium group;

Formula (2)

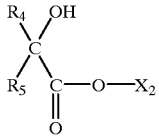

wherein $X_2$ represents a hydrogen atom, a sodium atom, a potassium atom, an ammonium group or an aliphatic ammonium group; $R_4$ represents an alkyl group having 1 to 22 carbon atoms, an alkenyl group having 2 to 22 carbon atoms or an aryl group; and $R_5$ represents a hydrogen atom, an alkyl group having 1 to 22 carbon atoms, an alkenyl group having 2 to 22 carbon atoms, an aryl group or an alkoxyl group.

15. The image-forming method according to claim 14, wherein the weight A of oxycarboxylic acid extracted with methanol from the toner and the weight B of oxycarboxylic acid extracted with an aqueous 0.1 mol/liter sodium hydroxide solution therefrom satisfies:

$$A \leqq (3/4)B+1.$$

16. The image-forming method according to claim 14, wherein, in a number-based circle-corresponding diameter/circularity scatter diagram of said toner as measured with a flow type particle image analyzer, a circle-corresponding number-average particle diameter D1 is from 2 $\mu$m to 10 $\mu$m, an average circularity of from 0.920 to 0.995 and a circularity standard deviation is less than 0.040.

17. The image-forming method according to claim 16, wherein, in the circle-corresponding diameter/circularity scatter diagram, the average circularity of said toner is from 0.950 to 0.995 and the circularity standard deviation is less than 0.035.

18. The image-forming method according to claim 16, wherein, in the circle-corresponding diameter/circularity scatter diagram, the average circularity of said toner is from 0.970 to 0.990 and the circularity standard deviation is less than 0.035.

19. The image-forming method according to claim 14, wherein, in a number-based circle-corresponding diameter/circularity scatter diagram of said toner as measured with a flow type particle image analyzer, a toner having an average circularity less than 0.950 is in a content of 15% by number or less.

20. The image-forming method according to claim 14, wherein said wax is dispersed in the form of substantially a spherical or spindle-shaped island or islands in such a way that, when in cross-sectional observation of toner particles with a transmission electron microscope (TEM);

(1) twenty planes of cross sections of toner particles having length R ($\mu$m) satisfying the relation of $0.9 \leqq R/D4 \leqq 1.1$ with respect to weight-average particle diameter D4 ($\mu$m) are selected; and (2) length r of the largest in phase-separated structure ascribable to the wax present in each of the cross-sectional planes of the toner particles thus selected is measured;

the arithmetic mean of r/R, $(r/R)_{st}$, satisfies:

$$0.05 \leqq (r/R)_{st} \leqq 0.95.$$

21. The image-forming method according to claim 20, wherein the $(r/R)_{st}$ satisfies:

$$0.25 \leqq (r/R)_{st} \leqq 0.90.$$

22. The image-forming method according to claim 14, wherein in said developing step the electrostatic latent image is developed by bringing a toner layer formed by the toner held on the toner-carrying member, into contact with the surface of the image-bearing member.

23. The image-forming method according to claim 14, wherein after said transfer step the image-bearing member is cleaned by a cleaning-at-development system in which the toner remaining on the surface of the image-bearing member is collected by a developing assembly in said developing step.

24. The image-forming method according to claim 14, wherein the image-bearing member comprises an electrophotographic photosensitive member, and the photosensitive member has a contact angle to water of 85 degrees or more.

25. The image-forming method according to claim 24, wherein a surface layer formed of a resin in which a compound powder containing a fluorine atom has been dispersed is formed on the surface of said photosensitive member.

26. The image-forming method according to claim 25, wherein said compound powder containing a fluorine atom comprises a fluorine resin powder.

27. The image-forming method according to claim 14, wherein in said developing step the movement direction of the surface of the toner-carrying member in a developing zone is the same direction as the movement direction of the image-bearing member.

28. The image-forming method according to claim 27, wherein in said developing step the movement speed of the surface of the toner-carrying member in the developing zone is a speed 1.05 to 3.0 times the movement speed of the surface of the image-bearing member.

29. The image-forming method according to claim 14, wherein in said developing step the layer thickness of a toner layer formed by the toner held on the toner-carrying member is regulated by bringing a toner layer thickness regulation member into touch with the toner.

30. The image-forming method according to claim 14, wherein said toner is held in a developing assembly, and the toner held in the developing assembly is fed onto the toner-carrying member by means of a toner feeding member for feeding the toner onto the toner-carrying member.

31. The image-forming method according to claim 30, wherein said toner feeding member is a toner-coating roller coming in contact with the surface of the toner-carrying member, and the movement direction of the surface of the toner-coating roller is the direction opposite to the movement direction of the toner-carrying member.

32. The image-forming method according to claim 31, wherein a development bias voltage is applied to said toner-carrying member at the time of development, and a coating bias voltage is applied to said toner-coating roller at the time of feeding the toner.

33. The image-forming method according to claim 32, wherein the coating bias voltage applied to said toner-coating roller is set higher than the development bias voltage applied to said toner-carrying member in terms of absolute value, and said toner-coating roller feeds the toner to the surface of said toner-carrying member and, after development, strips the toner remaining on the surface of said toner-carrying member.

34. The image-forming method according to claim 32, wherein said image-bearing member has a light-area potential of from 0 V to 250 V as absolute value and has a dark-area potential of from 300 V to 1,000 V, the coating bias voltage applied to said toner-coating roller is from 100 V to 900 V as absolute value, the development bias voltage applied to said toner-carrying member is from 100 V to 900 V as absolute value, the coating bias voltage is higher by 10 V to 400 V than the development bias voltage as absolute value, and said toner-coating roller feeds the toner to the surface of said toner-carrying member and, after development, strips the toner remaining on the surface of said toner-carrying member.

35. The image-forming method according to claim 14, wherein in the transfer step a transfer member to which a voltage is applied from the outside is brought into contact with the image-bearing member via the transfer medium to transfer to the transfer medium the toner image held on the image-bearing member.

36. The image-forming method according to claim 14, wherein in said transfer step a recording medium is used as the transfer medium and the toner image held on the image-bearing member is transferred to the recording medium; the toner image transferred to the recording medium being fixed to the recording medium in a fixing step.

37. The image-forming method according to claim 14, wherein in said charging step a charging member to which a voltage is applied from the outside is brought into contact with the image-bearing member to charge the image-bearing member.

38. The image-forming method according to claim 37, wherein in said charging step a direct-current voltage is applied to the charging member from the outside.

39. The image-forming method according to claim 37, wherein in said charging step a direct-current voltage and an alternating-current voltage less than twice the discharge start voltage in the direct-current voltage are applied to the charging member from the outside.

* * * * *

UNITED STATES PATENT AND TRADEMARK OFFICE

CERTIFICATE OF CORRECTION

PATENT NO. : 6,346,356 B1 
DATED : February 12, 2002
INVENTOR(S) : Manabu Ohno et al.

It is certified that error appears in the above-identified patent and that said Letters Patent is hereby corrected as shown below:

Column 22,
Line 34, “All” should read -- Such structures include all --.

Column 24,
Line 63, “have” should read -- has --.

Column 29,
Line 39, “Perking Elmer” should read -- Perkin-Elmer --.

Column 30,
Line 37, should read -- Detector: FID (split ratio: 1:20) --.

Column 33,
Line 1, “spongy” should read -- spongy form of --.

Column 37,
Line 11, “seed,” should read -- speed, --.

Column 39,
Line 63, “after” should read -- after being --.

Column 41,
Line 16, “counter direction” should read -- direction counter to --.

Column 50,
Line 36, “reduced” should read -- at a reduced --.

Column 53,
Line 31, “used” should read -- used for --.

Column 57,
Line 11, “plane” should read -- plain --.

Column 63,
Line 41, “plane” should read -- plain --.

Column 69,
Table 3(A), “4 D c c” should read -- 4 D C C --.

UNITED STATES PATENT AND TRADEMARK OFFICE

CERTIFICATE OF CORRECTION

PATENT NO. : 6,346,356 B1 
DATED : February 12, 2002
INVENTOR(S) : Manabu Ohno et al.

It is certified that error appears in the above-identified patent and that said Letters Patent is hereby corrected as shown below:

Column 71,
Table 5, “15 0” should read -- 15 O --;
Table 6, “15 0” should read -- 15 O --.

Column 75,
Table 11, “8 w” should read -- 8 W --.

Signed and Sealed this

Seventeenth Day of September, 2002

*Attest:*

*Attesting Officer*

JAMES E. ROGAN
*Director of the United States Patent and Trademark Office*